US008354803B2

(12) United States Patent
Newman, Jr. et al.

(10) Patent No.: US 8,354,803 B2
(45) Date of Patent: Jan. 15, 2013

(54) HYBRID LIGHT SOURCE

(75) Inventors: Robert C. Newman, Jr., Emmaus, PA (US); Keith Joseph Corrigan, Allentown, PA (US); Aaron Dobbins, Hopedale, MA (US); Mehmet Ozbek, Allentown, PA (US); Mark Taipale, Harleysville, PA (US); Joel S. Spira, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 13/476,433

(22) Filed: May 21, 2012

(65) Prior Publication Data

US 2012/0268020 A1 Oct. 25, 2012

Related U.S. Application Data

(60) Division of application No. 12/553,612, filed on Sep. 3, 2009, now Pat. No. 8,228,002, which is a continuation-in-part of application No. 12/205,571, filed on Sep. 5, 2008, now Pat. No. 8,008,866.

(51) Int. Cl.
*H05B 37/02* (2006.01)

(52) U.S. Cl. ..... 315/291; 315/178; 315/324

(58) Field of Classification Search ..... 315/51, 315/178, 194, 209 R, 210, 224–226, 246–247, 315/250, 291, 307, 308, 312, 324, DIG. 4, 315/DIG. 5, DIG. 7

See application file for complete search history.

(56) References Cited

U.S. PATENT DOCUMENTS

| | | | | |
|---|---|---|---|---|
| 5,430,356 | A * | 7/1995 | Ference et al. | 315/291 |
| 5,569,983 | A * | 10/1996 | McGuire et al. | 315/297 |
| 6,909,239 | B2 * | 6/2005 | Gauna | 315/134 |
| 2005/0134200 | A1 | 6/2005 | Kawarazaki | |
| 2005/0168168 | A1 | 8/2005 | Elliott | |
| 2007/0182347 | A1 | 8/2007 | Shteynberg et al. | |
| 2007/0247089 | A1 | 10/2007 | Summerland | |
| 2008/0158871 | A1 | 7/2008 | McAvoy et al. | |
| 2008/0203934 | A1 | 8/2008 | Van Meurs | |
| 2008/0258647 | A1 | 10/2008 | Scianna | |

FOREIGN PATENT DOCUMENTS

| | | |
|---|---|---|
| DE | 32 24 997 | 1/1984 |
| EP | 0 147 922 | 7/1985 |
| WO | WO 2007/091194 A1 | 8/2007 |

OTHER PUBLICATIONS

International Preliminary Report on Patentability dated Mar. 11, 2011 issued in corresponding PCT International Application No. PCT/US2009/005003.

Search Report issued by PCT on Aug. 26, 2010 in connection with corresponding PCT application No. PCT/US2009/005003.

* cited by examiner

*Primary Examiner* — Thuy Vinh Tran

(74) *Attorney, Agent, or Firm* — Ostrolenk Faber LLP

(57) ABSTRACT

A hybrid light source comprises a discrete-spectrum lamp (for example, a fluorescent lamp) and a continuous-spectrum lamp (for example, a halogen lamp). A control circuit individually controls the amount of power delivered to the discrete-spectrum lamp and the continuous-spectrum lamp in response to a phase-controlled voltage generated by a connected dimmer switch, such that a total light output of the hybrid light source ranges throughout a dimming range. The continuous-spectrum lamp is driven by a continuous-spectrum lamp drive circuit, which is operable to conduct a charging current of a power supply of the dimmer switch and to provide a path for enough current to flow through the hybrid light source, such that the magnitude of the current exceeds rated latching and holding currents of a thyristor of the dimmer.

32 Claims, 29 Drawing Sheets

HYBRID LIGHT SOURCE

RELATED APPLICATIONS

The present application is a divisional application under 37 C.F.R. §1.53(b) of prior U.S. patent application Ser. No. 12/553,612, filed Sep. 3, 2009 entitled HYBRID LIGHT SOURCE, now U.S. Pat. No. 8,228,002 B2, which is a continuation-in-part of commonly-assigned, U.S. patent application Ser. No. 12/205,571, filed Sep. 5, 2008, now U.S. Pat. No. 8,008,866, issued Aug. 30, 2011, entitled HYBRID LIGHT SOURCE, the entire disclosure of which is hereby incorporated by reference.

BACKGROUND OF THE INVENTION

1. Field of the Invention

The present invention relates to light sources, and more specifically, to a hybrid light source having a continuous-spectrum light source, a discrete-spectrum light source, and drive circuits for controlling the amount of power delivered to each of the light sources.

2. Description of the Related Art

From the dawn of mankind, the sun has proved to be a reliable source of illumination for humans on Earth. The sun is a black-body radiator, which means that it provides an essentially continuous spectrum of radiated light that includes wavelengths of light ranging across the full range of the visible spectrum. As the human eye has evolved over millennia, man has become accustomed to the continuous spectrum of visible light provided by the sun. When a continuous-spectrum light source, such as the sun, shines on an object, the human eye is able to perceive a wide range of colors from the visible spectrum. Accordingly, continuous-spectrum light sources (i.e., black-body radiators) provide a more pleasing and accurate visual experience for a human observer.

The invention of the incandescent light bulb introduced to mankind an artificial light source that approximates the light output of a black-body radiator. Incandescent lamps operate by conducting electrical current through a filament, which produces heat and thus emits light. Since incandescent lamps (including halogen lamps) generate a continuous spectrum of light, these lamps are often considered continuous-spectrum light sources. FIG. 1A is a simplified graph showing a portion of the continuous spectrum $SP_{CONT}$ of a halogen lamp, which ranges across the visible spectrum from a wavelength of approximately 380 nm to a wavelength of approximately 780 nm (Mark S. Rea, Illuminating Engineering Society of North America, The IESNA Lighting Handbook, Ninth Edition, 2000, pg. 4-1). For example, blue light comprises wavelengths from approximately 450 nm to 495 nm and red light comprises wavelengths from approximately 620 nm to 750 nm. Objects illuminated by incandescent lamps provide pleasing and accurate color rendering information to the human eye. However, continuous-spectrum light sources, such as incandescent and halogen lamps, unfortunately tend to be very inefficient. Much of the radiant energy generated by incandescent lamps is outside of the visible spectrum, e.g., in the infrared and ultra-violet range (Id. at pg. 6-2). For example, only approximately 12.1% of the input energy used to power a 1000-Watt incandescent lamp may result in radiation in the visible spectrum (Id. at pg. 6-11). In addition, the energy consumed in the generation of heat in the filament of an incandescent lamp is essentially wasted since it is not used to produce visible light.

As more steps are being taken in order to reduce energy consumption in the present day and age, the use of high-efficiency light sources is increasing, while the use of low-efficiency light sources (i.e., incandescent lamps, halogen lamps, and other low-efficacy light sources) is decreasing. High-efficiency light sources may comprise, for example, gas discharge lamps (such as compact fluorescent lamps), phosphor-based lamps, high-intensity discharge (HID) lamps, light-emitting diode (LED) light sources, and other types of high-efficacy light sources. A fluorescent lamp comprises, for example, a phosphor-coated glass tube containing mercury vapor and a filament at each end of the lamp. Electrical current is conducted through the filaments to excite the mercury vapor and produce ultraviolet light that then causes phosphor to emit visible light. A much greater percentage of the radiant energy of fluorescent lamps is produced inside the visible spectrum than the radiant energy produced by incandescent lamps. For example, approximately 20.1% of the input energy used to power a typical cool white fluorescent lamp may result in radiation in the visible spectrum (Id. at pg. 6-29).

Alas, a typical high-efficiency light source does not typically provide a continuous spectrum of light output, but rather provides a discrete spectrum of light output (Id. at pp. 6-23, 6-24). FIG. 1A shows the discrete spectrum $SP_{DISC\text{-}FLUOR}$ of a compact fluorescent lamp. FIG. 1B shows the discrete spectrum $SP_{DISC\text{-}LED}$ of an LED lighting fixture, for example, as manufactured by LLF, Inc. High-efficiency light sources that provide a discrete spectrum of light output are thus called discrete-spectrum light sources. Most of the light produced by a discrete-spectrum light source is concentrated primarily around one or more discrete wavelengths, e.g., around four different wavelengths as shown in FIG. 1A. When there are large ranges between the discrete wavelengths (as shown in FIG. 1A), certain colors are absent from the light spectrum of a discrete-spectrum light source and, thus the human eye receives less color-related information. Objects viewed under a discrete-spectrum light source may not exhibit the full range of colors that would be seen if viewed under a continuous-spectrum light source. When illuminated by a discrete-spectrum light source, some colors may even shift from those that are seen when the object is illuminated with a continuous-spectrum light source. For example, the color of someone's eyes or hair may appear different when viewed outdoors under sunlight or moonlight as compared to when viewed indoors under a fluorescent lamp. As a result, the visual experience, as well as the attitude, behavior, and productivity, of a human may be negatively affected when discrete-spectrum light sources are used.

Recent studies have shown that color affects perception, cognition, and mood of human observers. For example, one particular study completed by the Sauder School of Business at the University of British Columbia suggests that red colors lead to enhanced performance on detail-oriented tasks, while blue colors result in enhanced performance on creative tasks (Ravi Mehta and Rui Zhu, "Blue or Red? Exploring the Effect of Color on Cognitive Task Performances", Science Magazine, Feb. 5, 2009). As stated in a recent New York Times article, "the color red can make people's work more accurate, and blue can make people more creative" (Pam Belleck, "Reinvent Wheel? Blue Room. Defusing a Bomb? Red Room.", The New York Times, Feb. 5, 2009). Therefore, since the type of light sources used in a space can affect the colors in the space, the light sources may affect the attitude, behavior, and productivity, of occupants of the space.

Lighting control devices, such as dimmer switches, allow for the control of the amount of power delivered from a power source to a lighting load, such that the intensity of the lighting load may be dimmed. Both high-efficiency and low-efficiency light sources can be dimmed, but the dimming characteristics of these two types of light sources typically differ. A low-efficiency light source can usually be dimmed to very low light output levels, typically below 1% of the maximum light output. However, a high-efficiency light source cannot be typically dimmed to very low output levels.

The color of illumination is characterized by two independent properties: correlated color temperature and color rendering (Illuminating Engineering Society of North America, The IESNA Lighting Handbook, Ninth Edition, 2000, pg. 3-40). Low-efficiency (i.e., continuous-spectrum) light sources and high-efficiency (i.e., discrete-spectrum) light sources typically provide different correlated color temperatures and color rendering indexes as the light sources are dimmed. Correlated color temperature refers to the color appearance of a specific light source (Id. at pg. 3-40). A lower color temperature correlates to a color shift towards the red portion of the color spectrum which creates a warmer effect to the human eye, while higher color temperatures result in blue (or cool) colors (Id.). FIG. 1C is a simplified graph showing examples of a correlated color temperature $T_{CFL}$ of a 26-Watt compact fluorescent lamp (i.e., a high-efficiency light source) and a correlated color temperature $T_{INC}$ of a 100-Watt incandescent lamp (i.e., a low-efficiency light source) with respect to the percentage of the maximum lighting intensity to which the lamps are presently illuminated. The color of the light output of a low-efficiency light source (such as an incandescent lamp or a halogen lamp) typically shifts more towards the red portion of the color spectrum when the low-efficiency light source is dimmed to a low light intensity. This red color shift can invoke feelings of comfort to the human observer, since the reddish tint of illumination is often associated with romantic candlelit dinners and cozy campfires. In contrast, the color of the light output of a high-efficiency light source (such as a compact fluorescent lamp or an LED light source) is normally relatively constant through its dimming range with a slightly blue color shift and thus tends to be perceived as a cooler effect to the eye.

Color rendering represents the ability of a specific light source to reveal the true color of an object, e.g., as compared to a reference light source having the same correlated color temperature (Id. at pg. 3-40). Color rendering is typically characterized in terms of the CIE color rendering index, or CRI (Id.). The color rendering index is a scale used to evaluate the capability of a lamp to replicate colors accurately as compared to a black-body radiator. The greater the CRI, the more closely a lamp source matches a black-body radiator. Typically, low-efficiency light sources, such as incandescent lamps, have high-quality color rendering, and thus, have a CRI of one hundred, whereas some high-efficiency light sources, such as fluorescent lamps, have a CRI of eighty as they do not provide as high-quality color rendering as compared to low-efficiency light sources. Light sources having a high CRI (e.g., greater than 80) allow for improved visual performance and color discrimination (Id. at pp. 3-27, 3-28).

Generally, people have grown accustomed to the dimming performance and operation of low-efficiency light sources. As more people begin using high-efficiency light sources—typically to save energy—they are somewhat dissatisfied with the overall performance of the high-efficiency light sources. Thus, there has been a long-felt need for a light source that combines the advantages, while minimizing the disadvantages, of both low-efficiency (i.e., continuous-spectrum) and high-efficiency (i.e., discrete-spectrum) light sources. It would be desirable to provide a light source that saves energy (like a fluorescent lamp), but still has a broad dimming range and pleasing light color across the dimming range (like an incandescent lamp).

SUMMARY OF THE INVENTION

According to an embodiment of the present invention, a hybrid light source is characterized by a decreasing color temperature as a total light intensity of the hybrid light source is controlled near a low-end intensity. The hybrid light source is adapted to receive power from an AC power source and to produce a total light intensity, which is controlled throughout a dimming range from a low-end intensity and high-end intensity. The hybrid light source comprises a discrete-spectrum light source circuit having a discrete-spectrum lamp for producing a percentage of the total light intensity, and a continuous-spectrum light source circuit having a continuous-spectrum lamp for producing a percentage of the total light intensity. A control circuit is coupled to both the discrete-spectrum light source circuit and the continuous-spectrum light source circuit for individually controlling the amount of power delivered to each of the discrete-spectrum lamp and the continuous-spectrum lamp, such that the total light intensity of the hybrid light source ranges throughout the dimming range. The percentage of the total light intensity produced by the discrete-spectrum lamp is greater than the percentage of the total light intensity produced by the continuous-spectrum lamp when the total light intensity is near the high-end intensity. The percentage of the total light output produced by the discrete-spectrum lamp decreases and the percentage of the total light intensity produced by the continuous-spectrum lamp increases as the total light intensity is decreased below the high-end intensity. The control circuit controls the discrete-spectrum lamp when the total light intensity is below a transition intensity, such that the percentage of the total light intensity produced by the continuous-spectrum lamp is greater than the percentage of the total light intensity produced by the discrete-spectrum lamp when the total light intensity is below the transition intensity. Further, the control circuit may be operable to turn off the discrete-spectrum lamp when the total light intensity is below a transition intensity, such that the continuous-spectrum lamp produces all of the total light intensity of the hybrid light source and the hybrid light source generates a continuous spectrum of light when the total light intensity is below the transition intensity.

In addition, a method of illuminating a light source to produce a total light intensity throughout a dimming range from a low-end intensity and high-end intensity is described herein. The method comprising the steps of: (1) illuminating a discrete-spectrum lamp to produce a percentage of the total light intensity; (2) illuminating a continuous-spectrum lamp to produce a percentage of the total light intensity; (3) mounting the discrete-spectrum lamp and the continuous-spectrum lamp to a common support; (4) individually controlling the amount of power delivered to each of the discrete-spectrum lamp and the continuous-spectrum lamp, such that the total light intensity of the hybrid light source ranges throughout the dimming range; (5) controlling the discrete-spectrum lamp and the continuous-spectrum lamp near the high-end intensity, such that the percentage of the total light intensity produced by the discrete-spectrum lamp is greater than the percentage of the total light intensity produced by the continuous-spectrum lamp when the total light intensity in near the high-end intensity; (6) decreasing the percentage of the total light intensity produced by the discrete-spectrum lamp as the total light intensity decreases; (7) increasing the percentage of the total light intensity produced by the continuous-spectrum lamp as the total light intensity decreases; (8) turning off the discrete-spectrum lamp when the total light intensity is below a transition intensity; and (9) controlling the continuous-spectrum lamp such that the continuous-spectrum lamp produces all of the total light intensity of the hybrid light source and the hybrid light source generates a continuous spectrum of light when the total light intensity is below the transition intensity.

According to another embodiment of the present invention, a hybrid light source is adapted to receive power from an AC power source and to produce a total luminous flux, which is controlled throughout a dimming range from a minimum luminous flux and a maximum luminous flux. The hybrid light source comprises a continuous-spectrum light source circuit having a continuous-spectrum lamp for producing a percentage of the total luminous flux, and a discrete-spectrum light source circuit having a discrete-spectrum lamp for producing a percentage of the total luminous flux. The hybrid light source further comprises a control circuit coupled to both the continuous-spectrum light source circuit and the discrete-spectrum light source circuit for individually controlling the amount of power delivered to each of the continuous-spectrum lamp and the discrete-spectrum lamp, such that the total luminous flux of the hybrid light source ranges throughout the dimming range from the minimum luminous flux to the maximum luminous flux. The percentage of the total luminous flux produced by the discrete-spectrum lamp is greater than the percentage of the total luminous flux produced by the continuous-spectrum lamp when the total luminous flux is near the maximum luminous flux. The percentage of the total luminous flux produced by the discrete-spectrum lamp decreases and the percentage of the total luminous flux produced by the continuous-spectrum lamp increases as the total luminous flux is decreased below the maximum luminous flux, such that the total luminous flux generated by the hybrid light source has a continuous spectrum for at least a portion of the dimming range.

According to aspect embodiment of the present invention, a dimmable hybrid light source adapted to receive a phase-controlled voltage comprises a discrete-spectrum light source circuit comprising a discrete-spectrum lamp, and a low-efficiency light source circuit comprising a continuous-spectrum lamp operable to conduct a continuous-spectrum lamp current. The hybrid light source further comprises a zero-crossing detect circuit for detecting when the magnitude of the phase-controlled voltage becomes greater than a predetermined zero-crossing threshold voltage each half-cycle of the phase-controlled voltage, and a control circuit coupled to both the discrete-spectrum light source circuit and the continuous-spectrum light source circuit for individually controlling the amount of power delivered to each of the discrete-spectrum lamp and the continuous-spectrum lamp in response to the zero-crossing detect circuit, such that a total light output of the hybrid light source ranges from a minimum total intensity to a maximum total intensity. The control circuit controls the discrete-spectrum lamp when the total light intensity is below a transition intensity, such that the percentage of the total light intensity produced by the continuous-spectrum lamp is greater than the percentage of the total light intensity produced by the discrete-spectrum lamp when the total light intensity is below the transition intensity. The control circuit controls the amount of power delivered to the continuous-spectrum lamp to be greater than or equal to a minimum power level after the magnitude of the phase-controlled voltage becomes greater than the predetermined zero-crossing threshold voltage each half-cycle of the phase-controlled voltage when the total light intensity is above the transition intensity.

According to yet another embodiment of the present invention, a dimmable hybrid light source adapted to receive a phase-controlled voltage comprises: (1) a discrete-spectrum light source circuit comprising a discrete-spectrum lamp; (2) a continuous-spectrum light source circuit comprising a continuous-spectrum lamp operable to conduct a continuous-spectrum lamp current; (3) a zero-crossing detect circuit for detecting when the magnitude of the phase-controlled voltage is approximately zero volts; and (4) a control circuit coupled to both the discrete-spectrum light source circuit and the continuous-spectrum light source circuit for individually controlling the amount of power delivered to each of the discrete-spectrum lamp and the continuous-spectrum lamp in response to the zero-crossing detect circuit. The control circuit controls the continuous-spectrum light source circuit such that the continuous-spectrum lamp is operable to conduct the continuous-spectrum lamp current when the phase-controlled voltage across the hybrid light source is approximately zero volts.

In addition, a lighting control system, which comprises hybrid light source and a dimmer switch and receives power from an AC power source, is also described herein. The hybrid light source comprises a discrete-spectrum light source circuit having a discrete-spectrum lamp and a continuous-spectrum light source circuit having a continuous-spectrum lamp. The hybrid light source is adapted to be coupled to the AC power source and to individually control the amount of power delivered to each of the discrete-spectrum lamp and the continuous-spectrum lamp. The dimmer switch comprises a thyristor adapted to be coupled in series electrical connection between the AC power source and the hybrid light source. The thyristor is operable to be rendered conductive for a conduction period each half-cycle of the AC power source, such that the hybrid light source is operable to control the amount of power delivered to each of the discrete-spectrum lamp and the continuous-spectrum lamp in response to the conduction period of the thyristor, the thyristor characterized by a rated latching current. The continuous-spectrum light source circuit of the hybrid light source provides a path for enough current to flow from the AC power source through the hybrid light source, such that the magnitude of the current exceeds a rated latching current of the thyristor of the dimmer switch when the thyristor is rendered conductive.

According to yet another embodiment of the present invention, a lighting control system, which receives power from an AC power source, comprises a dimmer switch (having a thyristor and a power supply) and a hybrid light source that is operable to conduct a charging current of the power supply, as well, as enough current to exceed a rated latching current and a rated holding current of the thyristor. The hybrid light source comprises a continuous-spectrum light source circuit having a continuous-spectrum lamp. The continuous-spectrum light source circuit of the hybrid light source conducts the charging current when the thyristor is non-conductive. After the thyristor is rendered conductive each half-cycle, the continuous-spectrum light source circuit provides a path for enough current to flow from the AC power source through the hybrid light source, such that the magnitude of the current exceeds the rated latching current and the rated holding current of the thyristor of the dimmer.

A method of illuminating a light source in response to a phase-controlled voltage from a dimmer switch is also described herein. The dimmer switch is coupled in series electrical connection with between an AC power source and the light source, and comprises a thyristor, which generates the phase-controlled voltage and is characterized by a rated latching current. The method comprising the steps of: (1) enclosing the discrete-spectrum lamp and the continuous-spectrum lamp together in a translucent housing; (2) individually controlling the amount of power delivered to each of the discrete-spectrum lamp and the continuous-spectrum lamp in response to the phase-controlled voltage; and (3) conducting enough current from the AC power source and through bidirectional semiconductor switch of the dimmer and the continuous-spectrum lamp to exceed the rated latching current of the thyristor of the dimmer switch.

Other features and advantages of the present invention will become apparent from the following description of the invention that refers to the accompanying drawings.

DETAILED DESCRIPTION OF THE INVENTION

Figure 1A:
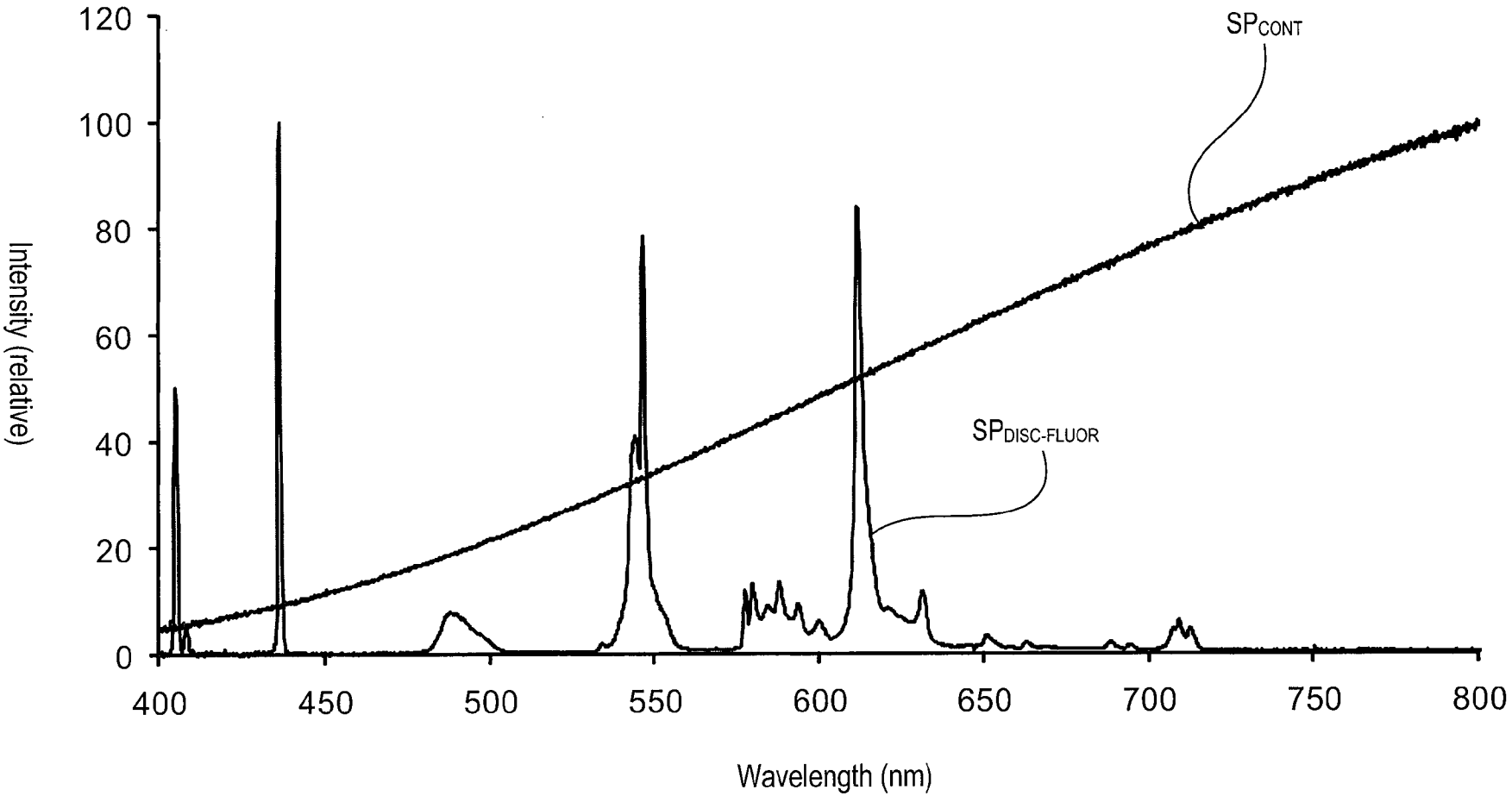
FIG. 1A is a simplified graph showing a portion of the continuous spectrum of a halogen lamp and the discrete spectrum of a compact fluorescent lamp.
Figure 1B:
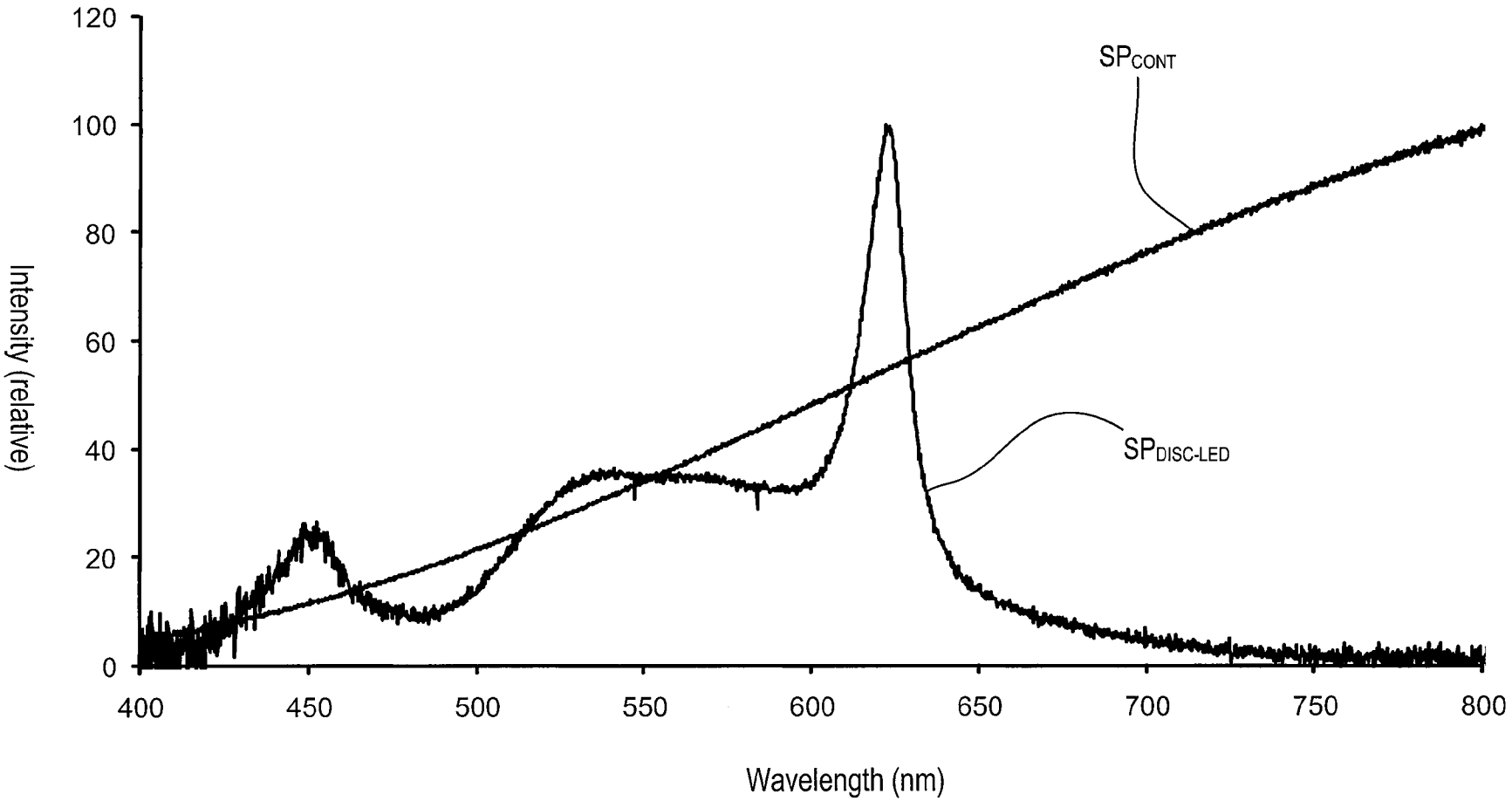
FIG. 1B is a simplified graph showing the discrete spectrum of an LED lighting fixture.
Figure 1C:
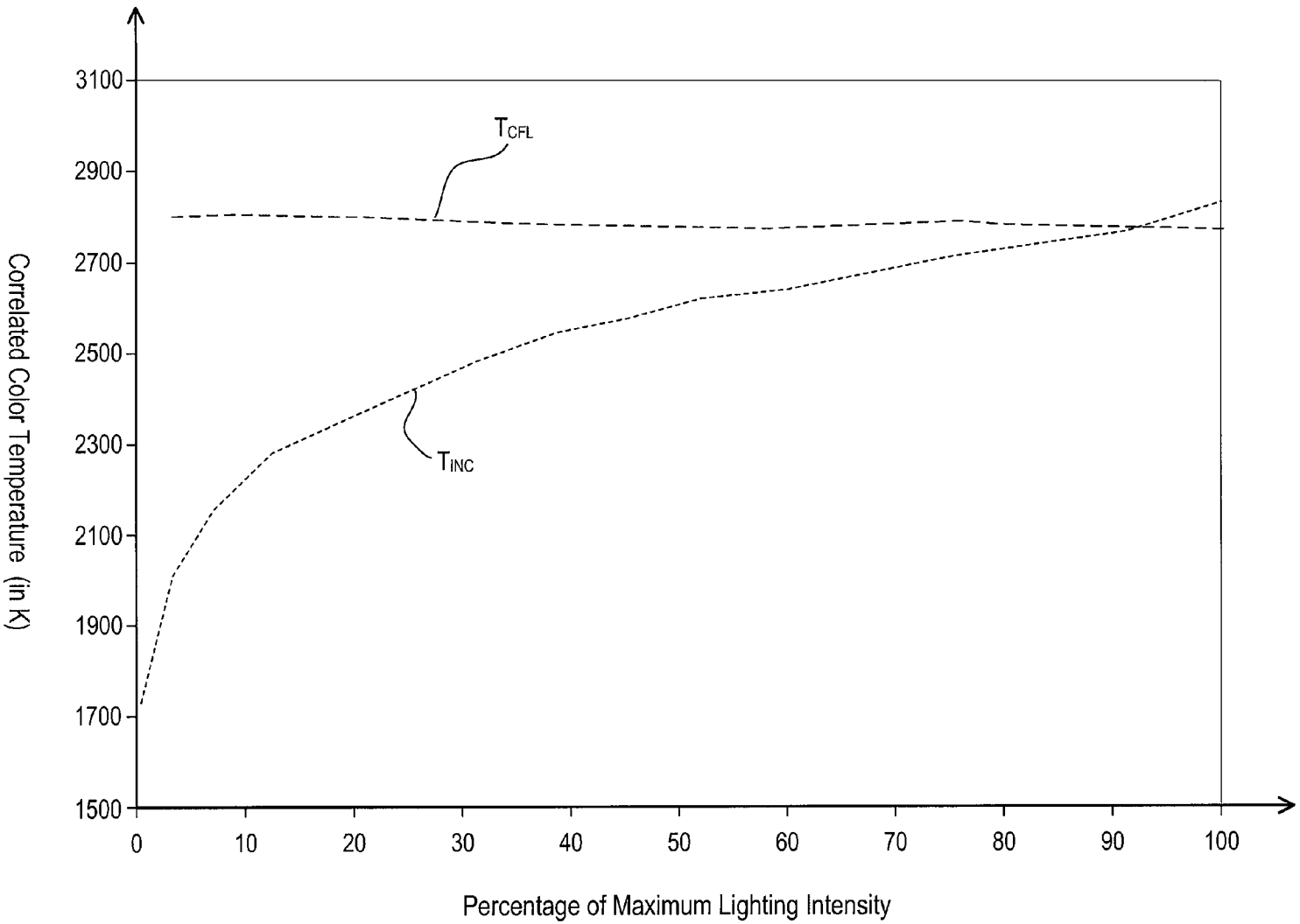
FIG. 1C is a simplified graph showing examples of a correlated color temperature of a 26-Watt compact fluorescent lamp and a correlated color temperature of a 100-Watt incandescent lamp with respect to the percentage of the maximum lighting intensity to which the lamps is presently illuminated.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2A:
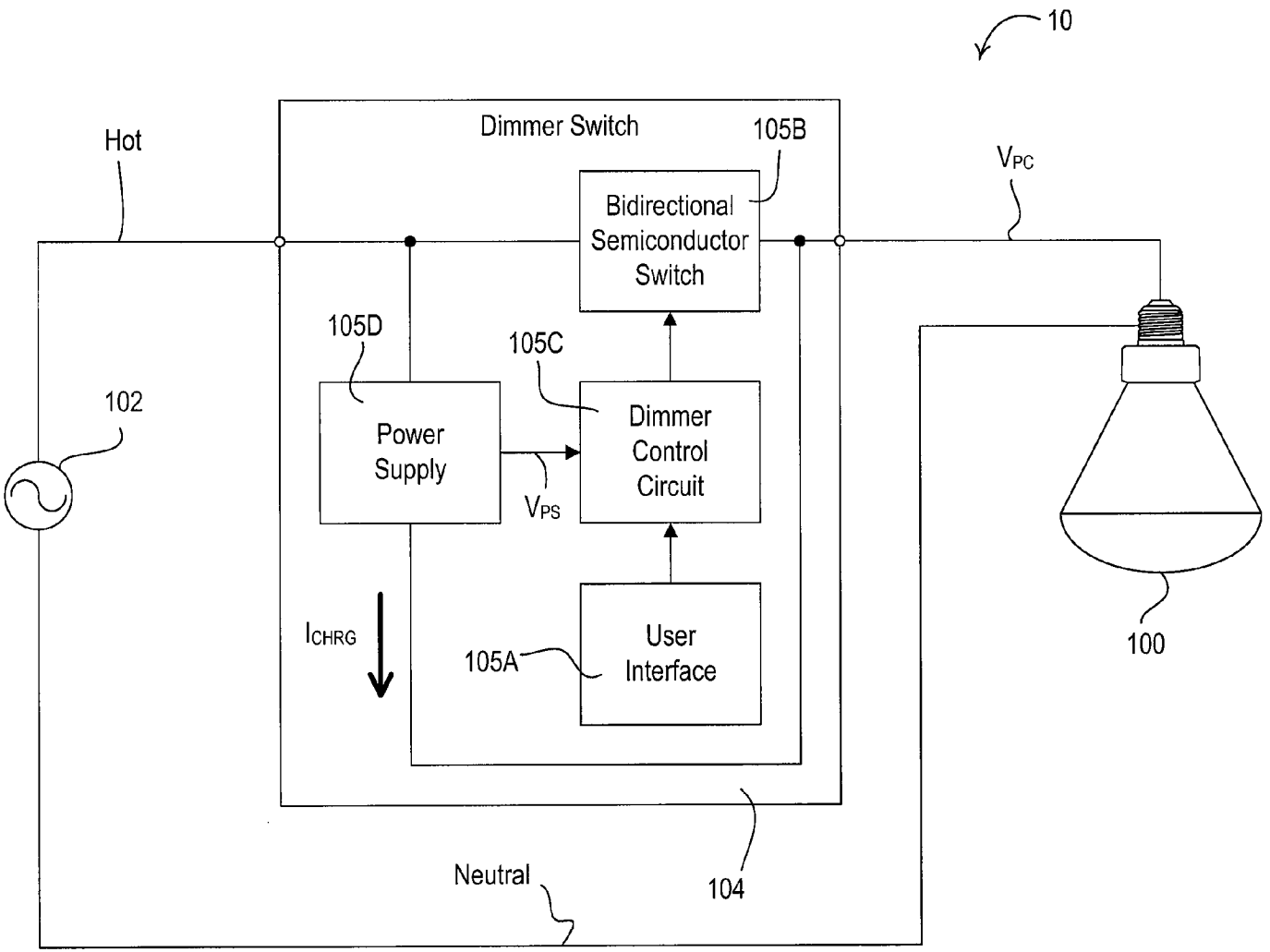
FIG. 2A is a simplified block diagram of a lighting control system including a hybrid light source and a dimmer having a power supply according to an embodiment of the present invention.

FIG. 2A is a simplified block diagram of a lighting control system 10 including a hybrid light source 100 according to an embodiment of the present invention. The hybrid light source 100 is coupled to the hot side of an alternating-current (AC) power source 102 (e.g., 120 $V_{AC}$, 60 Hz) through a conventional two-wire dimmer switch 104 and is directly coupled to the neutral side of the AC power source. The dimmer switch 104 comprises a user interface 105A including an intensity adjustment actuator (not shown), such as a slider control or a rocker switch. The user interface 105A allows a user to adjust the desired total lighting intensity $L_{DESIRED}$ of the hybrid light source 100 across a dimming range between a low-end lighting intensity $L_{LE}$ (i.e., a minimum intensity, e.g., 0%) and a high-end lighting intensity $L_{HE}$ (i.e., a maximum intensity, e.g., 100%).

The dimmer switch 104 typically includes a bidirectional semiconductor switch 105B, such as, for example, a thyristor (such as a triac) or two field-effect transistors (FETs) coupled in anti-series connection, for providing a phase-controlled voltage $V_{PC}$ (i.e., a dimmed-hot voltage) to the hybrid light source 100. Using a standard forward phase-control dimming technique, a control circuit 105C renders the bidirectional semiconductor switch 105B conductive at a specific time each half-cycle of the AC power source, such that the bidirectional semiconductor switch remains conductive for a conduction period $T_{CON}$ during each half-cycle (as shown in FIGS. 11A-11D). The dimmer switch 104 controls the amount of power delivered to the hybrid light source 100 by controlling the length of the conduction period $T_{CON}$. The dimmer switch 104 also often comprises a power supply 105D coupled across the bidirectional semiconductor switch 105B for powering the control circuit 105C. The power supply 105D generates a DC supply voltage $V_{PS}$ by drawing a charging current $I_{CHRG}$ from the AC power source 102 through the hybrid light source 100 when the bidirectional semiconductor switch 105B is non-conductive each half-cycle. An example of a dimmer switch having a power supply 105D is described in greater detail in U.S. Pat. No. 5,248,919, issued Sep. 29, 1993, entitled LIGHTING CONTROL DEVICE, the entire disclosure of which is hereby incorporated by reference.

Figure 2B:
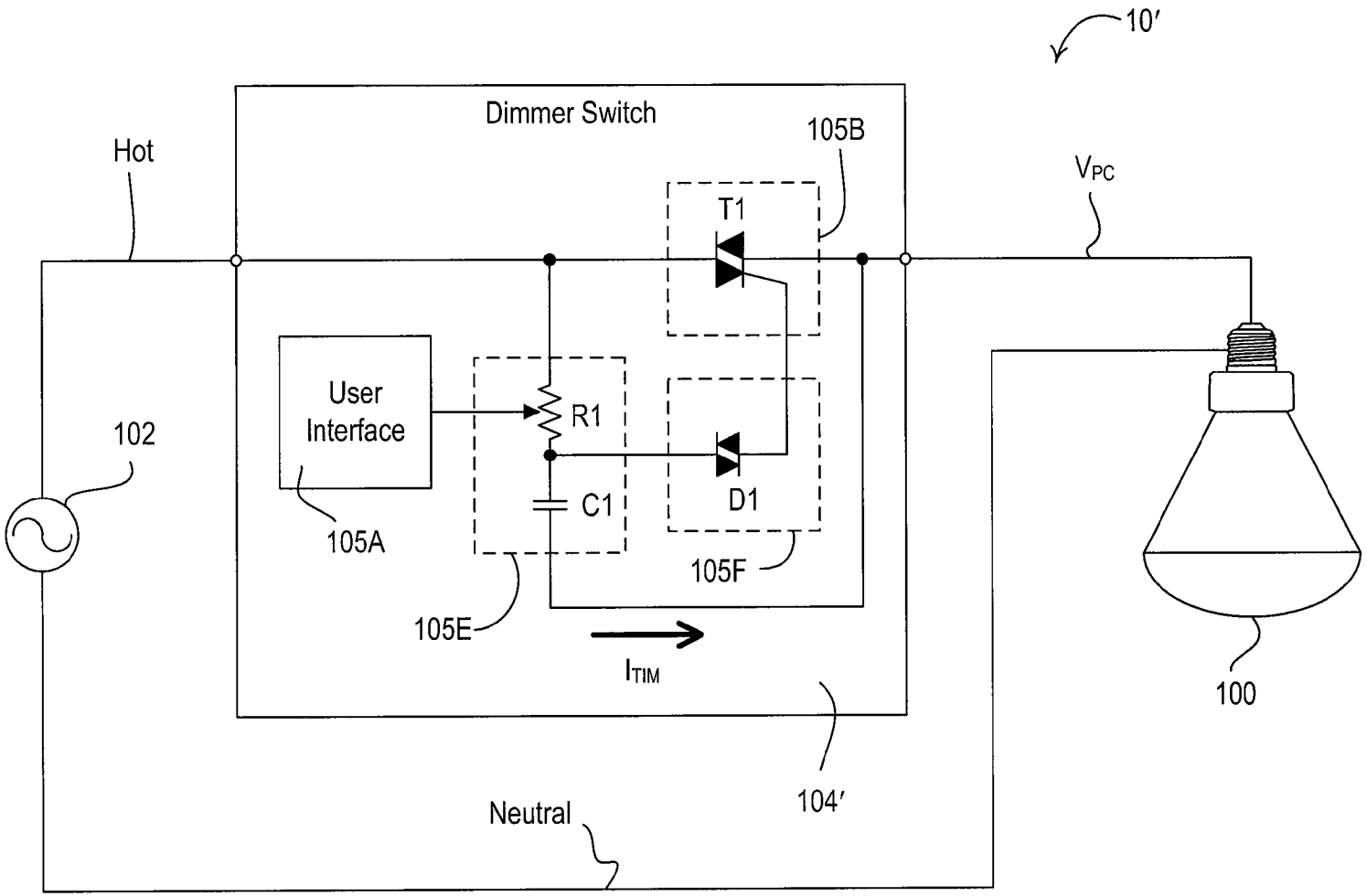
FIG. 2B is a simplified block diagram of an alternative lighting control system comprising the hybrid light source of FIG. 2A and a dimmer switch having a timing circuit.

FIG. 2B is a simplified block diagram of an alternative lighting control system 10' comprising a dimmer switch 104', which includes a timing circuit 105E and a trigger circuit 105F rather than the dimmer control circuit 105C and the power supply 105D. As shown in FIG. 2B, the bidirectional semiconductor switch 105B is implemented as a triac T1. The timing circuit 105E is coupled in parallel electrical connection with the triac T1 and comprises, for example, a resistor R1 and a capacitor C1. The trigger circuit 105F is coupled between the junction of the resistor R1 and the capacitor C1 is coupled to a gate of the triac T1 and comprises, for example, a diac D1. The capacitor C1 of the timing circuit 105E charges by conducting a timing current $I_{TIM}$ from the AC power source 102 and through the resistor R1 and the hybrid light source 100 when the bidirectional semiconductor switch 105B is non-conductive each half-cycle. When the voltage across the capacitor C1 exceeds approximately a break-over voltage of the diac D1, the diac conducts current through the gate of the triac T1, thus, rendering the triac conductive. After the triac T1 is fully conductive, the timing current $I_{TIM}$ ceases to flow. As shown in FIG. 2B, the resistor R1 is a potentiometer having a resistance adjustable in response to the user interface 105A to control how quickly the capacitor C1 charges and thus the conduction period $T_{CON}$ of the phase-controlled voltage $V_{PC}$.

Figure 3A:
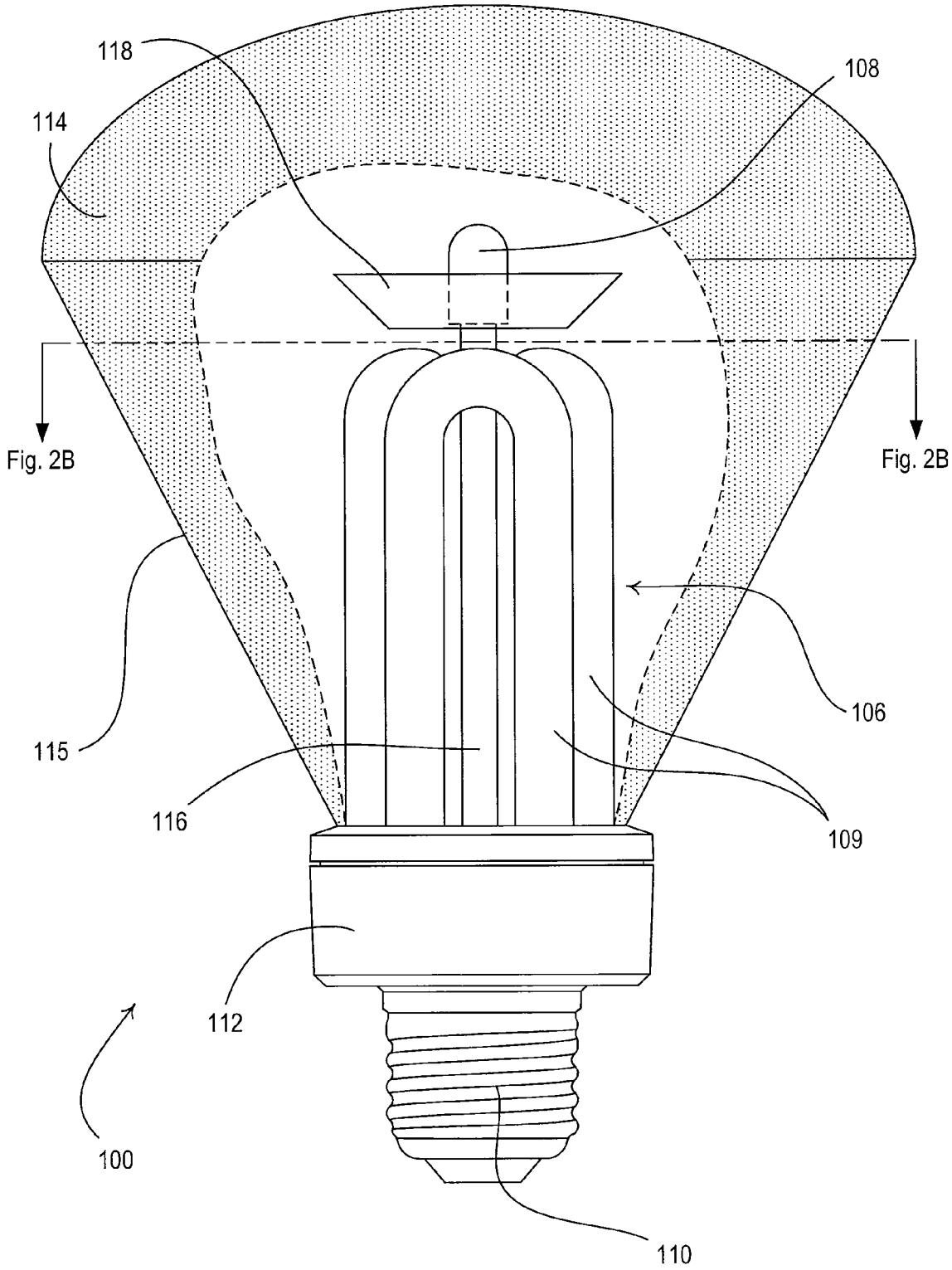
FIG. 3A is a simplified side view of the hybrid light source of FIG. 2A.
Figure 3B:
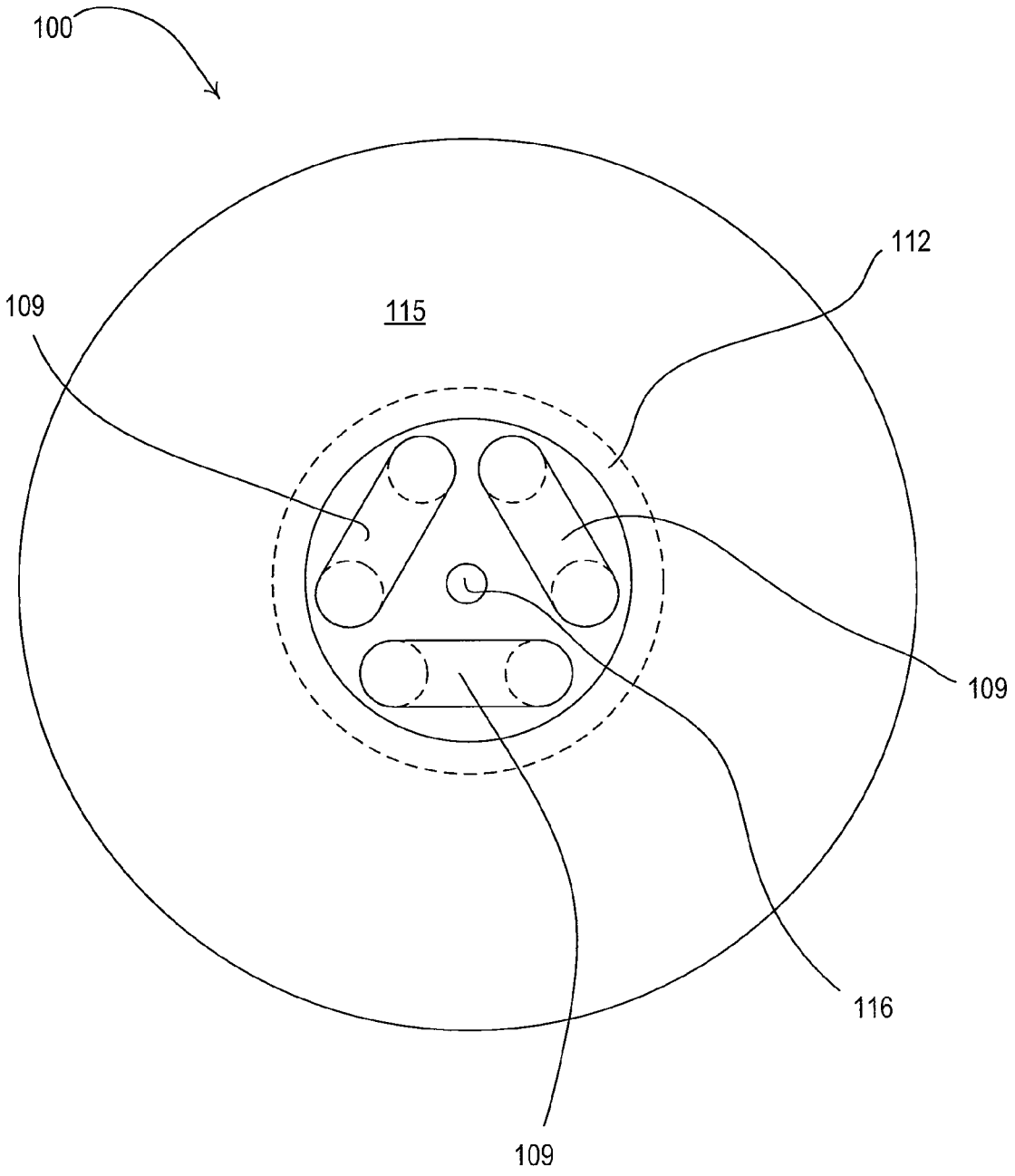
FIG. 3B is a simplified top cross-sectional view of the hybrid light source of FIG. 3A.

FIG. 3A is a simplified side view and FIG. 3B is a simplified top cross-sectional view of the hybrid light source 100. The hybrid light source 100 comprises both a discrete-spectrum lamp and a continuous-spectrum lamp. The discrete-spectrum lamp may comprise, for example, a gas discharge lamp (such as a compact fluorescent lamp 106), a phosphor-based lamp, a high-intensity discharge (HID) lamp, a solid-state light source (such as, a light-emitting diode (LED) light source), or any suitable high-efficiency lamp having an at least partially-discrete spectrum. The continuous-spectrum lamp may comprise, for example, an incandescent lamp (such as halogen lamp 108) or any suitable low-efficiency lamp having a continuous spectrum. For example, the halogen lamp 108 may comprise a 20-Watt, line-voltage halogen lamp that may be energized by an AC voltage having a magnitude of approximately 120 $V_{AC}$. The discrete-spectrum lamp (i.e., the fluorescent lamp 106) may have a greater efficacy than the continuous-spectrum lamp (i.e., the halogen lamp 108). For example, the fluorescent lamp 106 may be typically characterized by an efficacy greater than approximately 60 lm/W, while the halogen lamp 108 may be typically characterized by an efficacy less than approximately 30 lm/W. The present invention is not limited to high-efficiency and low-efficiency lamps having the efficacies stated above, since improvements in technology in the future could provide high-efficiency and low-efficiency lamps having higher efficacies.

Referring to FIG. 3A, the compact fluorescent lamp 106 may comprise, for example, three curved (i.e., U-shaped) gas-filled glass tubes 109 that extend along a central longitudinal axis of the hybrid light source 100 and have outermost ends that are approximately co-planar. Other geometries can be employed for the fluorescent lamp 106, for example, a different number of tubes (such as four tubes) or a single spiral tube of well-known form may be provided.

The hybrid light source 100 further comprises a screw-in Edison base 110 for connection to a standard Edison socket, such that the hybrid light source may be coupled to the AC power source 102. The screw-in base 110 has two input terminals 110A, 110B (FIG. 5) for receipt of the phase-controlled voltage $V_{PC}$ and for coupling to the neutral side of the AC power source 102. Alternatively, the hybrid light source 100 may comprise other types of input terminals, such as stab-in connectors, screw terminals, flying leads, or GU-24 screw-in base terminals. A hybrid light source electrical circuit 120 (FIG. 5) is housed in an enclosure 112 (FIG. 3A) and controls the amount of power delivered from the AC power source to each of the fluorescent lamp 106 and the halogen lamp 108. The screw-in base 110 extends from the enclosure 112 and is concentric with the longitudinal axis of the hybrid light source 100.

The fluorescent lamp 106 and halogen lamp 108 may be surrounded by a housing comprising a light diffuser 114 (e.g., a glass light diffuser) and a fluorescent lamp reflector 115. Alternatively, the light diffuser 114 could be made of plastic or any suitable type of transparent, translucent, partially-transparent, or partially-translucent material, or alternatively no light diffuser could be provided. The fluorescent lamp reflector 115 directs the light emitted by the fluorescent lamp 106 away from the hybrid light source 100. The housing may be implemented as a single part with the light diffuser 114 and the reflector 115.

As shown in FIG. 3A, the halogen lamp 108 is situated beyond the terminal end of the fluorescent lamp 106. Specifically, the halogen lamp 108 is mounted to a post 116, which is connected to the enclosure 112 and extends along the longitudinal axis of the hybrid light source 100 (i.e., co-axially with the longitudinal axis). The post 116 allows the halogen lamp to be electrically connected to the hybrid light source electrical circuit 120. The enclosure 112 serves as a common support for the tubes 109 of the fluorescent lamp 106 and the post 116 for the halogen lamp 108. A halogen lamp reflector 118 surrounds the halogen lamp 108 and directs the light emitted by the halogen lamp in the same direction as the fluorescent lamp reflector 115 directs the light emitted by the fluorescent lamp 106. Alternatively, the halogen lamp 108 may be mounted at a different location in the housing or multiple halogen lamps may be provided in the housing.

Figure 4A:
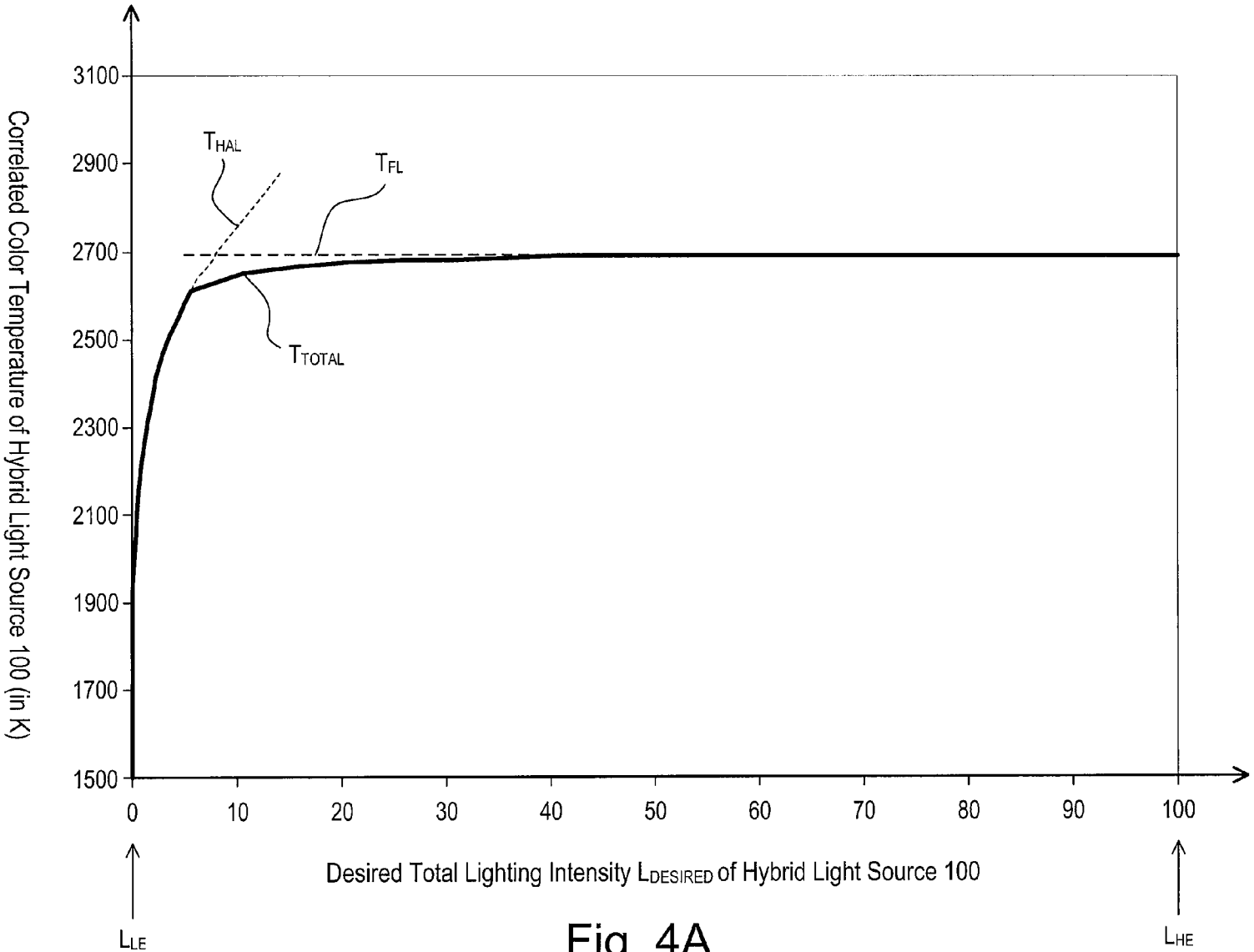
FIG. 4A is a simplified graph showing a total correlated color temperature of the hybrid light source of FIG. 3A plotted with respect to a desired total lighting intensity of the hybrid light source.

The hybrid light source 100 provides an improved color rendering index and correlated color temperature across the dimming range of the hybrid light source (particularly, near a low-end lighting intensity $L_{LE}$) as compared to a discrete-spectrum light source, such as a stand-alone compact fluorescent lamp. FIG. 4A is a simplified graph showing a total correlated color temperature $T_{TOTAL}$ of the hybrid light source 100 plotted with respect to the desired total lighting intensity $L_{DESIRED}$ of the hybrid light source 100 (as determined by the user actuating the intensity adjustment actuator of the user interface 105A of the dimmer switch 104). A correlated color temperature $T_{FL}$ of a stand-alone compact fluorescent lamp remains constant at approximately 2700 Kelvin throughout most of the dimming range. A correlated color temperature $T_{HAL}$ of a stand-alone halogen lamp decreases as the halogen lamp is dimmed to low intensities causing a desirable color shift towards the red portion of the color spectrum and creating a warmer effect as perceived by the human eye. The hybrid light source 100 is operable to individually control the intensities of the fluorescent lamp 106 and the halogen lamp 108, such that the total correlated color temperature $T_{TOTAL}$ of the hybrid light source 100 more closely mimics the correlated color temperature of the halogen lamp at low light intensities, thus more closely meeting the expectations of a user accustomed to dimming low-efficiency lamps.

The hybrid light source 100 is further operable to control the fluorescent lamp 106 and the halogen lamp 108 to provide high-efficiency operation near the high-end intensity $L_{HE}$.

Figure 4B:
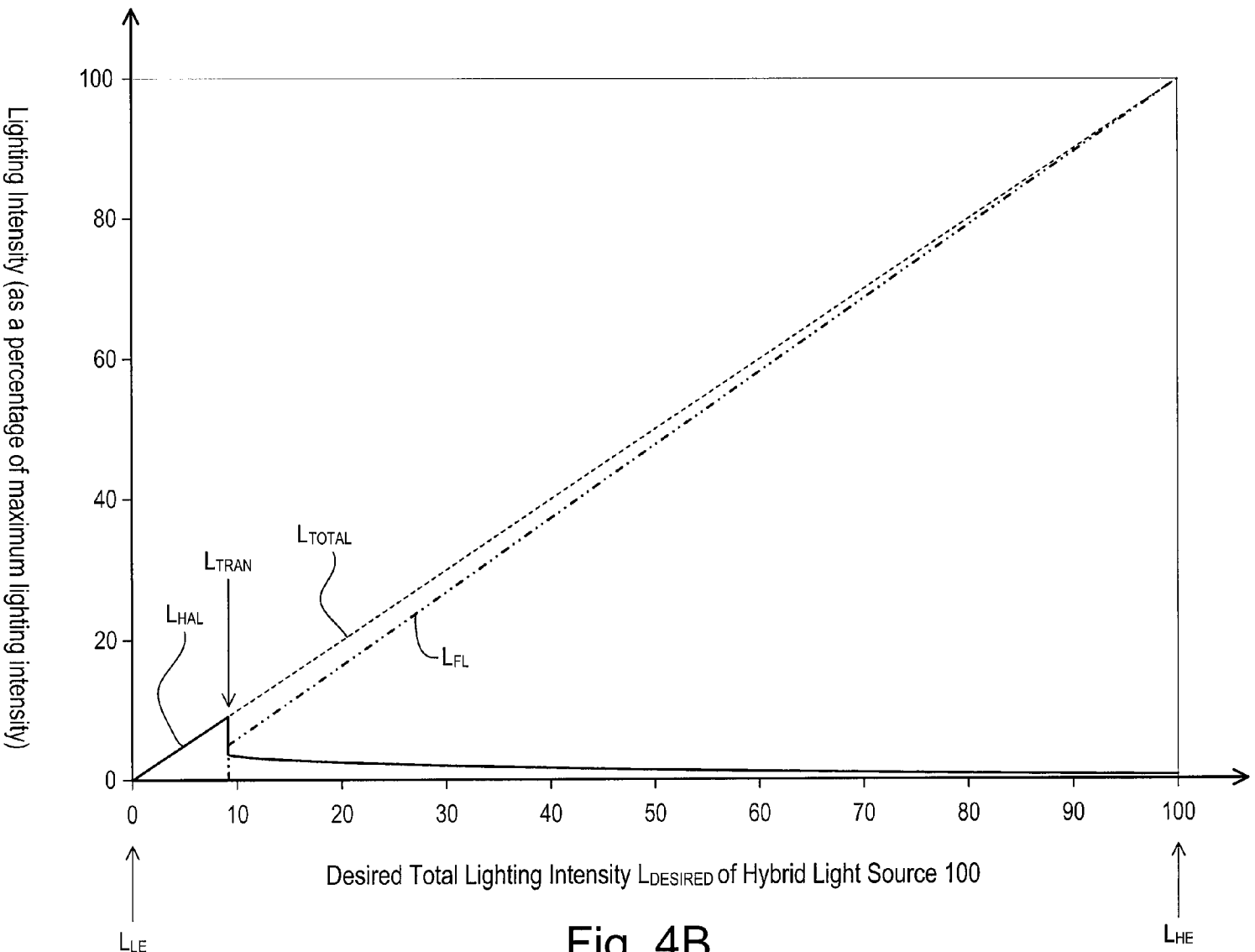
FIG. 4B is a simplified graph showing a target fluorescent lamp lighting intensity, a target halogen lamp lighting intensity, and a total lighting intensity of the hybrid light source of FIG. 3A plotted with respect to the desired total lighting intensity.

FIG. 4B is a simplified graph showing a target fluorescent lighting intensity $L_{FL}$, a target halogen lighting intensity $L_{HAL}$, and a target total lighting intensity $L_{TOTAL}$ plotted with respect to the desired total lighting intensity $L_{DESIRED}$ of the hybrid light source 100 (as determined by the user actuating the intensity adjustment actuator of the dimmer switch 104). The target total lighting intensity $L_{TOTAL}$ may be representative of the perceived luminous flux of the hybrid light source 100. The target fluorescent lighting intensity $L_{FL}$ and the target halogen lighting intensity $L_{HAL}$ (as shown in FIG. 4B) provide for a decrease in color temperature near the low-end intensity $L_{LE}$ and high-efficiency operation near the high-end intensity $L_{HE}$. Near the high-end intensity $L_{HE}$, the fluorescent lamp 106 (i.e., the high-efficiency lamp) provides a greater percentage of the total light intensity $L_{TOTAL}$ of the hybrid light source 100. As the total light intensity $L_{TOTAL}$ of the hybrid light source 100 decreases, the halogen lamp 108 is controlled such that the halogen lamp begins to provide a greater percentage of the total light intensity.

Since the fluorescent lamp 106 cannot be dimmed to very low intensities without the use of more expensive and complex circuits, the fluorescent lamp 106 is controlled to be off at a transition intensity $L_{TRAN}$, e.g., approximately 8% (as shown in FIG. 4B) or up to approximately 30%. Below the transition intensity $L_{TRAN}$, the halogen lamp 108 provides a greater percentage of the total light intensity $L_{TOTAL}$, of the hybrid light source 100 than the fluorescent lamp 106. As shown in FIG. 4B, the halogen lamp 108 provides all of the total light intensity $L_{TOTAL}$ of the hybrid light source 100, thus providing for a lower low-end intensity $L_{LE}$ than can be provided by a stand-alone fluorescent lamp 106. In addition, the hybrid light source 100 generates a continuous spectrum of light when the total light intensity $L_{TOTAL}$ is below the transition intensity $L_{TRAN}$ since only the halogen lamp 108 is illuminated. Above, the transition intensity $L_{TRAN}$, the hybrid light source 100 generates a discrete spectrum of light since both the fluorescent lamp 106 and the halogen lamp 108 are illuminated. Immediately below the transition intensity $L_{TRAN}$, the halogen lamp 108 is controlled to a maximum controlled intensity, which is, for example, approximately 80% of the maximum rated intensity of the halogen lamp. The intensities of the fluorescent lamp 106 and the halogen lamp 108 are individually controlled such that the target total light intensity $L_{TOTAL}$ of the hybrid light source 100 is substantially linear as shown in FIG. 4B. Rather than turning the fluorescent lamp 106 off below the transition intensity $L_{TRAN}$, the target fluorescent lighting intensity $L_{FL}$ of the fluorescent lamp could be controlled to a low (non-off) intensity level, such that the halogen lamp 108 provides most (but not all) of the total light intensity $L_{TOTAL}$ of the hybrid light source 100.

Figure 5:
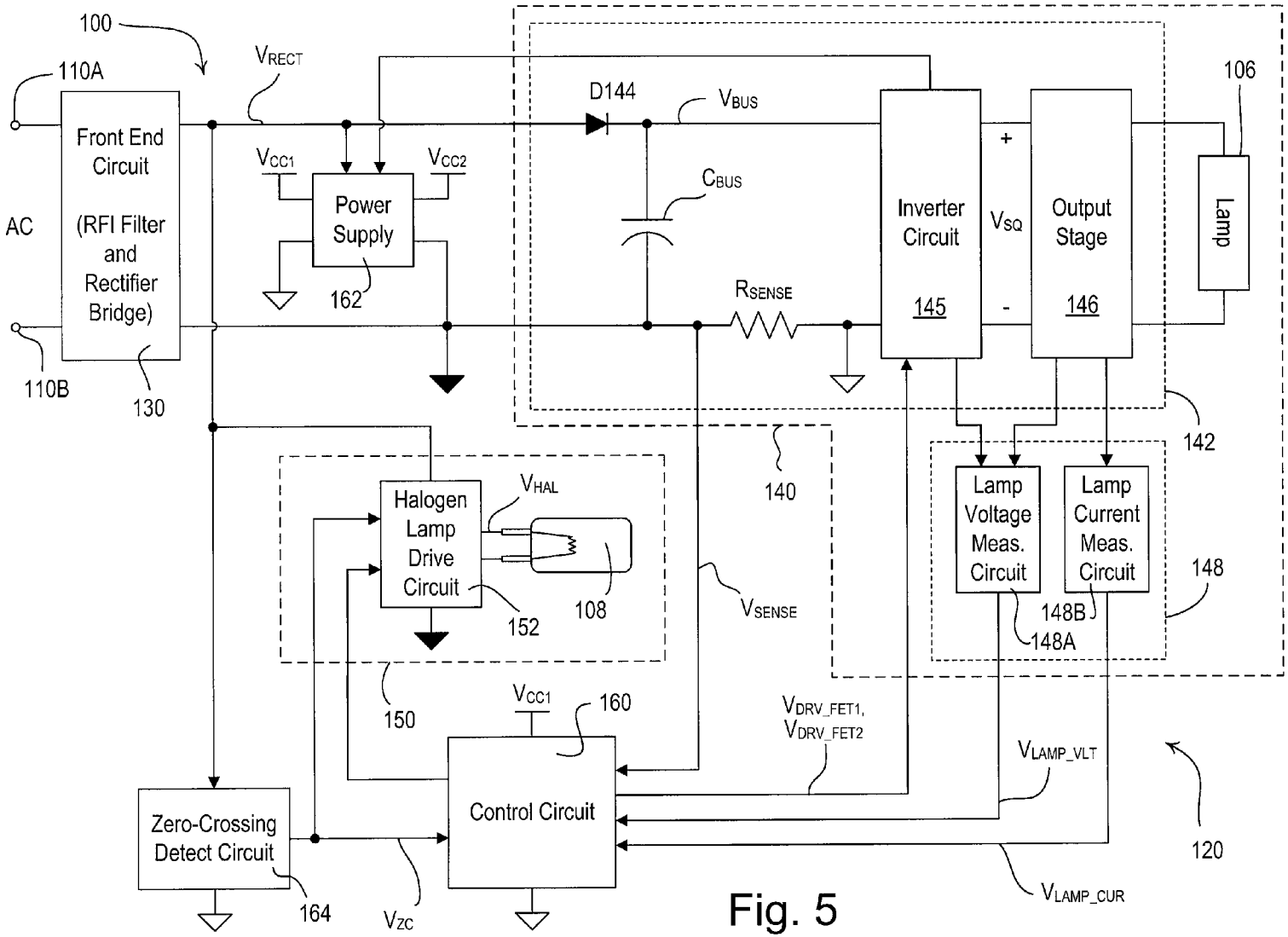
FIG. 5 is a simplified block diagram of a lighting control circuit for the hybrid light source of FIG. 3A.

FIG. 5 is a simplified block diagram of the hybrid light source 100 showing the hybrid light source electrical circuit 120. The hybrid light source 100 comprises a front end circuit 130 coupled across the input terminals 110A, 110B. The front end circuit 130 includes a radio-frequency interference (RFI) filter for minimizing the noise provided to the AC power source 102 and a rectifier (e.g., a full-wave rectifier) for receiving the phase-controlled voltage $V_{PC}$ and generating a rectified voltage $V_{RECT}$ at an output. Alternatively, the rectifier of the front end circuit 130 could comprise a half-wave rectifier. The hybrid light source 100 further comprises a high-efficiency light source circuit 140 (i.e., a discrete-spectrum light source circuit) for illuminating the fluorescent lamp 106 and a low-efficiency light source circuit 150 (i.e., a continuous-spectrum light source circuit) for illuminating the halogen lamp 108.

A control circuit 160 simultaneously controls the operation of the high-efficiency light source circuit 140 and the low-efficiency light source circuit 150 to thus control the amount of power delivered to each of the fluorescent lamp 106 and the halogen lamp 108. The control circuit 160 may comprise a microcontroller or any other suitable processing device, such as, for example, a programmable logic device (PLD), a microprocessor, or an application specific integrated circuit (ASIC). A power supply 162 generates a first direct-current (DC) supply voltage $V_{CC1}$ (e.g., 5 $V_{DC}$) referenced to a circuit common for powering the control circuit 160, and a second DC supply voltage $V_{CC2}$ referenced to a rectifier DC common connection, which has a magnitude greater than the first DC supply voltage $V_{CC1}$ (e.g., approximately 15 $V_{DC}$) and is used by the low-efficiency light source circuit 150 (and other circuitry of the hybrid light source 100) as will be described in greater detail below.

The control circuit 160 is operable to determine the target total lighting intensity $L_{TARGET}$ for the hybrid light source 100 in response to a zero-crossing detect circuit 164. The zero-crossing detect circuit 164 provides a zero-crossing control signal $V_{ZC}$, representative of the zero-crossings of the phase-controlled voltage $V_{PC}$, to the control circuit 160. A zero-crossing is defined as the time at which the phase-controlled voltage $V_{PC}$ changes from having a magnitude of substantially zero volts to having a magnitude greater than a predetermined zero-crossing threshold $V_{TH\text{-}ZC}$ (and vice versa) each half-cycle. Specifically, the zero-crossing detect circuit 164 compares the magnitude of the rectified voltage to the predetermined zero-crossing threshold $V_{TH\text{-}ZC}$ (e.g., approximately 20 V), and drives the zero-crossing control signal $V_{ZC}$ high (i.e., to a logic high level, such as, approximately the DC supply voltage $V_{CC1}$) when the magnitude of the rectified voltage $V_{RECT}$ is greater than the predetermined zero-crossing threshold $V_{TH\text{-}ZC}$. Further, the zero-crossing detect circuit 164 drives the zero-crossing control signal $V_{ZC}$ low (i.e., to a logic low level, such as, approximately circuit common) when the magnitude of the rectified voltage $V_{RECT}$ is less than the predetermined zero-crossing threshold $V_{TH\text{-}ZC}$. The control circuit 160 determines the length of the conduction period $T_{CON}$ of the phase-controlled voltage $V_{PC}$ in response to the zero-crossing control signal $V_{ZC}$, and then determines the target lighting intensities for both the fluorescent lamp 106 and the halogen lamp 108 to produce the target total lighting intensity $L_{TOTAL}$ of the hybrid light source 100 in response to the conduction period $T_{CON}$ of the phase-controlled voltage $V_{PC}$.

Alternatively, the zero-crossing detect circuit 164 may provide some hysteresis, such that the zero-crossing threshold $V_{TH\text{-}ZC}$ has a first magnitude $V_{TH\text{-}ZC1}$ when the zero-crossing control signal $V_{ZC}$ is low (i.e., before the magnitude of the phase-controlled voltage $V_{PC}$ has risen above the first magnitude $V_{TH-ZC1}$), and has a second magnitude $V_{TH-ZC2}$ when the zero-crossing control signal $V_{ZC}$ is high (i.e., after the magnitude of the phase-controlled voltage $V_{PC}$ has risen above the first magnitude $V_{TH-ZC1}$ and before the magnitude of the phase-controlled voltage $V_{PC}$ drops below the second magnitude $V_{TH-ZC2}$). Since the power supply 105D of the dimmer switch 104 (and thus the hybrid light source 100) conduct the charging current $I_{CHRG}$ when the bidirectional semiconductor switch 105B is non-conductive each half-cycle, a voltage may be developed across the input terminals 110A, 110B of the hybrid light source and thus across the zero-crossing detect circuit 164 at this time. The first magnitude $V_{TH-ZC1}$ of the zero-crossing threshold $V_{TH-ZC}$ is sized to be larger than the voltage that may be developed across the input terminals 110A, 110B of the hybrid light source when the bidirectional semiconductor switch 105B of the dimmer switch 104 is non-conductive (e.g., approximately 70 V). Accordingly, the zero-crossing detect circuit 164 will only drive the zero-crossing control signal $V_{ZC}$ high when the bidirectional semiconductor switch 105B is rendered conductive. The second magnitude of the zero-crossing threshold $V_{TH-ZC}$ is sized to be close to zero volts (e.g., approximately 20 V), such that the zero-crossing detect circuit 164 drives the zero-crossing control signal $V_{ZC}$ low near the end of the half-cycle (i.e., when the bidirectional semiconductor switch 105B is rendered non-conductive).

The low-efficiency light source circuit 150 comprises a halogen lamp drive circuit 152, which receives the rectified voltage $V_{RECT}$ and controls the amount of power delivered to the halogen lamp 108. The low-efficiency light source circuit 150 is coupled between the rectified voltage $V_{RECT}$ and the rectifier common connection (i.e., across the output of the front end circuit 130). The control circuit 160 is operable to control the intensity of the halogen lamp 108 to the target halogen lighting intensity corresponding to the present value of the target total lighting intensity $L_{TOTAL}$ of the hybrid light source 100, e.g., to the target halogen lighting intensity as shown in FIG. 4B. Specifically, the halogen lamp drive circuit 152 is operable to pulse-width modulate a halogen voltage $V_{HAL}$ provided across the halogen lamp 108.

The high-efficiency light source circuit 140 comprises a fluorescent drive circuit (e.g., a dimmable ballast circuit 142) for receiving the rectified voltage $V_{RECT}$ and for driving the fluorescent lamp 106. Specifically, the rectified voltage $V_{RECT}$ is coupled to a bus capacitor $C_{BUS}$ through a diode D144 for producing a substantially DC bus voltage $V_{BUS}$ across the bus capacitor $C_{BUS}$. The negative terminal of the bus capacitor $C_{BUS}$ is coupled to the rectifier DC common. The ballast circuit 142 includes a power converter, e.g., an inverter circuit 145, for converting the DC bus voltage $V_{BUS}$ to a high-frequency square-wave voltage $V_{SQ}$. The high-frequency square-wave voltage $V_{SQ}$ is characterized by an operating frequency $f_{OP}$ (and an operating period $T_{OP}=1/f_{OP}$). The ballast circuit 142 further comprises an output circuit, e.g., a "symmetric" resonant tank circuit 146, for filtering the square-wave voltage $V_{SQ}$ to produce a substantially sinusoidal high-frequency AC voltage $V_{SIN}$, which is coupled to the electrodes of the fluorescent lamp 106. The inverter circuit 145 is coupled to the negative input of the DC bus capacitor $C_{BUS}$ via a sense resistor $R_{SENSE}$. A sense voltage $V_{SENSE}$ (which is referenced to a circuit common connection as shown in FIG. 5) is produced across the sense resistor $R_{SENSE}$ in response to an inverter current $I_{INV}$ flowing through bus capacitor $C_{BUS}$ during the operation of the inverter circuit 145. The sense resistor $R_{SENSE}$ is coupled between the rectifier DC common connection and the circuit common connection and has, for example, a resistance of 1Ω.

The high-efficiency lamp source circuit 140 further comprises a measurement circuit 148, which includes a lamp voltage measurement circuit 148A and a lamp current measurement circuit 148B. The lamp voltage measurement circuit 148A provides a lamp voltage control signal $V_{LAMP_VLT}$ to the control circuit 160, and the lamp current measurement circuit 148B provides a lamp current control signal $V_{LAMP_CUR}$ to the control circuit 160. The measurement circuit 148 is responsive to the inverter circuit 145 and the resonant tank 146, such that the lamp voltage control signal $V_{LAMP_VLT}$ is representative of the magnitude of a lamp voltage $V_{LAMP}$ measured across the electrodes of the fluorescent lamp 106, while the lamp current control signal $V_{LAMP_CUR}$ is representative of the magnitude of a lamp current $I_{LAMP}$ flowing through the fluorescent lamp. The measurement circuit 148 is described in greater detail in commonly-assigned, co-pending U.S. patent application, filed the same day as the present application, entitled MEASUREMENT CIRCUIT FOR AN ELECTRONIC BALLAST, the entire disclosure of which is hereby incorporated by reference.

The control circuit 160 is operable to control the inverter circuit 145 of the ballast circuit 140 to control the intensity of the fluorescent lamp 106 to the target fluorescent lighting intensity corresponding to the present value of the target total lighting intensity $L_{TOTAL}$ of the hybrid light source 100, e.g., to the target fluorescent lighting intensity as shown in FIG. 4B. The control circuit 160 determines a target lamp current $I_{TARGET}$ for the fluorescent lamp 106 that corresponds to the target fluorescent lighting intensity. The control circuit 160 then controls the operation of the inverter circuit 145 in response to the sense voltage $V_{SENSE}$ produced across the sense resistor $R_{SENSE}$, the zero-crossing control signal $V_{ZC}$ from the zero-crossing detect circuit 164, the lamp voltage control signal $V_{LAMP_VLT}$, and the lamp current control signal $V_{LAMP_CUR}$, in order to control the lamp current $I_{LAMP}$ towards the target lamp current $I_{TARGET}$. The control circuit 160 controls the peak value of the integral of the inverter current $I_{INV}$ flowing in the inverter circuit 145 to indirectly control the operating frequency $f_{OP}$ of the high-frequency square-wave voltage $V_{SQ}$, and to thus control the intensity of the fluorescent lamp 106 to the target fluorescent lighting intensity.

Figure 6:
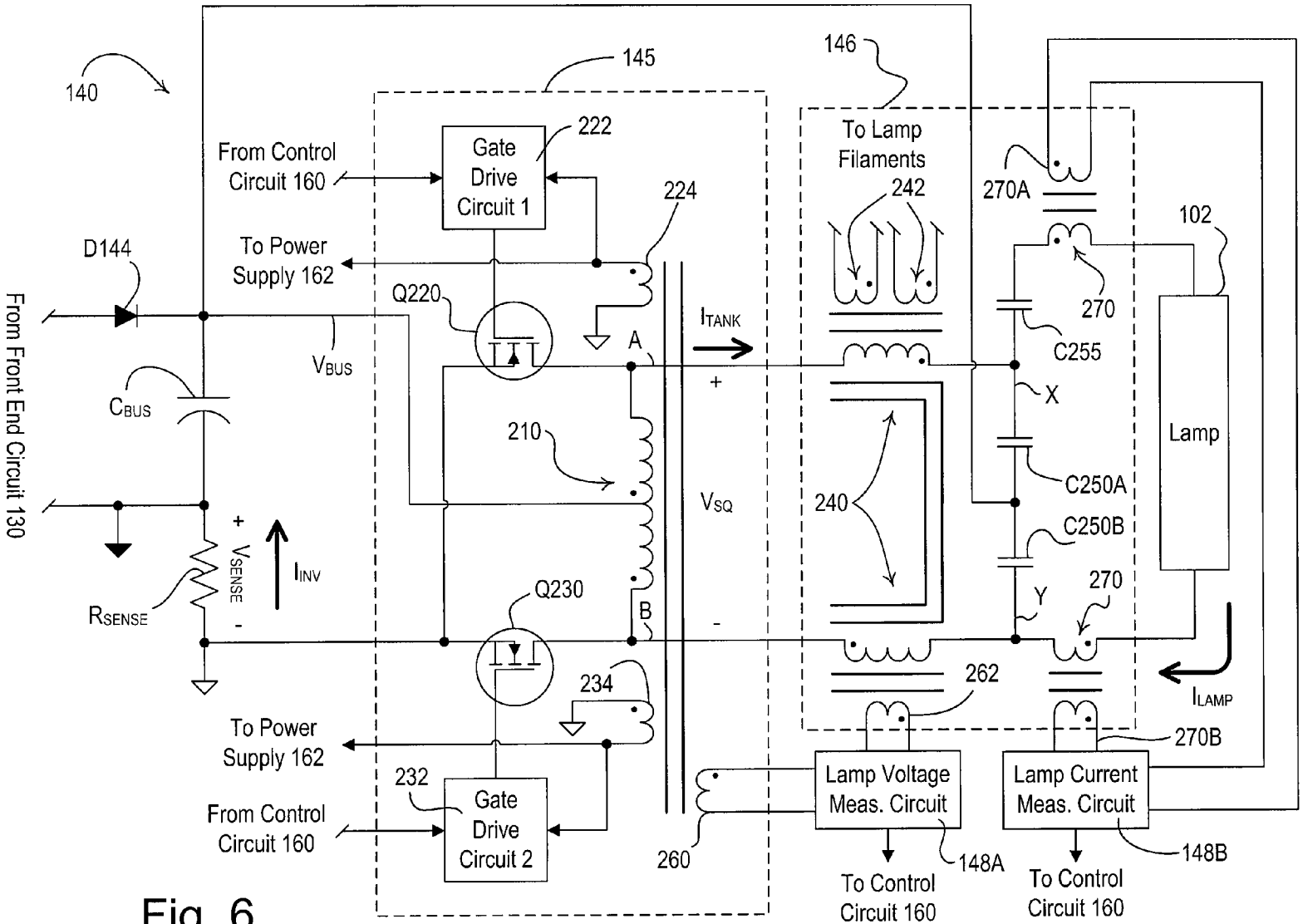
FIG. 6 is a simplified schematic diagram showing a bus capacitor, a sense resistor, an inverter circuit, and a resonant tank of a discrete-spectrum light source circuit of the hybrid light source of FIG. 3A.

FIG. 6 is a simplified schematic diagram showing the inverter circuit 145 and the resonant tank 146 in greater detail. As shown in FIG. 5, the inverter circuit 14, the bus capacitor $C_{BUS}$, and the sense resistor $R_{SENSE}$ form a push/pull converter. However, the present invention is not limited to ballast circuits having only push/pull converters. The inverter circuit 145 comprises a main transformer 210 having a center-tapped primary winding that is coupled across an output of the inverter circuit 145. The high-frequency square-wave voltage $V_{SQ}$ of the inverter circuit 145 is generated across the primary winding of the main transformer 210. The center tap of the primary winding of the main transformer 210 is coupled to the DC bus voltage $V_{BUS}$.

The inverter circuit 145 further comprises first and second semiconductor switches, e.g., field-effect transistors (FETs) Q220, Q230, which are coupled between the terminal ends of the primary winding of the main transformer 210 and circuit common. The FETs Q220, Q230 have control inputs (i.e., gates), which are coupled to first and second gate drive circuits 222, 232, respectively, for rendering the FETs conductive and non-conductive. The gate drive circuits 222, 232 receive first and second FET drive signals $V_{DRV_FET1}$ and $V_{DRV_FET2}$ from the control circuit 160, respectively. The gate drive circuits 222, 232 are also electrically coupled to respective drive windings 224, 234 that are magnetically coupled to the primary winding of the main transformer 210.

The push/pull converter of the ballast circuit 140 exhibits a partially self-oscillating behavior since the gate drive circuits 222, 232 are operable to control the operation of the FETs Q220, Q230 in response to control signals received from both the control circuit 160 and the main transformer 210. Specifically, the gate drive circuits 222, 232 are operable to turn on (i.e., render conductive) the FETs Q220, Q230 in response to the control signals from the drive windings 224, 234 of the main transformer 210, and to turn off (i.e., render non-conductive) the FETs in response to the control signals (i.e., the first and second FET drive signals $V_{DRV_FET1}$ and $V_{DRV_FET2}$) from the control circuit 160. The FETs Q220, Q230 may be rendered conductive on an alternate basis, i.e., such that the first FET Q220 is not conductive when the second FET Q230 is conductive, and vice versa.

When the first FET Q220 is conductive, the terminal end of the primary winding connected to the first FET Q220 is electrically coupled to circuit common. Accordingly, the DC bus voltage $V_{BUS}$ is provided across one-half of the primary winding of the main transformer 210, such that the high-frequency square-wave voltage $V_{SQ}$ at the output of the inverter circuit 145 (i.e., across the primary winding of the main transformer 210) has a magnitude of approximately twice the bus voltage (i.e., $2 \cdot V_{BUS}$) with a positive voltage potential present from node B to node A as shown on FIG. 6. When the second FET Q230 is conductive and the first FET Q220 is not conductive, the terminal end of the primary winding connected to the second FET Q230 is electrically coupled to circuit common. The high-frequency square-wave voltage $V_{SQ}$ at the output of the inverter circuit 140 has an opposite polarity than when the first FET Q220 is conductive (i.e., a positive voltage potential is now present from node A to node B). Accordingly, the high-frequency square-wave voltage $V_{SQ}$ has a magnitude of twice the bus voltage $V_{BUS}$ that changes polarity at the operating frequency of the inverter circuit 145.

As shown in FIG. 6, the drive windings 224, 234 of the main transformer 210 are also coupled to the power supply 162, such that the power supply is operable to draw current to generate the first and second DC supply voltages $V_{CC1}$, $V_{CC2}$ by drawing current from the drive windings during normal operation of the ballast circuit 140. When the hybrid light source 100 is first powered up, the power supply 162 draws current from the output of the front end circuit 130 through a high impedance path (e.g., approximately 50 kΩ) to generate an unregulated supply voltage $V_{UNREG}$. The power supply 162 does not generate the first DC supply voltage $V_{CC1}$ until the magnitude of the unregulated supply voltage $V_{UNREG}$ has increased to a predetermined level (e.g., 12 V) to allow the power supply to draw a small amount of current to charge properly during startup of the hybrid light source 100. During normal operation of the ballast circuit 140 (i.e., when the inverter circuit 145 is operating normally), the power supply 162 draws current to generate the unregulated supply voltage $V_{UNREG}$ and the first and second DC supply voltages $V_{CC1}$, $V_{CC2}$ from the drive windings 224, 234 of the inverter circuit 145. The unregulated supply voltage $V_{UNREG}$ has a peak voltage of approximately 15 V and a ripple voltage of approximately 3 V during normal operation.

The high-frequency square-wave voltage $V_{SQ}$ is provided to the resonant tank circuit 146, which draws a tank current $I_{TANK}$ from the inverter circuit 145. The resonant tank circuit 146 includes a "split" resonant inductor 240, which has first and second windings that are magnetically coupled together. The first winding is directly electrically coupled to node A at the output of the inverter circuit 145, while the second winding is directly electrically coupled to node B at the output of the inverter circuit. A "split" resonant capacitor (i.e., the series combination of two capacitors C250A, C250B) is coupled between the first and second windings of the split resonant inductor 240. The junction of the two capacitors C250A, 250B is coupled to the bus voltage $V_{BUS}$, i.e., to the junction of the diode D144, the bus capacitor $C_{BUS}$, and the center tap of the transformer 210. The split resonant inductor 240 and the capacitors C250A, C250B operate to filter the high-frequency square-wave voltage $V_{SQ}$ to produce the substantially sinusoidal voltage $V_{SIN}$ (between node X and node Y) for driving the fluorescent lamp 106. The sinusoidal voltage $V_{SIN}$ is coupled to the fluorescent lamp 106 through a DC-blocking capacitor C255, which prevents any DC lamp characteristics from adversely affecting the inverter.

The symmetric (or split) topology of the resonant tank circuit 146 minimizes the RFI noise produced at the electrodes of the fluorescent lamp 106. The first and second windings of the split resonant inductor 240 are each characterized by parasitic capacitances coupled between the leads of the windings. These parasitic capacitances form capacitive dividers with the capacitors C250A, C250B, such that the RFI noise generated by the high-frequency square-wave voltage $V_{SQ}$ of the inverter circuit 145 is attenuated at the output of the resonant tank circuit 146, thereby improving the RFI performance of the hybrid light source 100.

The first and second windings of the split resonant inductor 240 are also magnetically coupled to two filament windings 242, which are electrically coupled to the filaments of the fluorescent lamp 106. Before the fluorescent lamp 106 is turned on, the filaments of the fluorescent lamp must be heated in order to extend the life of the lamp. Specifically, during a preheat mode before striking the fluorescent lamp 106, the operating frequency $f_{OP}$ of the inverter circuit 145 is controlled to a preheat frequency $f_{PRE}$, such that the magnitude of the voltage generated across the first and second windings of the split resonant inductor 240 is substantially greater than the magnitude of the voltage produced across the capacitors C250A, C250B. Accordingly, at this time, the filament windings 242 provide filament voltages to the filaments of the fluorescent lamp 106 for heating the filaments. After the filaments are heated appropriately, the operating frequency $f_{OP}$ of the inverter circuit 145 is controlled such that the magnitude of the voltage across the capacitors C250A, C250B increases until the fluorescent lamp 106 strikes and the lamp current $I_{LAMP}$ begins to flow through the lamp.

The measurement circuit 148 is electrically coupled to a first auxiliary winding 260 (which is magnetically coupled to the primary winding of the main transformer 210) and to a second auxiliary winding 262 (which is magnetically coupled to the first and second windings of the split resonant inductor 240). The voltage generated across the first auxiliary winding 260 is representative of the magnitude of the high-frequency square-wave voltage $V_{SQ}$ of the inverter circuit 145, while the voltage generated across the second auxiliary winding 262 is representative of the magnitude of the voltage across the first and second windings of the split resonant inductor 240. Since the magnitude of the lamp voltage $V_{LAMP}$ is approximately equal to the sum of the high-frequency square-wave voltage $V_{SQ}$ and the voltage across the first and second windings of the split resonant inductor 240, the measurement circuit 148 is operable to generate the lamp voltage control signal $V_{LAMP_VLT}$ in response to the voltages across the first and second auxiliary windings 260, 262.

The high-frequency sinusoidal voltage $V_{SIN}$ generated by the resonant tank circuit 146 is coupled to the electrodes of the fluorescent lamp 106 via a current transformer 270. Specifically, the current transformer 270 has two primary windings which are coupled in series with each of the electrodes of the fluorescent lamp 106. The current transformer 270 also has two secondary windings 270A, 270B that are magnetically coupled to the two primary windings, and electrically coupled to the measurement circuit 148. The measurement circuit 148 is operable to generate the lamp current $I_{LAMP}$ control signal in response to the currents generated through the secondary windings 270A, 270B of the current transformer 270.

Figure 7:
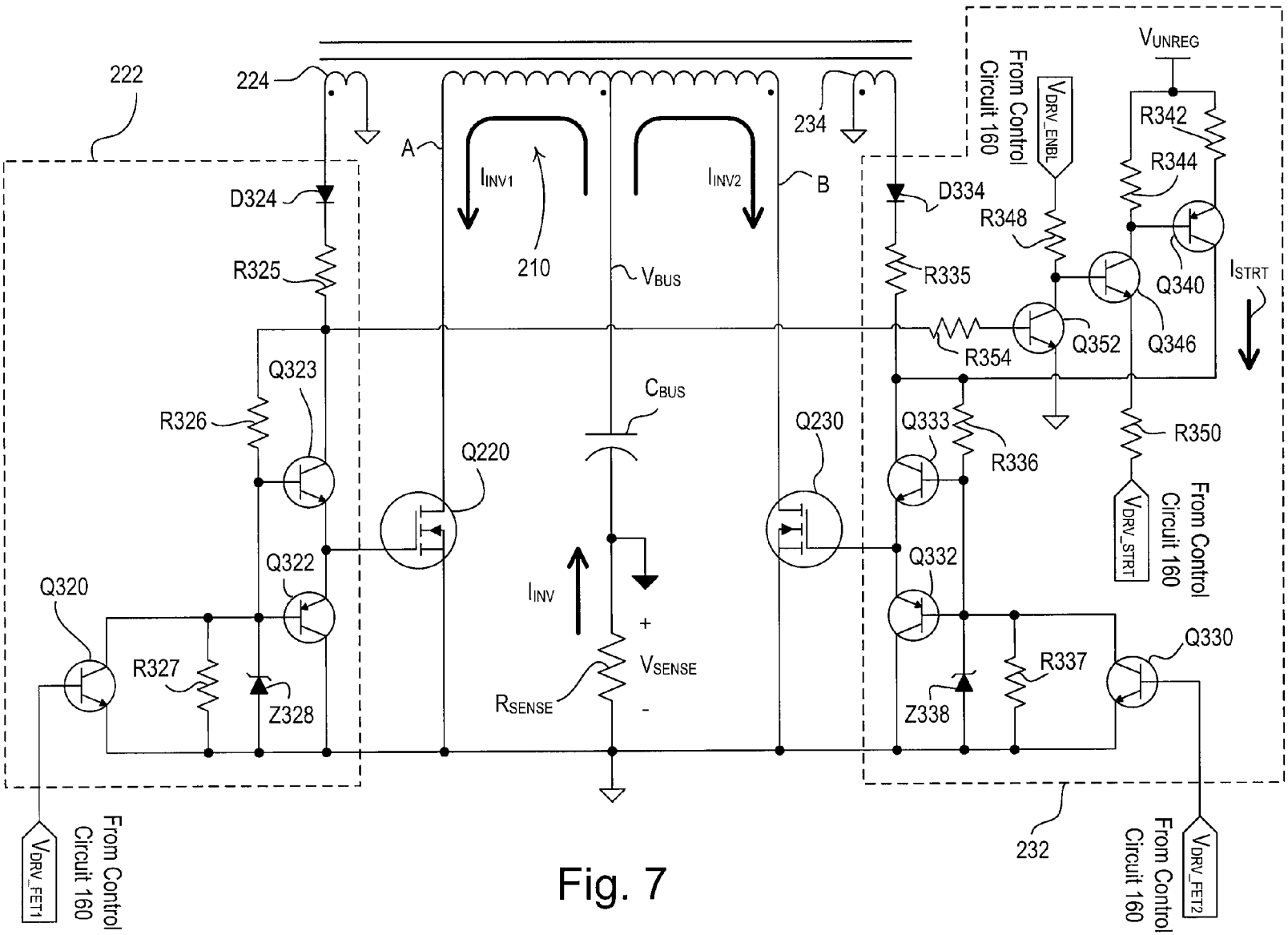
FIG. 7 is a simplified schematic diagram showing in greater detail a push/pull converter, which includes the inverter circuit, the bus capacitor, and the sense resistor of the discrete-spectrum light source circuit of FIG. 6.
Figure 8:
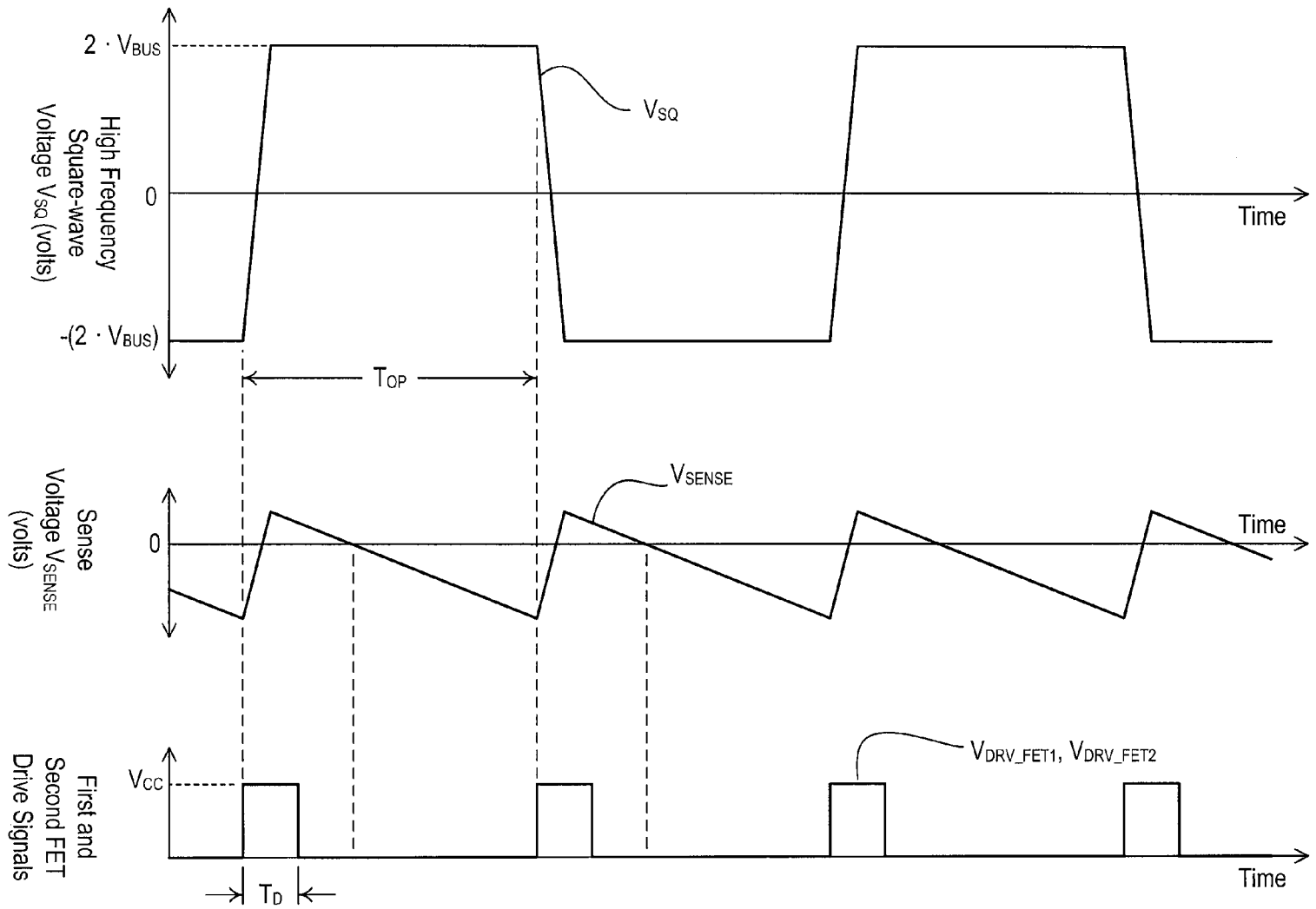
FIG. 8 is a simplified diagram of waveforms showing the operation of the push/pull converter of FIG. 7 during normal operation.

FIG. 7 is a simplified schematic diagram of the push/pull converter (i.e., the inverter circuit 145, the bus capacitor $C_{BUS}$, and the sense resistor $R_{SENSE}$) showing the gate drive circuits 222, 232 in greater detail. FIG. 8 is a simplified diagram of waveforms showing the operation of the push/pull converter during normal operation of the ballast circuit 140.

As previously mentioned, the first and second FETs Q220, Q230 are rendered conductive in response to the control signals provided from the first and second drive windings 224, 234 of the main transformer 210, respectively. The first and second gate drive circuits 222, 232 are operable to render the FETs Q220, Q230 non-conductive in response to the first and second FET drive signals $V_{DRV_FET1}$, $V_{DRV_FET2}$ generated by the control circuit 160, respectively. The control circuit 160 drives the first and second FET drive signals $V_{DRV_FET1}$, $V_{DRV_FET2}$ high and low simultaneously, such that the first and second FET drive signals are the same. Accordingly, the FETs Q220, Q230 are non-conductive at the same time, but are conductive on an alternate basis, such that the square-wave voltage is generated with the appropriate operating frequency $f_{OP}$.

When the second FET Q230 is conductive, the tank current $I_{TANK}$ flows through a first half of the primary winding of the main transformer 210 to the resonant tank circuit 146 (i.e., from the bus capacitor $C_{BUS}$ to node A as shown in FIG. 7). At the same time, a current $I_{INV2}$ (which has a magnitude equal to the magnitude of the tank current) flows through a second half of the primary winding (as shown in FIG. 7). Similarly, when the first FET Q220 is conductive, the tank current $I_{TANK}$ flows through the second half of the primary winding of the main transformer 210, and a current $I_{INV1}$ (which has a magnitude equal to the magnitude of the tank current) flows through the first half of the primary winding. Accordingly, the inverter current $I_{INV}$ has a magnitude equal to approximately twice the magnitude of the tank current $I_{TANK}$.

When the first FET Q220 is conductive, the magnitude of the high-frequency square wave voltage $V_{SQ}$ is approximately twice the bus voltage $V_{BUS}$ as measured from node B to node A. As previously mentioned, the tank current $I_{TANK}$ flows through the second half of the primary winding of the main transformer 210, and the current $I_{INV1}$ flows through the first half of the primary winding. The sense voltage $V_{SENSE}$ is generated across the sense resistor $R_{SENSE}$ and is representative of the magnitude of the inverter current $I_{INV}$. Note that the sense voltage $V_{SENSE}$ is a negative voltage when the inverter current $I_{INV}$ flows through the sense resistor $R_{SENSE}$ in the direction of the inverter current $I_{INV}$ shown in FIG. 7. The control circuit 160 is operable to turn off the first FET Q220 in response to the integral of the sense voltage $V_{SENSE}$ reaching a threshold voltage. The operation of the control circuit 160 and the integral control signal $V_{INT}$ are described in greater detail in commonly-assigned U.S. patent application, entitled ELECTRONIC DIMMING BALLAST HAVING A PARTIALLY SELF-OSCILLATING INVERTER CIRCUIT, the entire disclosure of which is hereby incorporated by reference.

To turn off the first FET Q220, the control circuit 160 drives the first FET drive signal $V_{DRV_FET1}$ high (i.e., to approximately the first DC supply voltage $V_{CC1}$). Accordingly, an NPN bipolar junction transistor Q320 becomes conductive and conducts a current through the base of a PNP bipolar junction transistor Q322. The transistor Q322 becomes conductive pulling the gate of the first FET Q220 down towards circuit common, such that the first FET Q220 is rendered non-conductive. After the FET Q220 is rendered non-conductive, the inverter current $I_{INV}$ continues to flow and charges a drain capacitance of the FET Q220. The high-frequency square-wave voltage $V_{SQ}$ changes polarity, such that the magnitude of the square-wave voltage $V_{SQ}$ is approximately twice the bus voltage $V_{BUS}$ as measured from node A to node B and the tank current $I_{TANK}$ is conducted through the first half of the primary winding of the main transformer 210. Eventually, the drain capacitance of the first FET Q220 charges to a point at which circuit common is at a greater magnitude than node B of the main transformer, and the body diode of the second FET Q230 begins to conduct, such that the sense voltage $V_{SENSE}$ briefly is a positive voltage.

The control circuit 160 drives the second FET drive signal $V_{DRV_FET2}$ low to allow the second FET Q230 to become conductive after a "dead time", and while the body diode of the second FET Q230 is conductive and there is substantially no voltage developed across the second FET Q230 (i.e., only a "diode drop" or approximately 0.5-0.7V). The control circuit 160 waits for a dead time period $T_D$ (e.g., approximately 0.5 μsec) after driving the first and second FET drive signals $V_{DRV_FET1}$, $V_{DRV_FET2}$ high before the control circuit 160 drives the first and second FET drive signals $V_{DRV_FET1}$, $V_{DRV_FET2}$ low in order to render the second FET Q230 conductive while there is substantially no voltage developed across the second FET (i.e., during the dead time). The magnetizing current of the main transformer 210 provides additional current for charging the drain capacitance of the FET Q220 to ensure that the switching transition occurs during the dead time.

Specifically, the second FET Q230 is rendered conductive in response to the control signal provided from the second drive winding 234 of the main transformer 210 after the first and second FET drive signals $V_{DRV_FET1}$, $V_{DRV_FET2}$ are driven low. The second drive winding 234 is magnetically coupled to the primary winding of the main transformer 210, such that the second drive winding 234 is operable to conduct a current into the second gate drive circuit 232 through a diode D334 when the square-wave voltage $V_{SQ}$ has a positive voltage potential from node A to node B. Thus, when the first and second FET drive signals $V_{DRV_FET1}$, $V_{DRV_FET2}$ are driven low by the control circuit 160, the second drive winding 234 conducts current through the diode D334 and resistors R335, R336, R337, and an NPN bipolar junction transistor Q333 is rendered conductive, thus, rendering the second FET Q230 conductive. The resistors R335, R336, R337 have, for example, resistances of 50Ω, 1.5 kΩ, and 33 kΩ, respectively. A zener diode Z338 has a breakover voltage of 15 V, for example, and is coupled to the transistors Q332, Q333 to prevent the voltage at the bases of the transistors Q332, Q333 from exceeding approximately 15 V.

Since the square-wave voltage $V_{SQ}$ has a positive voltage potential from node A to node B, the body diode of the second FET Q230 eventually becomes non-conductive. The current $I_{INV2}$ flows through the second half of the primary winding and through the drain-source connection of the second FET Q230. Accordingly, the polarity of the sense voltage $V_{SENSE}$ changes from positive to negative as shown in FIG. 8. When the integral control signal $V_{INT}$ reaches the voltage threshold $V_{TH}$, the control circuit 160 once again renders both of the FETs Q220, Q230 non-conductive. Similar to the operation of the first gate drive circuit 222, the gate of the second FET Q230 is then pulled down through two transistors Q330, Q332 in response to the second FET drive signal $V_{DRV_FET2}$ After the second FET Q230 becomes non-conductive, the tank current $I_{TANK}$ and the magnetizing current of the main transformer 210 charge the drain capacitance of the second FET Q230 and the square-wave voltage $V_{SQ}$ changes polarity. When the first FET drive signal $V_{DRV_FET1}$ is driven low, the first drive winding 224 conducts current through a diode D324 and three resistors R325, R326, R327 (e.g., having resistances of 50Ω, 1.5 kΩ, and 33 kΩ, respectively). Accordingly, an NPN bipolar junction transistor Q323 is rendered conductive, such that the first FET Q220 becomes conductive. The push/pull converter continues to operate in the partially self-oscillating fashion in response to the first and second drive signals $V_{DRV_FET1}$, $V_{DRV_FET2}$ from the control circuit 160 and the first and second drive windings 224, 234.

During startup of the ballast 100, the control circuit 160 is operable to enable a current path to conduct a startup current $I_{STRT}$ through the resistors R336, R337 of the second gate drive circuit 232. In response to the startup current $I_{STRT}$, the second FET Q230 is rendered conductive and the inverter current $I_{INV1}$ begins to flow. The second gate drive circuit 232 comprises a PNP bipolar junction transistor Q340, which is operable to conduct the startup current $I_{STRT}$ from the unregulated supply voltage $V_{UNREG}$ through a resistor R342 (e.g., having a resistance of 100Ω). The base of the transistor Q340 is coupled to the unregulated supply voltage $V_{UNREG}$ through a resistor R344 (e.g., having a resistance of 330Ω).

The control circuit 160 generates a FET enable control signal $V_{DRV_ENBL}$ and an inverter startup control signal $V_{DRV_STRT}$, which are both provided to the inverter circuit 140 in order to control the startup current $I_{STRT}$. The FET enable control signal $V_{DRV_ENBL}$ is coupled to the base of an NPN bipolar junction transistor Q346 through a resistor R348 (e.g., having a resistance of 1 kΩ). The inverter startup control signal $V_{DRV_STRT}$ is coupled to the emitter of the transistor Q346 through a resistor R350 (e.g., having a resistance of 220Ω). The inverter startup control signal $V_{DRV_STRT}$ is driven low by the control circuit 160 at startup of the ballast 100. The FET enable control signal $V_{DRV_ENBL}$ is the complement of the first and second drive signals $V_{DRV_FET1}$, $V_{DRV_FET2}$, i.e., the FET enable control signal $V_{DRV_ENBL}$ is driven high when the first and second drive signals $V_{DRV_FET1}$, $V_{DRV_FET2}$ are low (i.e., the FETs Q220, Q230 are conductive). Accordingly, when the inverter startup control signal $V_{DRV_STRT}$ is driven low during startup and the FET enable control signal $V_{DRV_ENBL}$ is driven high, the transistor Q340 is rendered conductive and conducts the startup current $I_{STRT}$ through the resistors R336, R337 and the inverter current $I_{INV}$ begins to flow. Once the push/pull converter is operating in the partially self-oscillating fashion described above, the control circuit 160 disables the current path that provides the startup current $I_{STRT}$.

Another NPN transistor Q352 is coupled to the base of the transistor Q346 for preventing the transistor Q346 from being rendered conductive when the first FET Q220 is conductive. The base of the transistor Q352 is coupled to the junction of the resistors R325, R326 and the transistor Q323 of the first gate drive circuit 222 through a resistor R354 (e.g., having a resistance of 10Ω). Accordingly, if the first drive winding 224 is conducting current through the diodes D324 to render the first FET Q220 conductive, the transistor Q340 is prevented from conducting the startup current $I_{STRT}$.

Figure 9:
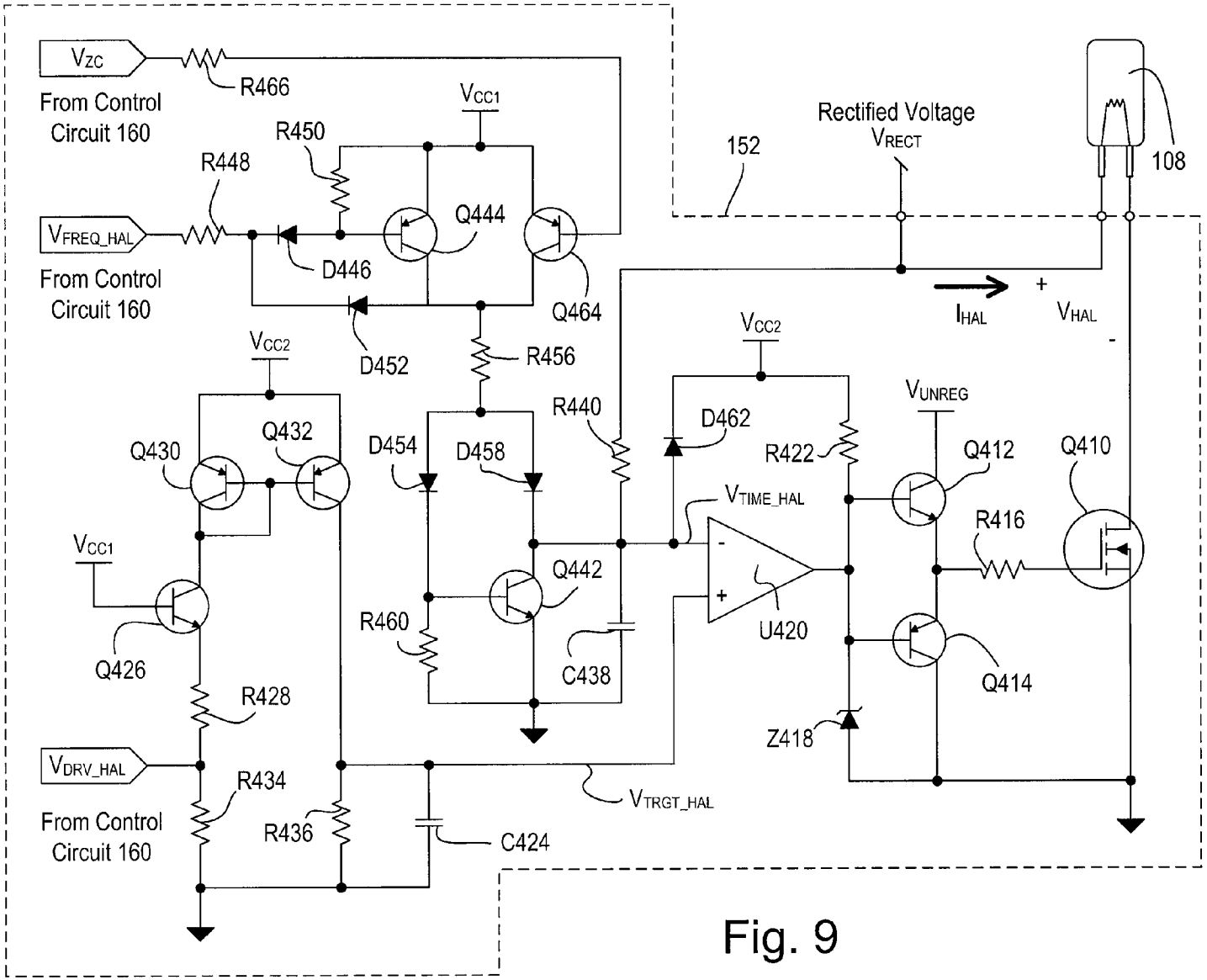
FIG. 9 is a simplified schematic diagram showing the halogen lamp drive circuit of the continuous-spectrum light source circuit in greater detail.
Figure 10:
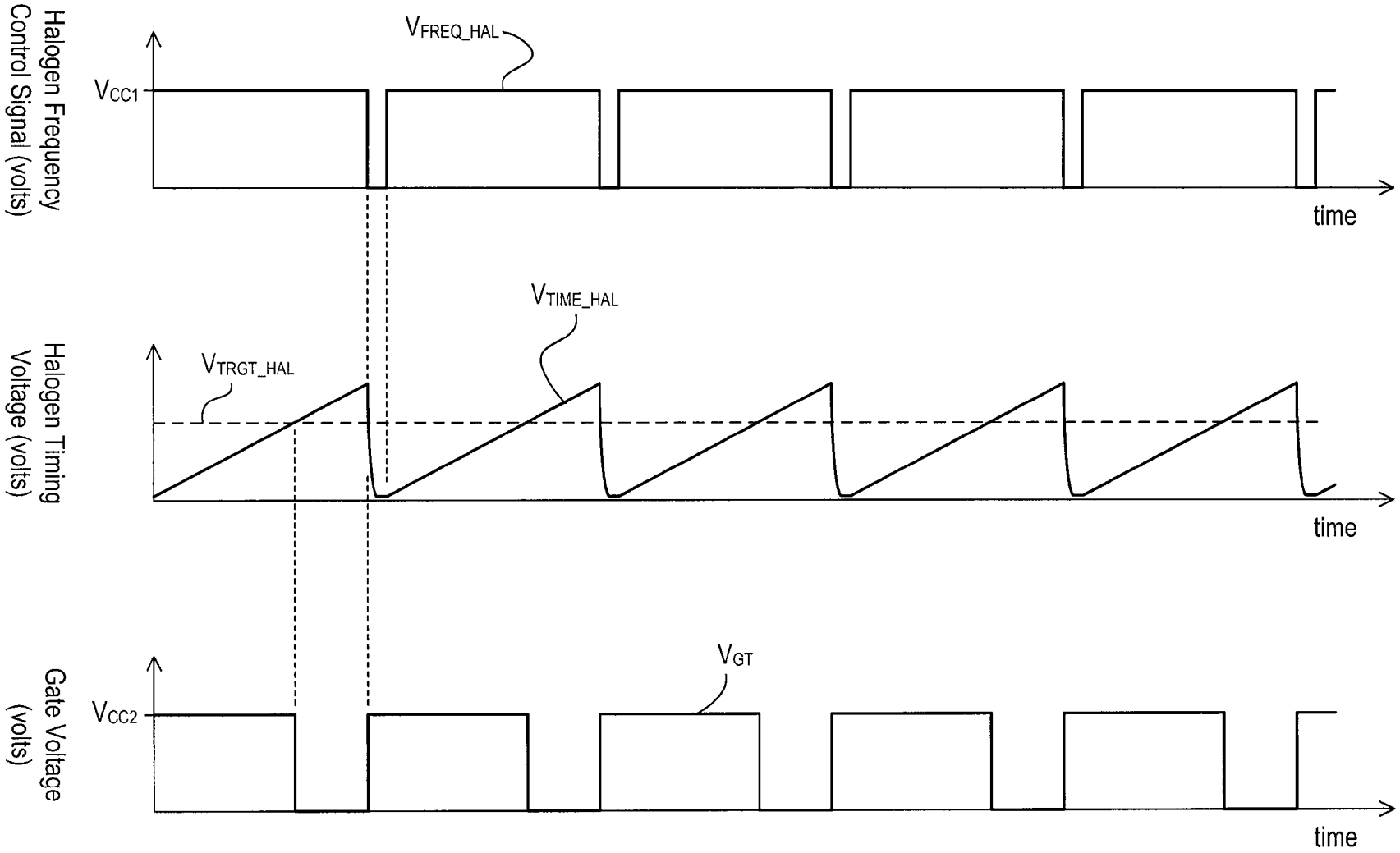
FIG. 10 is a simplified diagram of voltage waveforms of the halogen lamp drive circuit of FIG. 9.

FIG. 9 is a simplified schematic diagram showing the halogen lamp drive circuit 152 of the low-efficiency light source circuit 150 in greater detail. FIG. 10 is a simplified diagram of voltage waveforms of the halogen lamp drive circuit 152. When the total light intensity $L_{TOTAL}$, of the hybrid light source 100 is less than the transition intensity $L_{TRAN}$, the halogen drive circuit 152 controls the halogen lamp 108 to be on after the bidirectional semiconductor switch 105B of the dimmer switch 104 is rendered conductive each half-cycle. When the total light intensity $L_{TOTAL}$ of the hybrid light source 100 is greater than the transition intensity $L_{TRAN}$, the halogen drive circuit 152 is operable to pulse-width modulate the halogen voltage $V_{HAL}$ provided across the halogen lamp 108 to control the amount of power delivered to the halogen lamp. Specifically, the halogen drive circuit 152 controls the amount of power delivered to the halogen lamp 108 to be greater than or equal to a minimum power level $P_{MIN}$ when the total light intensity $L_{TOTAL}$ of the hybrid light source 100 is greater than the transition intensity $L_{TRAN}$.

The halogen lamp drive circuit 152 receives a halogen lamp drive level control signal $V_{DRV_HAL}$ and a halogen frequency control signal $V_{FREQ_HAL}$ from the control circuit 160. The halogen lamp drive level control signal $V_{DRV_HAL}$ is a pulse-width modulated (PWM) signal having a duty cycle that is representative of the target halogen lighting intensity. As shown in FIG. 10, the halogen frequency control signal $V_{FREQ_HAL}$ comprises a pulse train that defines a constant halogen lamp drive circuit operating frequency $f_{HAL}$ at which the halogen lamp drive circuit 152 operates. As long as the hybrid light source 100 is powered, the control circuit 160 generates the halogen frequency control signal $V_{FREQ_HAL}$.

The halogen lamp drive circuit 152 controls the amount of power delivered to the halogen lamp 108 using a semiconductor switch (e.g., a FET Q410), which is coupled in series electrical connection with the halogen lamp. When the FET Q410 is conductive, the halogen lamp 108 conducts a halogen current $I_{HAL}$. A push-pull drive circuit (which includes an NPN bipolar junction transistor Q412 and a PNP bipolar junction transistor Q414) provides a gate voltage $V_{GT}$ to the gate of the FET Q410 via a resistor R416 (e.g., having a resistance of 10Ω). The FET Q410 is rendered conductive when the magnitude of the gate voltage $V_{GT}$ exceeds the specified gate voltage threshold of the FET. A zener diode Z418 is coupled between the base of the transistor 414 and the rectifier common connection and has a break-over voltage of, for example, 15 V.

The halogen lamp drive circuit 152 comprises a comparator U420 that controls when the FET Q410 is rendered conductive. The output of the comparator U420 is coupled to the junction of the bases of the transistors Q412, Q414 of the push-pull drive circuit and is pulled up to the second DC supply voltage $V_{CC2}$ via a resistor R422 (e.g., having a resistance of 4.7 kΩ). A halogen timing voltage $V_{TIME_HAL}$ is provided to the inverting input of the comparator U420 and is a periodic signal that increases in magnitude with respect to time during each period as shown in FIG. 10. A halogen target threshold voltage $V_{TRGT_HAL}$ is provided to the non-inverting input of the comparator U420 and is a substantially DC voltage representative of the target halogen lighting intensity (e.g., ranging from approximately 0.6 V to 15 V).

The halogen target threshold voltage $V_{TRGT_HAL}$ is generated in response to the halogen lamp drive level control signal $V_{DRV_HAL}$ from the control circuit 160. Since the control circuit 160 is referenced to the circuit common connection and the halogen lamp drive circuit 152 is referenced to the rectifier common connection, the halogen lamp drive circuit 152 comprises a current mirror circuit for charging a capacitor C424 (e.g., having a capacitance of 0.01 μF), such that the halogen target threshold voltage $V_{TRGT_HAL}$ is generated across the capacitor C424. The halogen lamp drive level control signal $V_{DRV_HAL}$ from the control circuit 160 is coupled to the emitter of an NPN bipolar junction transistor Q426 via a resistor R428 (e.g., having a resistance of 33 kΩ). The base of the transistor Q426 is coupled to the first DC supply voltage $V_{CC1}$ from which the control circuit 160 is powered. The current mirror circuit comprises two PNP transistors Q430, Q432. The transistor Q430 is connected between the collector of the transistor Q426 and the second DC supply voltage $V_{CC2}$.

When the halogen lamp drive level control signal $V_{DRV_HAL}$ is high (i.e., at approximately the first DC supply voltage $V_{CC1}$), the transistor Q426 is non-conductive. However, when the halogen lamp drive level control signal $V_{DRV_HAL}$ is driven low (i.e., to approximately the circuit common connection to which the control circuit 160 is referenced), the first DC supply voltage $V_{CC1}$ is provided across the base-emitter junction of the transistor Q426 and the resistor R428. The transistor Q426 is rendered conductive and a substantially constant current is conducted through the resistor R428 and a resistor R434 (e.g., having a resistance of 33 kΩ) to the rectifier common connection. A current having approximately the same magnitude as the current through the resistor R428 is conducted through the transistor Q432 of the current mirror circuit and a resistor R436 (e.g., having a resistance of 100 kΩ). Accordingly, the halogen target threshold voltage $V_{TRGT_HAL}$ is generated across the capacitor C424 as a substantially DC voltage as shown in FIG. 10.

The halogen timing voltage $V_{TIME_HAL}$ is generated in response to the halogen frequency control signal $V_{FREQ_HAL}$ from the control circuit 160. A capacitor C438 is coupled between the inverting input of the comparator U420 and the rectifier common connection, and produces the halogen timing voltage $V_{TIME_HAL}$, which increases in magnitude with respect to time. The capacitor C438 charges from the rectified voltage $V_{RECT}$ through a resistor R440, such that the rate at which the capacitor C438 charges increases as the magnitude of the rectified voltage increases, which allows a relatively constant amount of power to be delivered to the halogen lamp 108 after the bidirectional semiconductor switch 105B of the dimmer switch 104 is rendered conductive each half-cycle. For example, the resistor R440 has a resistance of 220Ω and the capacitor C438 has a capacitance of 560 pF, such that the halogen timing voltage $V_{TIME_HAL}$ has a substantially constant slope while the capacitor C438 is charging (as shown in FIG. 10). An NPN bipolar junction transistor Q442 is coupled across the capacitor C438 and is responsive to the halogen frequency control signal $V_{FREQ_HAL}$ to periodically reset of the halogen timing voltage $V_{TIME_HAL}$. Specifically, the magnitude of the halogen timing voltage $V_{TIME_HAL}$ is controlled to substantially low magnitude, e.g., to a magnitude below the magnitude of the halogen target threshold voltage $V_{TRGT_HAL}$ at the non-inverting input of the comparator U420 (i.e., to approximately 0.6 V).

The halogen frequency control signal $V_{FREQ_HAL}$ is coupled to the base of a PNP bipolar junction transistor Q444 through a diode D446 and a resistor R448 (e.g., having a resistance of 33 kΩ). The base of the transistor Q444 is coupled to the emitter (which is coupled to the first DC supply voltage $V_{CC1}$) via a resistor R450 (e.g., having a resistance of 33 kΩ). A diode D452 is coupled between the collector of the transistor Q444 and the junction of the diode D446 and the resistor R448. When the halogen frequency control signal $V_{FREQ_HAL}$ is high (i.e., at approximately the first DC supply voltage $V_{CC1}$), the transistor Q444 is non-conductive. When the halogen frequency control signal $V_{FREQ_HAL}$ is driven low (i.e., to approximately circuit common), the transistor Q444 is rendered conductive causing the transistor Q442 to be rendered conductive as will be described below. The two diodes D446, D452 form a Baker clamp to prevent the transistor Q444 from becoming saturated, such that the transistor Q444 quickly becomes non-conductive when the halogen frequency control signal $V_{FREQ_HAL}$ is controlled high once again.

The base of the transistor Q442 is coupled to the collector of the transistor Q444 via a diode D454 and a resistor R456 (e.g., having a resistances of 33 kΩ). A diode D458 is coupled between the collector of the transistor Q442 and the collector of the transistor Q444. When the halogen frequency control signal $V_{FREQ_HAL}$ is high and the transistor Q444 is non-conductive, the transistor Q444 is also non-conductive, thus allowing the capacitor C438 to charge. When the halogen frequency control signal $V_{FREQ_HAL}$ is low and the transistor Q444 is conductive, current is conducted through the resistor R456, the diode D454, and a resistor R460 (e.g., having a resistance of 33 kΩ) and the transistor Q442 is rendered conductive, thus allowing the capacitor C438 to quickly discharge (as shown in FIG. 10). After the halogen frequency control signal $V_{FREQ_HAL}$ is driven high, the capacitor C438 begins to charge once again. The two diodes D454, D458 also form a Baker clamp to prevent the transistor Q442 from saturating and thus allowing the transistor Q422 to be quickly rendered non-conductive. The inverting input of the comparator U420 is coupled to the second DC supply voltage $V_{CC2}$ via a diode D462 to prevent the magnitude of the halogen timing voltage $V_{TIME_HAL}$ from exceeding a predetermined voltage (e.g., a diode drop above the second DC supply voltage $V_{CC2}$).

The comparator U420 causes the push-pull drive circuit to generate the gate voltage $V_{GT}$ at the constant halogen lamp drive circuit operating frequency $f_{HAL}$ (defined by the halogen frequency control signal $V_{FREQ_HAL}$) and at a variable duty cycle (dependent upon the magnitude of the halogen target threshold voltage $V_{TRGT_HAL}$). When the halogen timing voltage $V_{TIME_HAL}$ exceeds the halogen target threshold voltage $V_{TRGT_HAL}$, the gate voltage $V_{GT}$ is driven low rendering the FET Q410 non-conductive. When the halogen timing voltage $V_{TIME_HAL}$ falls below the halogen target threshold voltage $V_{TRGT_HAL}$, the gate voltage $V_{GT}$ is driven high thus rendering the FET Q410 conductive, such that the halogen current $I_{HAL}$ is conducted through the halogen lamp 108. As the magnitude of the halogen target threshold voltage $V_{TRGT_HAL}$ and the duty cycle of the gate voltage $V_{GT}$ increases, the intensity of the halogen lamp 108 increases (and vice versa).

The low-efficiency light source circuit 150 is operable to provide a path for the charging current $I_{CHRG}$ of the power supply 105D of the dimmer switch 104 when the semiconductor switch 105B is non-conductive, and thus the zero-crossing control signal $V_{ZC}$ is low. The zero-crossing control signal $V_{ZC}$ is also provided to the halogen lamp drive circuit 150. Specifically, the zero-crossing control signal $V_{ZC}$ is coupled to the base of an NPN bipolar junction transistor Q464 via a resistor R466 (e.g., having a resistance of 33 kΩ). The transistor Q464 is coupled in parallel with the transistor Q444, which is responsive to the halogen frequency control signal $V_{FREQ_HAL}$. When the phase-controlled voltage $V_{PC}$ has a magnitude of approximately zero volts and the zero-crossing control signal $V_{ZC}$ is low, the transistor Q464 is rendered conductive, thus the magnitude of the halogen timing voltage $V_{TIME_HAL}$ remains at a substantially low voltage (e.g., approximately 0.6 V). Since the magnitude of the halogen timing voltage $V_{TIME_HAL}$ is maintained below the magnitude of the halogen target threshold voltage $V_{TRGT_HAL}$, the FET Q410 is rendered conductive, thus providing a path for the charging current $I_{CHRG}$ of the power supply 105D to flow when the semiconductor switch 105B is non-conductive.

As previously mentioned, the bidirectional semiconductor 105B of the dimmer switch 104 may be a thyristor, such as, a triac or two silicon-controlled rectifier (SCRs) in anti-parallel connection. Thyristors are typically characterized by a rated latching current and a rated holding current. The current conducted through the main terminals of the thyristor must exceed the latching current for the thyristor to become fully conductive. The current conducted through the main terminals of the thyristor must remain above the holding current for the thyristor to remain in full conduction.

The control circuit 160 of the hybrid light source 100 controls the low-efficiency light source circuit 150, such that the low-efficiency light source circuit provides a path for enough current to flow to exceed the required latching current and holding current of the semiconductor switch 105B. To accomplish this feature, the control circuit 160 does not completely turn off the halogen lamp 108 at any points of the dimming range, specifically, at the high-end intensity $L_{HE}$, where the fluorescent lamp 106 provides the majority of the total light intensity $L_{TOTAL}$ of the hybrid light source 100. At the high-end intensity $L_{HE}$, the control circuit 160 controls the halogen target threshold voltage $V_{TRGT_HAL}$ to a minimum threshold value, such that the amount of power delivered to the halogen lamp 108 is controlled to the minimum power level $P_{MIN}$. Accordingly, after the semiconductor switch 105B is rendered conductive, the low-efficiency light source circuit 150 is operable to conduct enough current to ensure that the required latching current and holding current of the semiconductor switch 105B are reached. Even though the halogen lamp 108 conducts some current at the high-end intensity $L_{HE}$, the magnitude of the current is not large enough to illuminate the halogen lamp. Alternatively, the halogen lamp 108 may produce a greater percentage of the total light intensity $L_{TOTAL}$ of the hybrid light source 100, for example, up to approximately 50% of the total light intensity.

Accordingly, the hybrid light source 100 (specifically, the low-efficiency light source circuit 150) is characterized by a low impedance between the input terminals 110A, 110B during the length of the each half-cycle of the AC power source 102. Specifically, the impedance between the input terminals 110A, 110B (i.e., the impedance of the low-efficiency light source circuit 150) has an average magnitude that is substantially low, such that the current drawn through the impedance is not large enough to visually illuminate the halogen lamp 108 (when the semiconductor switch 105B of the dimmer switch 104 in non-conductive), but is great enough to exceed the rated latching current or the rated holding current of the thyristor in the dimmer switch 104, or to allow the timing current $I_{TIM}$ or the charging current $I_{CHRG}$ of the dimmer switch to flow. For example, the hybrid light source 100 may provide an impedance having an average magnitude of approximately 1.44 kΩ or less in series with the AC power source 102 and the dimmer switch 104 during the length of each half-cycle, such that the hybrid light source 100 appears like a 10-Watt incandescent lamp to the dimmer switch 104. Alternatively, the hybrid light source 100 may provide an impedance having an average magnitude of approximately 360Ω or less in series with the AC power source 102 and the dimmer switch 104 during the length of each half-cycle, such that the hybrid light source 100 appears like a 40-Watt incandescent lamp to the dimmer switch 104.

Figure 11A:
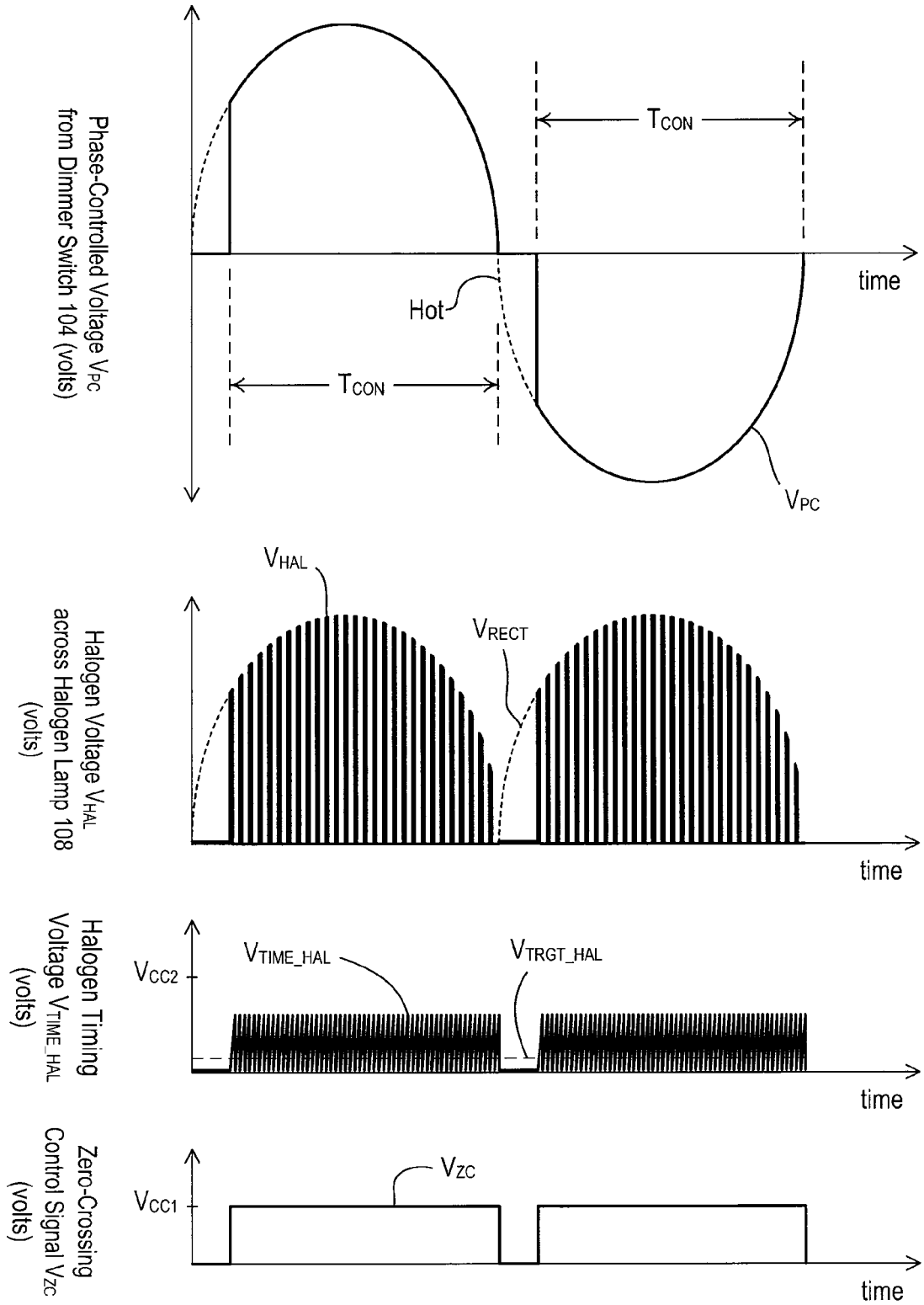
FIGS. 11A-11C are simplified diagrams of voltage waveforms of the hybrid light source of FIG. 5 as the hybrid light source is controlled to different values of the total light intensity.
Figure 11B:
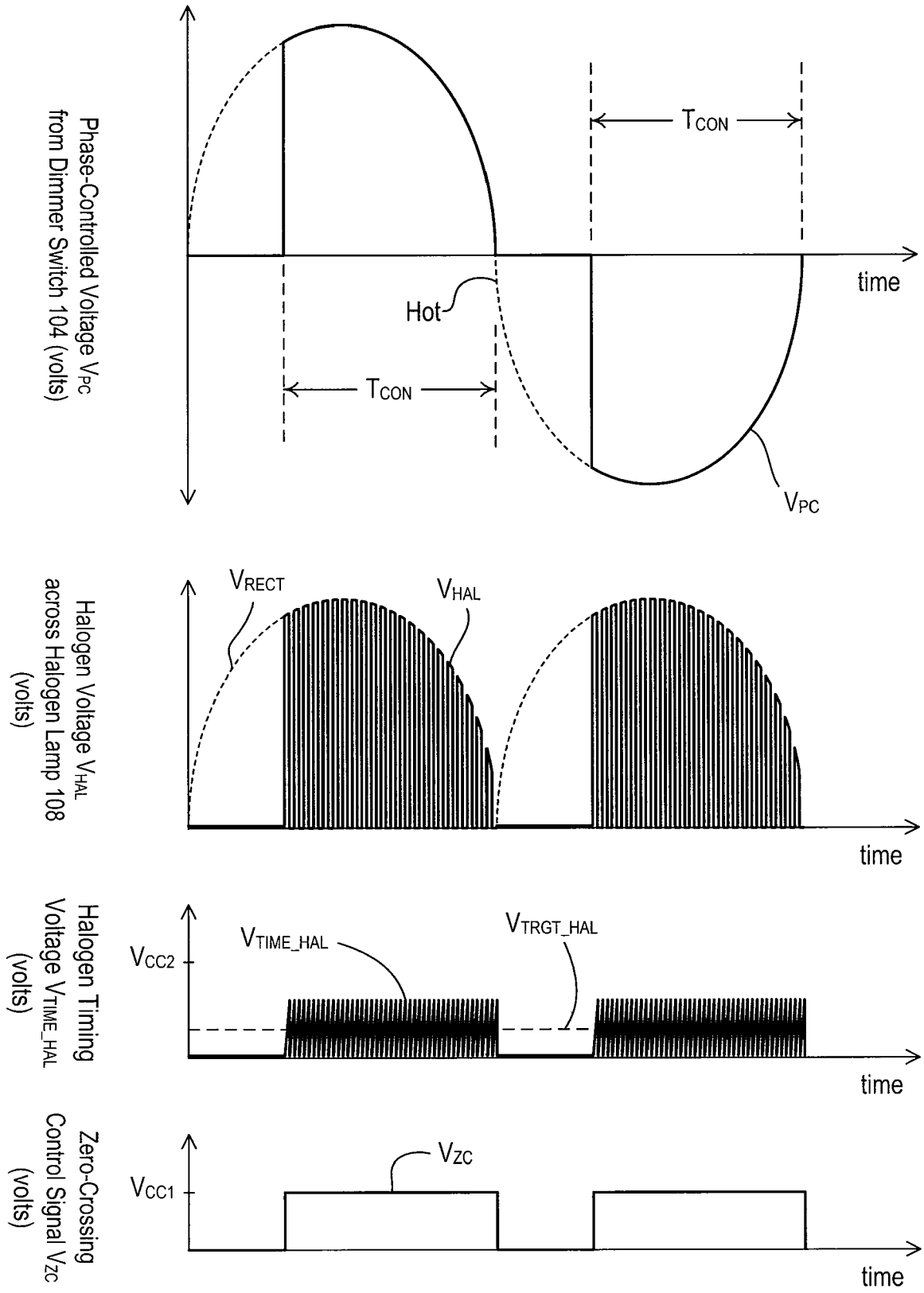
Figure 11C:
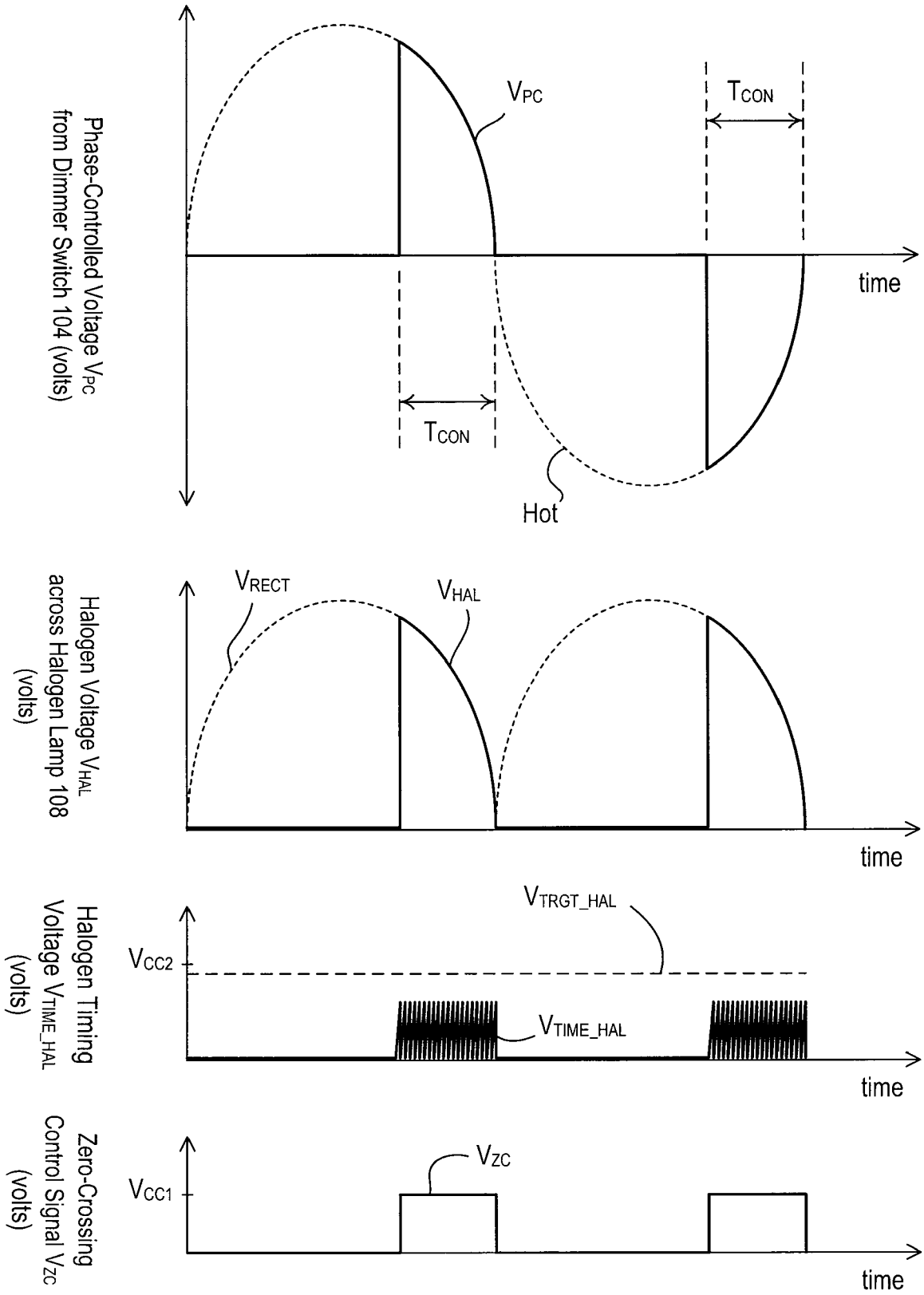

FIGS. 11A-11C are simplified diagrams of voltage waveforms of the hybrid light source 100 showing the phase-controlled voltage $V_{PC}$, the halogen voltage $V_{HAL}$, the halogen timing voltage $V_{TIME_HAL}$, and the zero-crossing control signal $V_{ZC}$ as the hybrid light source is controlled to different values of the target total light intensity $L_{TOTAL}$. In FIG. 11A, the total light intensity $L_{TOTAL}$ is at the high-end intensity $L_{HE}$, i.e., the dimmer switch 104 is controlling the conduction period $T_{CON}$ to a maximum period. The amount of power delivered to the halogen lamp 108 is controlled to the minimum power level $P_{MIN}$ such that the halogen lamp 108 conducts current to ensure that the required latching current and holding current of the semiconductor switch 105B are obtained. When the zero-crossing control signal $V_{ZC}$ is low, the halogen lamp 108 provides a path for the charging current $I_{CHRG}$ of the power supply 105D to flow and there is a small voltage drop across the halogen lamp.

In FIG. 11B, the total light intensity $L_{TOTAL}$ is below the high-end intensity $L_{HE}$, but above the transition intensity $L_{TRAN}$. At this time, the amount of power delivered to the halogen lamp 108 is greater than the minimum power level $P_{MIN}$ such that the halogen lamp 108 comprises a greater percentage of the total light intensity $L_{TOTAL}$. In FIG. 11C, the total light intensity $L_{TOTAL}$ is below the transition intensity $L_{TRAN}$, such that the fluorescent lamp 106 is turned off and the halogen lamp 108 provides all of the total light intensity $L_{TOTAL}$ of the hybrid light source 100. For example, the halogen target threshold voltage $V_{TRGT_HAL}$ has a magnitude greater than the maximum value of the halogen timing voltage $V_{TIME_HAL}$, such that the halogen voltage $V_{HAL}$ is not pulse-width modulated below the transition intensity $L_{TRAN}$. Alternatively, the halogen lamp 108 may also be pulse-width modulated below the transition intensity $L_{TRAN}$.

Figure 12A:
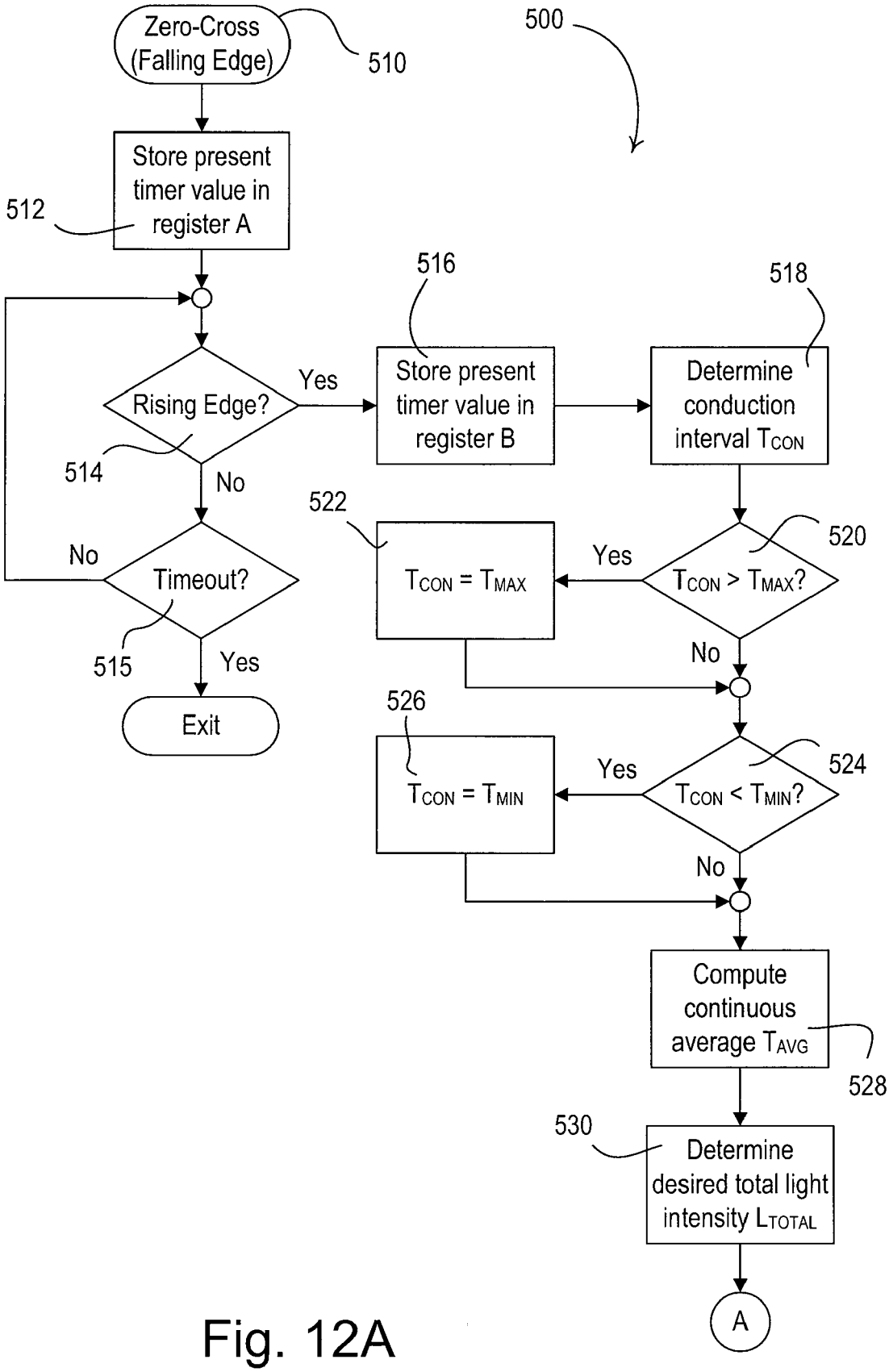
FIGS. 12A and 12B are simplified flowcharts of a target light intensity procedure executed periodically by a control circuit 160 of the hybrid light source of FIG. 5.
Figure 12B:
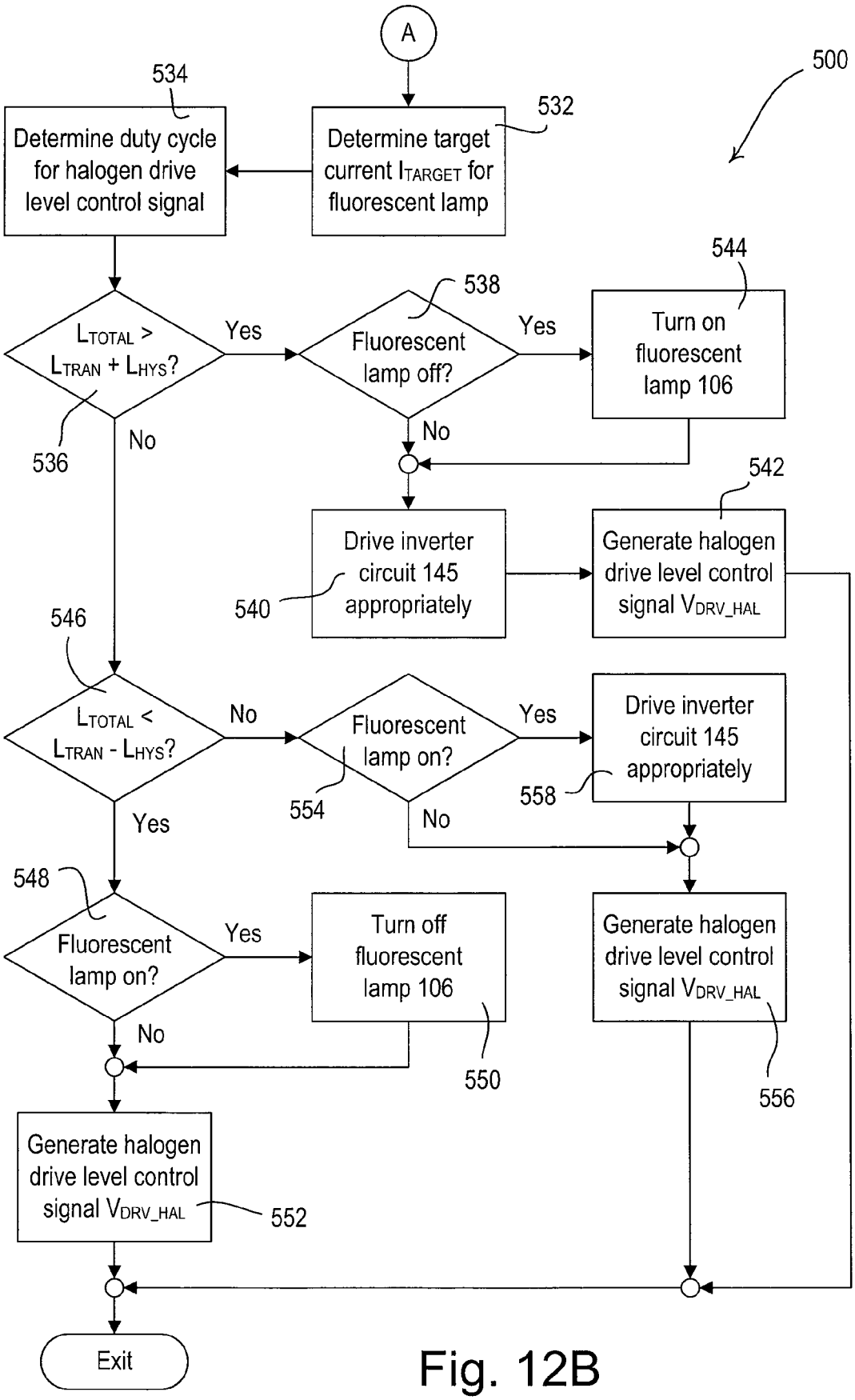

FIGS. 12A and 12B are simplified flowcharts of a target light intensity procedure 500 executed periodically by the control circuit 160, e.g., once every half-cycle of the AC power source 102. The primary function of the target light intensity procedure 500 is to measure the conduction period $T_{CON}$ of the phase-controlled voltage $V_{PC}$ generated by the dimmer switch 104 and to appropriately control the fluorescent lamp 106 and the halogen lamp 108 to achieve the target total light intensity $L_{TOTAL}$ of the hybrid light source 100 (e.g., as defined by the plot shown in FIG. 4B). The control circuit 160 uses a timer, which is continuously running, to measure the times between the rising and falling edges of the zero-crossing control signal $V_{ZC}$, and to calculate the difference between the times of the falling and rising edges to determine the conduction period $T_{CON}$ of the phase-controlled voltage $V_{PC}$.

The target light intensity procedure 500 begins at step 510 in response to a rising edge of the zero-crossing control signal $V_{ZC}$, which signals that the phase-controlled voltage $V_{PC}$ has risen above the zero-crossing threshold $V_{TH\text{-}ZC}$ of the zero-crossing detect circuit 162. The present value of the timer is immediately stored in a register A at step 512. The control circuit 160 waits for a falling edge of the zero-crossing signal $V_{ZC}$ at step 514 or for a timeout to expire at step 515. For example, the timeout may be the length of a half-cycle, i.e., approximately 8.33 msec if the AC power source operates at 60 Hz. If the timeout expires at step 515 before the control circuit 160 detects a rising edge of the zero-crossing signal $V_{ZC}$ at step 514, the target light intensity procedure 500 simply exits. When a rising edge of the zero-crossing control signal $V_{ZC}$ is detected at step 514 before the timeout expires at step 515, the control circuit 160 stores the present value of the timer in a register B at step 516. At step 518, the control circuit 160 determines the length of the conduction interval $T_{CON}$ by subtracting the timer value stored in register A from the timer value stored in register B.

Next, the control circuit 160 ensures that the measured conduction interval $T_{CON}$ is within predetermined limits. Specifically, if the conduction interval $T_{CON}$ is greater than a maximum conduction interval $T_{MAX}$ at step 520, the control circuit 160 sets the conduction interval $T_{CON}$ equal to the maximum conduction interval $T_{MAX}$ at step 522. If the conduction interval $T_{CON}$ is less than a minimum conduction interval $T_{MIN}$ at step 524, the control circuit 160 sets the conduction interval $T_{CON}$ equal to the minimum conduction interval $T_{MIN}$ at step 526.

At step 528, the control circuit 160 calculates a continuous average $T_{AVG}$ in response to the measured conduction interval $T_{CON}$. For example, the control circuit 160 may calculate an N:1 continuous average $T_{AVG}$ using the following equation:

$$T_{AVG}=(N\cdot T_{AVG}+T_{CON})/(N+1). \quad \text{(Equation 1)}$$

For example, N may equal 31, such that N+1 equals 32, which allows for easy processing of the division calculation by the control circuit 160. At step 530, the control circuit 160 determines the target total light intensity $L_{TOTAL}$ in response to the continuous average $T_{AVG}$ calculated at step 528, for example, by using a lookup table.

Next, the control circuit 160 appropriately controls the high-efficiency light source circuit 140 and the low-efficiency light source circuit 150 to produce the desired total light intensity $L_{TOTAL}$ of the hybrid light source 100 (i.e., as defined by the plot shown in FIG. 4B). While not shown in FIG. 4B, the control circuit 160 controls the desired total light intensity $L_{TOTAL}$ using some hysteresis around the transition intensity $L_{TRAN}$. Specifically, when the desired total light intensity $L_{TOTAL}$ drops below an intensity equal to the transition intensity $L_{TRAN}$ minus a hysteresis offset $L_{HYS}$, the fluorescent lamp 106 is turned off and only the halogen lamp 108 is controlled. The desired total light intensity $L_{TOTAL}$ must then rise above an intensity equal to the transition intensity $L_{TRAN}$ plus the hysteresis offset $L_{HYS}$ for the control circuit 160 to turn on the fluorescent lamp 106.

Referring to FIG. 12B, the control circuit 160 determines the target lamp current $I_{TARGET}$ for the fluorescent lamp 106 at step 532 and the appropriate duty cycle for the halogen lamp drive level control signal $V_{DRV_HAL}$ at step 534, which will cause the hybrid light source 100 to produce the target total light intensity $L_{TOTAL}$. If the target total light intensity $L_{TOTAL}$ is greater than the transition intensity $L_{TRAN}$ plus the hysteresis offset $L_{HYS}$ at step 536 and the fluorescent lamp 106 is on at step 538, the control circuit 160 drives the inverter circuit 145 appropriately at step 540 to achieve the desired lamp current $I_{TARGET}$ and generates the halogen lamp drive level control signal $V_{DRV_HAL}$ with the appropriate duty cycle at step 542. If the fluorescent lamp 106 is off at step 538 (i.e., the target total light intensity $L_{TOTAL}$ has just transitioned above the transition intensity $L_{TRAN}$), the control circuit 160 turns the fluorescent lamp 106 on by preheating and striking the lamp at step 544 before driving the inverter circuit 145 at step 540 and generating the halogen lamp drive level control signal $V_{DRV_HAL}$ at step 542. After appropriately controlling the fluorescent lamp 106 and the halogen lamp 108, the target light intensity procedure 500 exits.

If the target total light intensity $L_{TOTAL}$ is not greater than the transition intensity $L_{TRAN}$ plus the hysteresis offset $L_{HYS}$ at step 536, but is less than the transition intensity $L_{TRAN}$ minus the hysteresis offset $L_{HYS}$ at step 546, the control circuit 160 turns of the fluorescent lamp 106 and only controls the target halogen intensity of the halogen lamp 108. Specifically, if the fluorescent lamp 106 is on at step 548, the control circuit 160 turns the fluorescent lamp 106 off at step 550. The control circuit 160 generates the halogen lamp drive level control signal $V_{DRV_HAL}$ with the appropriate duty cycle at step 552, such that the halogen lamp 108 provides all of the target total light intensity $L_{TOTAL}$ and the target light intensity procedure 500 exits.

If the target total light intensity $L_{TOTAL}$ is not greater than the transition intensity $L_{TRAN}$ plus the hysteresis offset $L_{HYS}$ at step 536, but is not less than the transition intensity $L_{TRAN}$ minus the hysteresis offset $L_{HYS}$ at step 546, the control circuit 160 is in the hysteresis range. Therefore, if the fluorescent lamp 106 is not on at step 554, the control circuit 160 simply generates the halogen lamp drive level control signal $V_{DRV_HAL}$ with the appropriate duty cycle at step 556 and the target light intensity procedure 500 exits. However, if the fluorescent lamp 106 is on at step 554, the control circuit 160 drives the inverter circuit 145 appropriately at step 558 and generates the halogen lamp drive level control signal $V_{DRV_HAL}$ with the appropriate duty cycle at step 556 before the target light intensity procedure 500 exits.

Figure 13A:
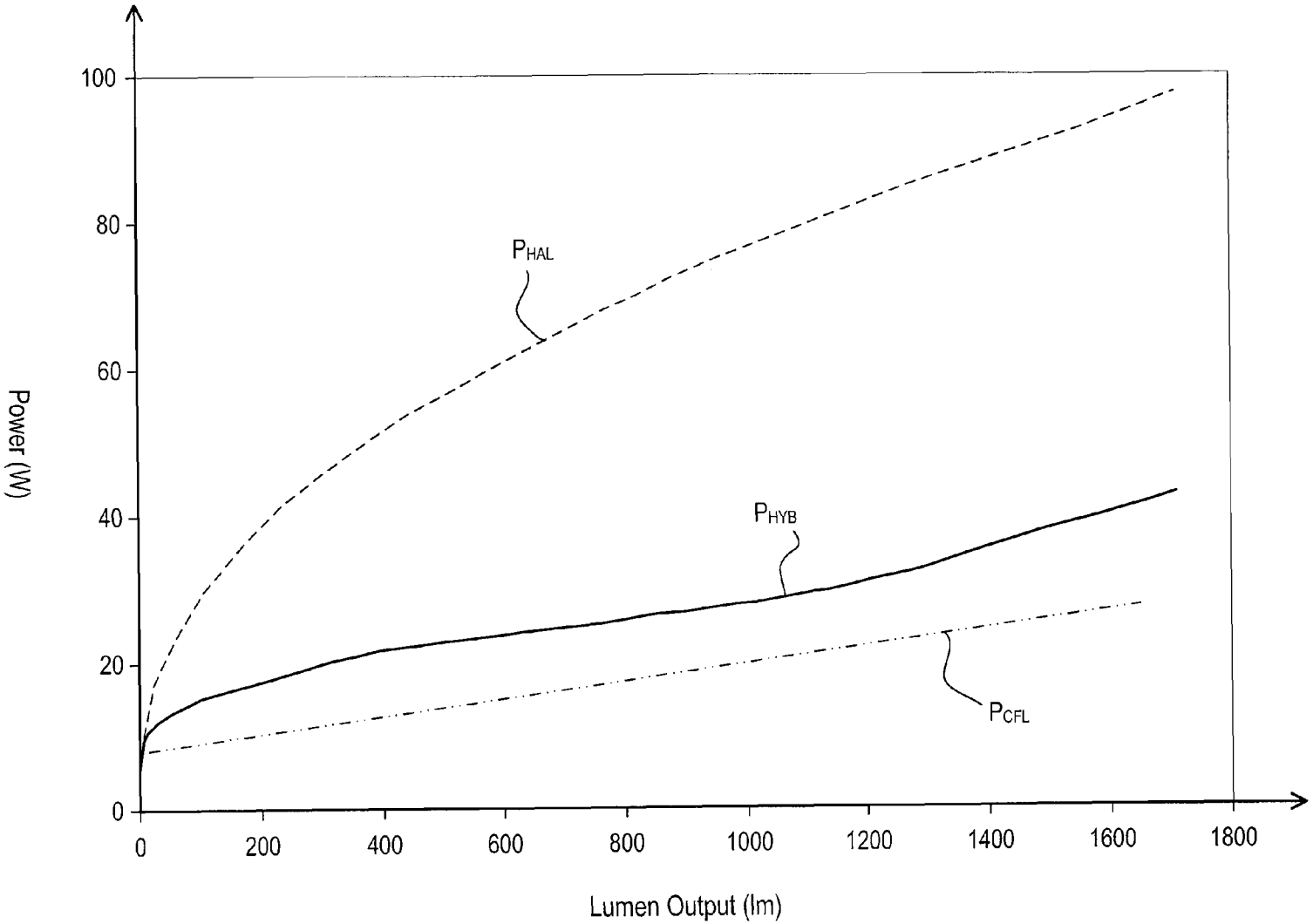
FIG. 13A is a simplified graph showing a monotonic power consumption $P_{HYB}$ of the hybrid light source of FIG. 3A according to a second embodiment of the present invention.
Figure 13B:
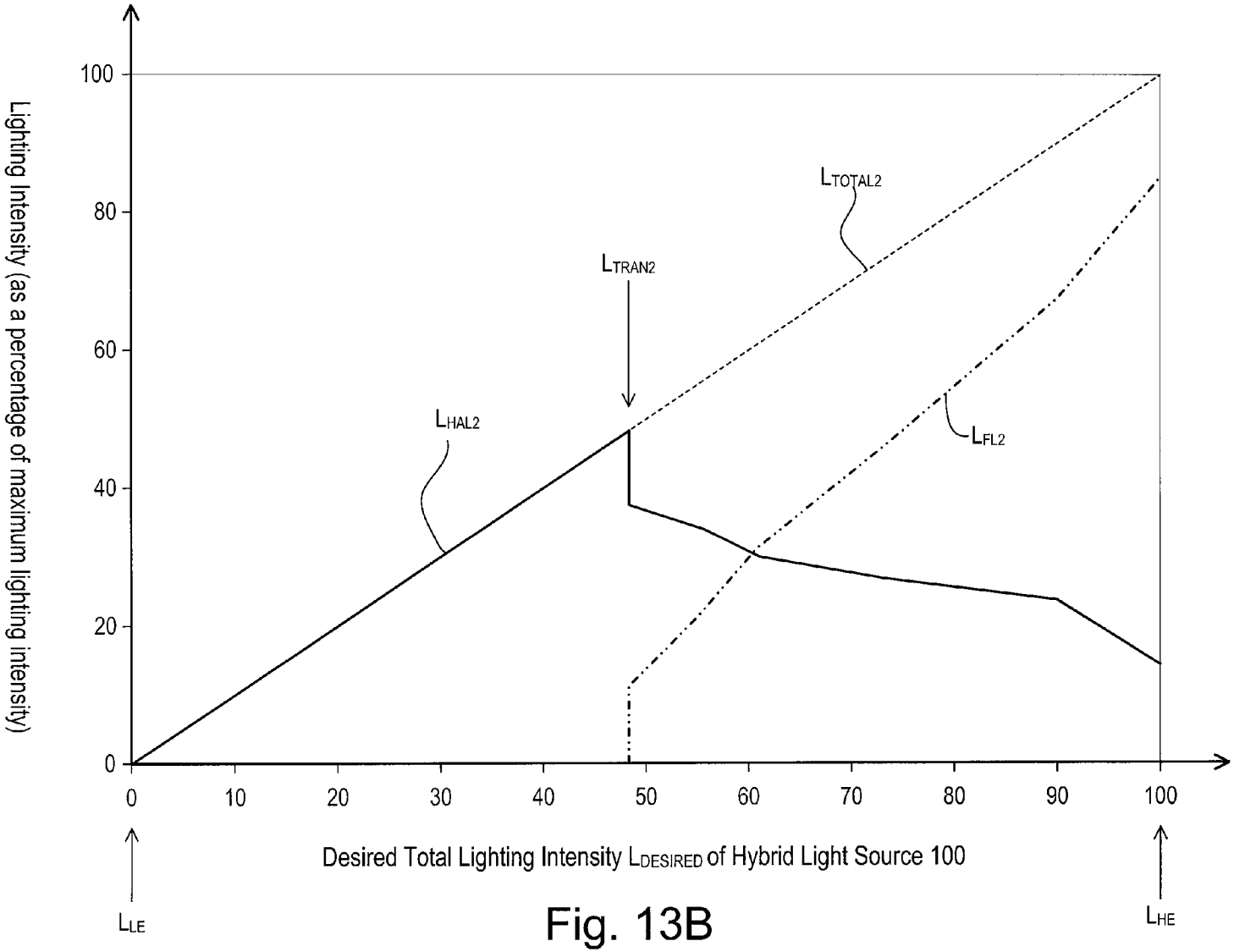
FIG. 13B is a simplified graph showing a target fluorescent lamp lighting intensity, a target halogen lamp lighting intensity, and a total lighting intensity of the hybrid light source to achieve the monotonic power consumption shown in FIG. 13A.

FIG. 13A is a simplified graph showing an example curve of a monotonic power consumption $P_{HYB}$ with respect to the lumen output of the hybrid light source 100 according to a second embodiment of the present invention. FIG. 13A also shows example curves of a power consumption $P_{CFL}$ of a prior art 26-Watt compact fluorescent lamp and a power consumption $P_{INC}$ of a prior art 100-Watt incandescent lamp with respect to the lumen output of the hybrid light source 100. FIG. 13B is a simplified graph showing a target fluorescent lamp lighting intensity $L_{FL2}$, a target halogen lamp lighting intensity $L_{HAL2}$, and a total light intensity $L_{TOTAL2}$ of the hybrid light source 100 (plotted with respect to the desired total lighting intensity $L_{DESIRED}$) to achieve the monotonic power consumption shown in FIG. 13A. The fluorescent lamp 106 is turned off below a transition intensity $L_{TRAN2}$, e.g., approximately 48%. As the desired lighting intensity $L_{DESIRED}$ is decreased from the high-end intensity $L_{HE}$ to the low-end intensity $L_{LE}$, the power consumption of the hybrid light source 100 consistently decreases and never increases. In other words, if a user controls the dimmer switch 104 to decrease the total light intensity $L_{TOTAL}$ of the hybrid light source 100 at any point along the dimming range, the hybrid light source consumes a corresponding reduced power.

Figure 14:
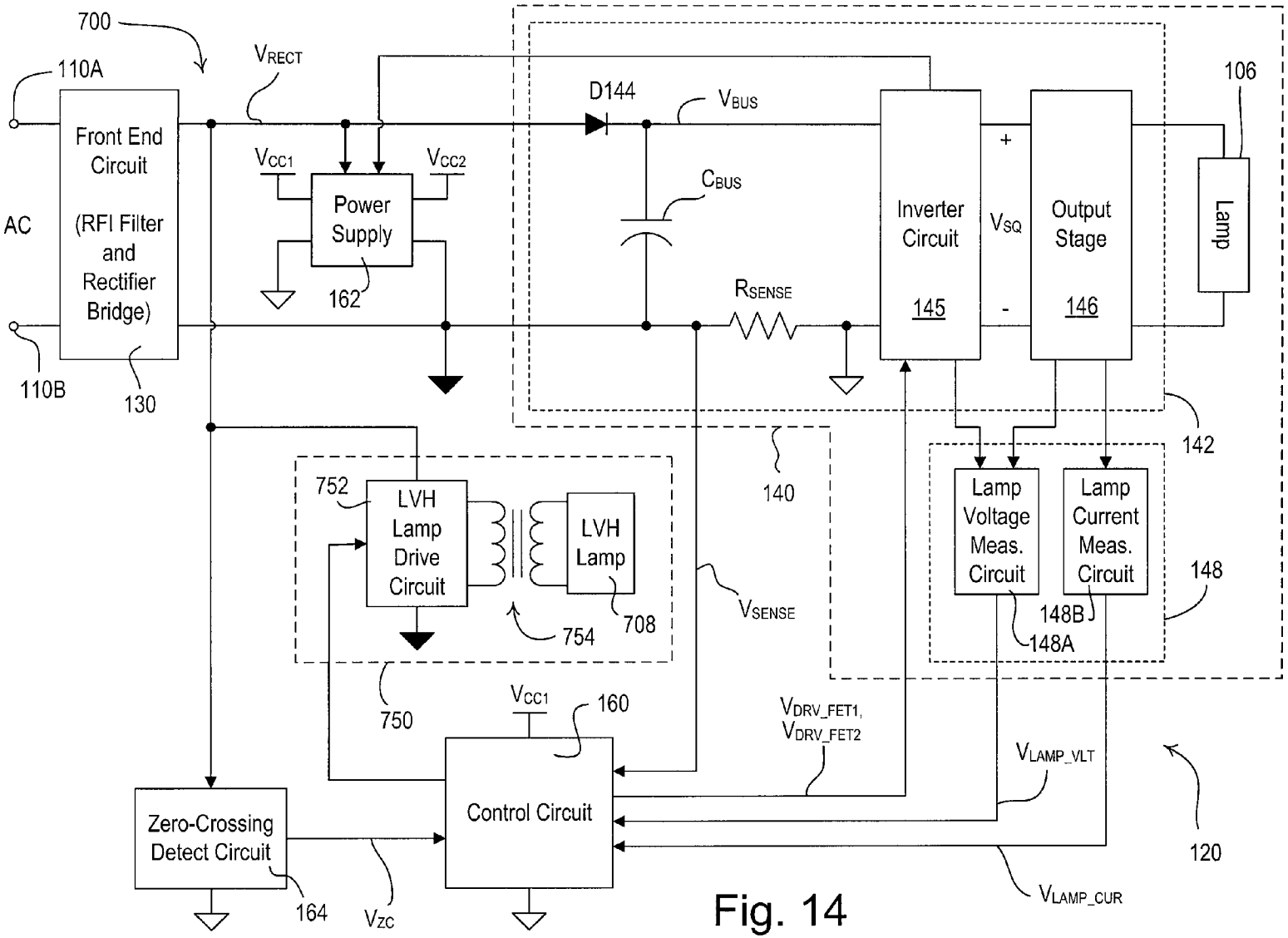
FIG. 14 is a simplified block diagram of a hybrid light source comprising a continuous-spectrum light source circuit having a low-voltage halogen lamp according to a third embodiment of the present invention.

FIG. 14 is a simplified block diagram of a hybrid light source 700 according to a third embodiment of the present invention. The hybrid light source 700 comprises a low-efficiency light source circuit 750 having a low-voltage halogen (LVH) lamp 708 (e.g., powered by a voltage having a magnitude ranging from approximately 12 volts to 24 volts). The low-efficiency light source circuit 750 further comprises a low-voltage halogen drive circuit 752 and a low-voltage transformer 754 coupled between the low-voltage halogen lamp 708 and the low-voltage halogen drive circuit 752. The low-voltage halogen drive circuit 752 and the low-voltage transformer 754 are described in greater detail below with reference to FIGS. 18-20. The hybrid light source 700 provides the same improvements over the prior art as the hybrid light source 100 of the first embodiment. In addition, as compared to the line-voltage halogen lamp 108 of the first embodiment, the low-voltage halogen lamp 708 is generally characterized by a longer lifetime, has a smaller form factor, and provides a smaller point source of illumination to allow for improved photometrics.

Figure 15:
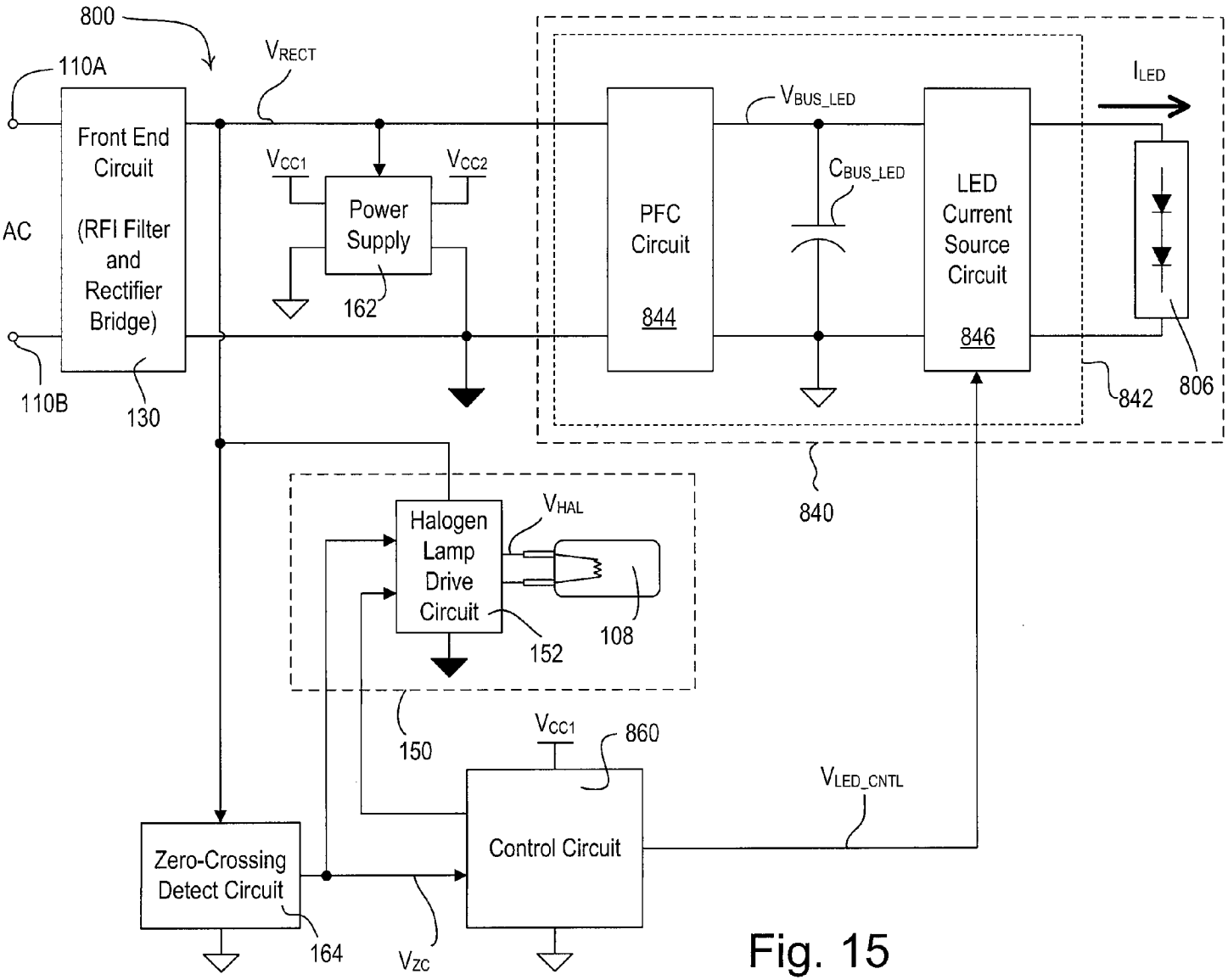
FIG. 15 is a simplified block diagram of a hybrid light source comprising a discrete-spectrum light source circuit having a LED light source according to a fourth embodiment of the present invention.

FIG. 15 is a simplified block diagram of a hybrid light source 800 according to a fourth embodiment of the present invention. The hybrid light source 800 comprises a high-efficiency light source circuit 840 having a solid-state light source, such as an LED light source 806, and a solid-state light source drive circuit, such as an LED drive circuit 842. The LED light source 806 provides a relatively constant correlated color temperature across the dimming range of the LED light source 806 (similar to the fluorescent lamp 106). The LED drive circuit 842 comprises a power factor correction (PFC) circuit 844, an LED current source circuit 846, and a control circuit 860. The PFC circuit 844 receives the rectified voltage $V_{RECT}$ and generates a DC bus voltage $V_{BUS_LED}$ (e.g., approximately 40 $V_{DC}$) across a bus capacitor $C_{BUS_LED}$. The PFC circuit 844 comprises an active circuit that operates to adjust the power factor of the hybrid light source 800 towards a power factor of one. The LED current source circuit 846 receives the bus voltage $V_{BUS_LED}$ and regulates an LED output current $I_{LED}$ conducted through the LED light source 806 to thus control the intensity of the LED light source. The control circuit 860 provides an LED control signal $V_{LED_CNTL}$ to the LED current source circuit 842, which controls the light intensity of the LED light source 806 in response to the LED control signal $V_{LED_CNTL}$ by controlling the frequency and the duty cycle of the LED output current $I_{LED}$. For example, the LED current source circuit 846 may comprise a LED driver integrated circuit (not shown), for example, part number MAX16831, manufactured by Maxim Integrated Products.

Figure 16:
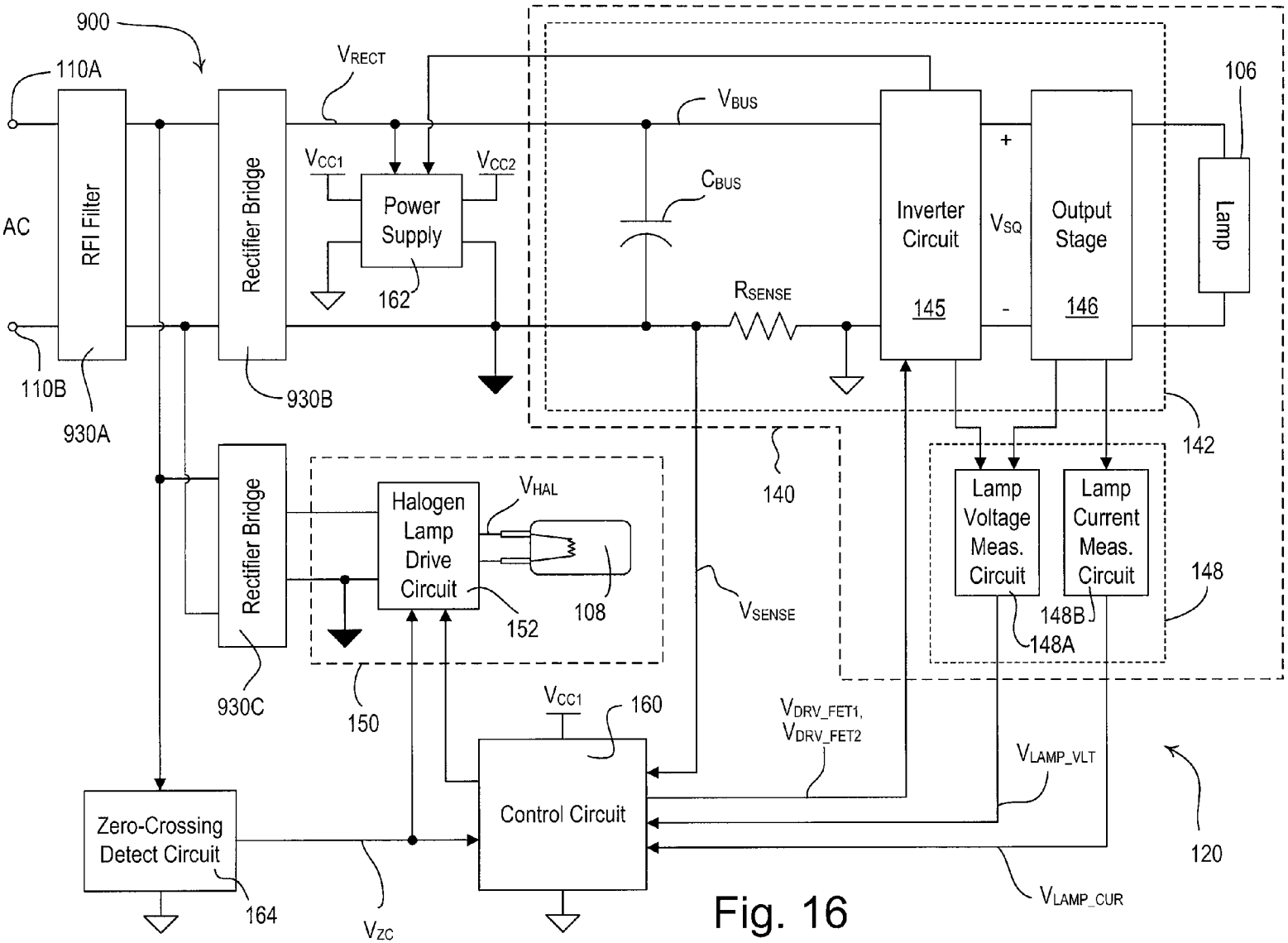
FIG. 16 is a simplified block diagram of a hybrid light source having two rectifiers according to a fifth embodiment of the present invention.

FIG. 16 is a simplified block diagram of a hybrid light source 900 according to a fifth embodiment of the present invention. The hybrid light source 900 includes an RFI filter 930A for minimizing the noise provided to the AC power source 102 and two full-wave rectifiers 930B, 930C, which both receive the phase-controlled voltage $V_{PC}$ through the RFI filter. The first rectifier 930B generates a first rectified voltage $V_{RECT1}$, which is provided to the high-efficiency light source circuit 140 for illuminating the fluorescent lamp 106. The second rectifier 930C generates a second rectified voltage $V_{RECT2}$, which is provided to the low-efficiency light source circuit 150 for illuminating the halogen lamp 108.

Figure 17:
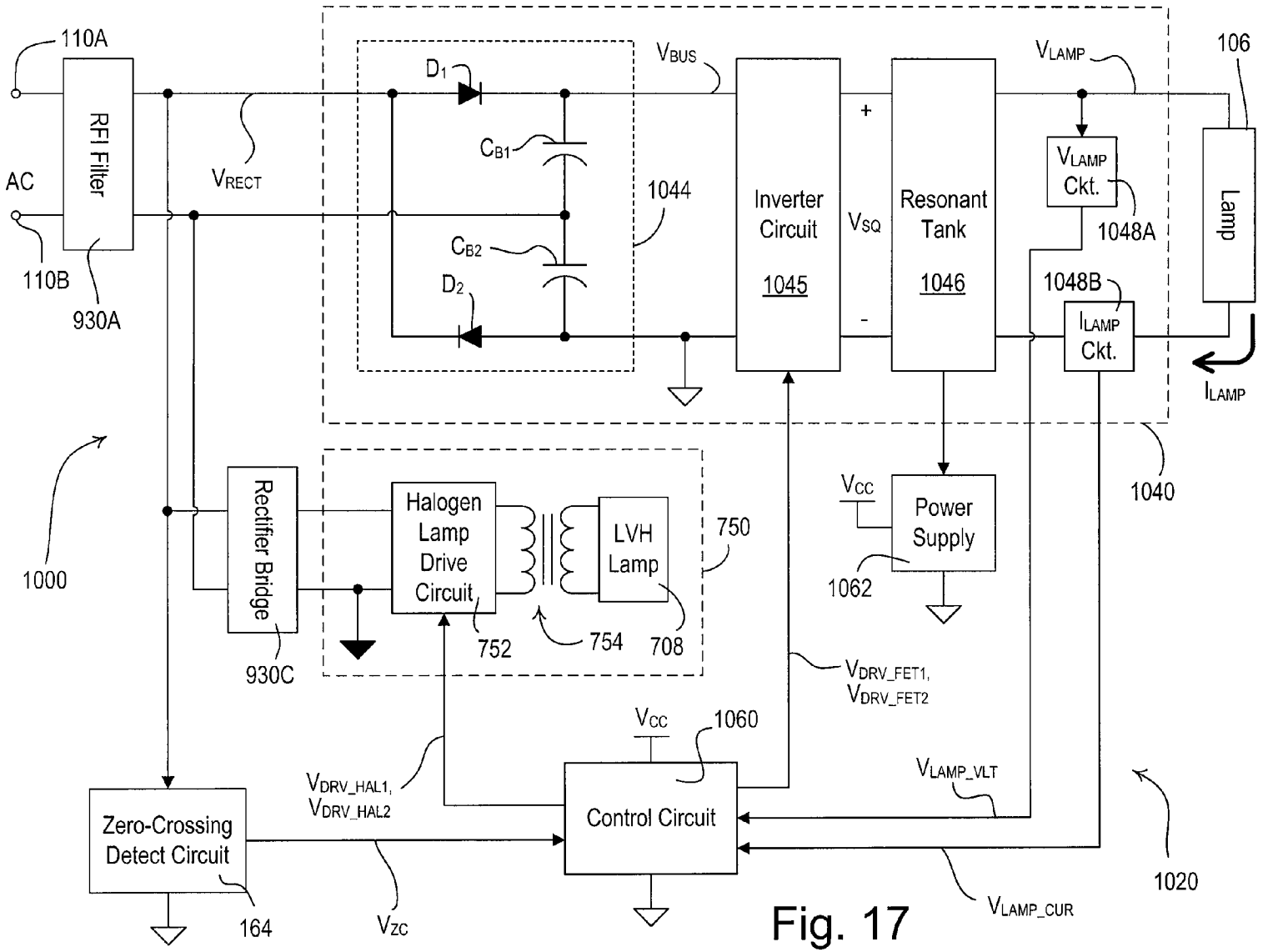
FIG. 17 is a simplified block diagram of a hybrid light source according to a sixth embodiment of the present invention.

FIG. 17 is a simplified block diagram of a hybrid light source 1000 comprising a hybrid light source electrical circuit 1020 according to a sixth embodiment of the present invention. The hybrid light source 1000 comprises a high-efficiency light source circuit 1040 (i.e., a discrete-spectrum light source circuit) for illuminating the fluorescent lamp 106. As shown in FIG. 17, the low-efficiency light source circuit 750 includes the low-voltage halogen lamp 708, as well as the low-voltage halogen drive circuit 752 and the low-voltage transformer 754 for driving the low-voltage halogen lamp (as in the third embodiment of the present invention shown in FIG. 14). A control circuit 1060 simultaneously controls the operation of the high-efficiency light source circuit 1040 and the low-efficiency light source circuit 750 to thus control the amount of power delivered to the fluorescent lamp 106 and the halogen lamp 108.

The high-efficiency light source circuit 1040 comprises a fluorescent drive circuit including a voltage doubler circuit 1044, an inverter circuit 1045, and a resonant tank circuit 1046. The voltage doubler circuit 1044 receives the phase-controlled voltage $V_{PC}$ and generates the bus voltage $V_{BUS}$ across two series-connected bus capacitors $C_{B1}$, $C_{B2}$. The first bus capacitor $C_{B1}$ is operable to charge through a first diode $D_1$ during the positive half-cycles, while the second bus capacitor $C_{B2}$ is operable to charge through a second diode $D_2$ during the negative half-cycles. The inverter circuit 1045 converts the DC bus voltage $V_{BUS}$ to a high-frequency square-wave voltage $V_{SQ}$. The inverter circuit 1045 may comprise a standard inverter circuit, for example, comprising a first FET (not shown) for pulling the high-frequency square-wave voltage $V_{SQ}$ up towards the bus voltage $V_{BUS}$ and second FET (not shown) for pulling the high-frequency square-wave voltage $V_{SQ}$ down towards circuit common. The control circuit 1060 supplies the FET drive signals $V_{DRV_FET1}$ and $V_{DRV_FET2}$ for driving the two FETs of the inverter circuit 1045.

The resonant tank circuit 1046 filters the square-wave voltage $V_{SQ}$ to produce a substantially-sinusoidal high-frequency AC voltage $V_{SIN}$, which is coupled to the electrodes of the fluorescent lamp 106. The high-efficiency lamp source circuit 1040 further comprises a lamp voltage measurement circuit 1048A (which provides a lamp voltage control signal $V_{LAMP_VLT}$ representative of a magnitude of a lamp voltage $V_{LAMP}$ to the control circuit 1060), and a lamp current measurement circuit 1048B (which provides a lamp current control signal $V_{LAMP_CUR}$ representative of a magnitude of a lamp current $I_{LAMP}$ to the control circuit). The hybrid light source 1000 further comprises a power supply 1062 for generating a direct-current (DC) supply voltage $V_{CC}$ (e.g., approximately 5 $V_{DC}$) for powering the control circuit 1060. For example, the power supply 1062 may be magnetically coupled to a resonant inductor (not shown) of the resonant tank for generating the DC supply voltage $V_{CC}$.

Figure 18:
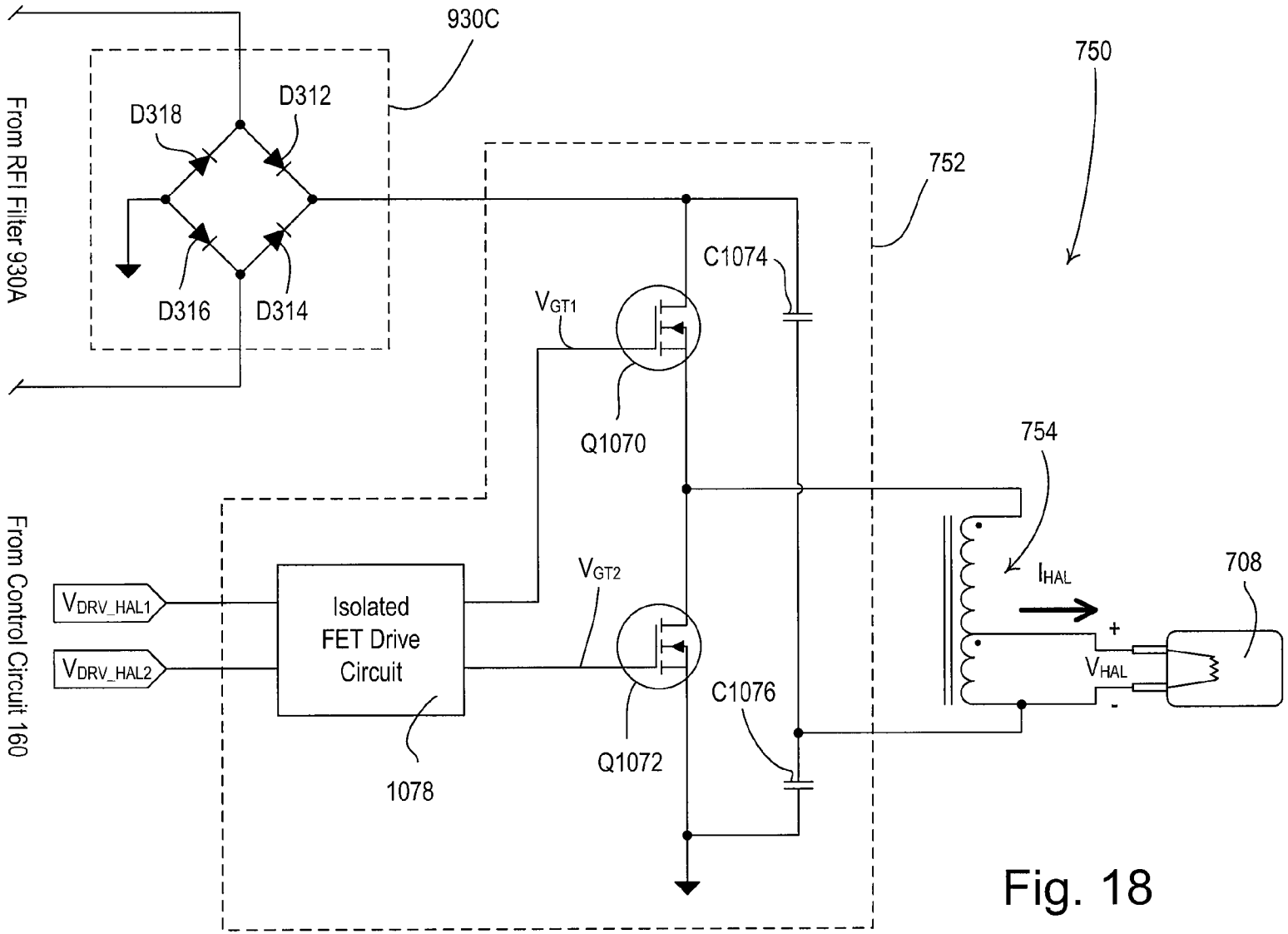
FIG. 18 is a simplified schematic diagram of a full-wave rectifier and a low-efficiency light source circuit of the hybrid light source of FIG. 17.

FIG. 18 is a simplified schematic diagram of the full-wave rectifier 930C and the low-efficiency light source circuit 750. The low-efficiency light source circuit 750 comprises two FETs Q1070, Q1072, which are coupled in series across the output (i.e., the DC terminals) of the full-wave rectifier 930C so as to control the flow of the halogen current $I_{HAL}$ through the halogen lamp 708. The low-efficiency light source circuit 750 further comprises two capacitors C1074, C1076, which are also coupled in series across the DC terminals of the full-wave rectifier 930C. The low-voltage transformer 754 comprises an autotransformer, having a primary winding coupled between the junction of the two FETs Q1070, Q1072 and the junction of the two capacitors C1074, C1076, and a secondary winding coupled across the low-voltage halogen lamp 708. The capacitors C1074, C1076 both have, for example, capacitances of approximately 0.15 μF, such that a voltage having a magnitude of approximately one-half of the peak voltage $V_{PEAK}$ of the AC power source 102 is generated across each of the capacitors.

Figure 19:
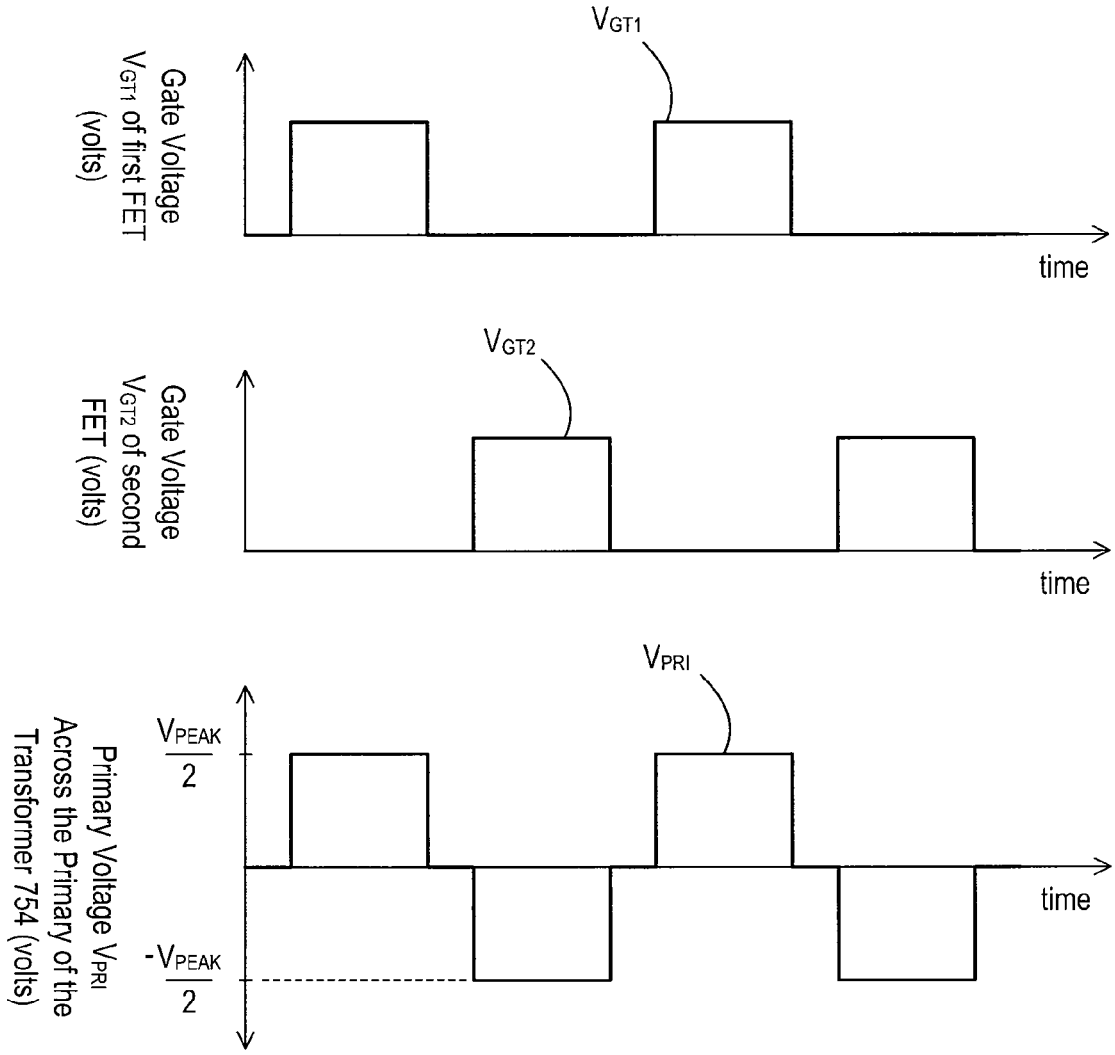
FIGS. 19 and 20 are simplified diagrams showing waveforms illustrating the operation of the low-efficiency light source circuit of FIG. 18.

FIG. 19 is a simplified diagram showing waveforms illustrating the operation of the low-efficiency light source circuit 750. The control circuit 1060 provides halogen drive control signals $V_{DRV_HAL1}$, $V_{DRV_HAL2}$ to the low-efficiency light source circuit 750 for selectively rendering the FETs Q1070, Q1072 conductive in order to conduct the halogen current $I_{HAL}$ through the secondary winding of the transformer 754 and thus the halogen lamp 708. Since the low-efficiency light source circuit 750 is referenced to a different circuit common than the control circuit 1060, the low-efficiency light source circuit comprises an isolated FET drive circuit 1078 for driving the FETs Q1070, Q1072 in response to the halogen drive control signals $V_{DRV_HAL1}$, $V_{DRV_HAL2}$ received from the control circuit. Specifically, the isolated FET drive circuit 1078 provides gate voltages $V_{GT1}$, $V_{GT2}$ to the gates of the FETs Q1070, Q1072, respectively. The gate voltages $V_{GT1}$, $V_{GT2}$ are both characterized by a frequency $f_{HAL}$ (e.g., approximately 30 kHz) and a duty cycle $DC_{HAL}$, which is the same for both of the gate voltages as shown in FIG. 19. The gate voltages $V_{GT1}$, $V_{GT2}$ are 180° out of phase with each other, such that the FETs Q1070, Q1072 are not rendered conductive at the same time (i.e., the duty cycles must be less than 50%).

When the first FET Q1070 is rendered conductive, the first capacitor C1074 is coupled in parallel with the primary winding of the transformer 754, such that a positive voltage having a magnitude equal to approximately one-half of the peak voltage $V_{PEAK}$ of the AC power source 102 is coupled across the primary winding of the transformer. When the second FET Q1072 is rendered conductive, the second capacitor C1076 is coupled in parallel with the primary winding of the transformer 754, such that a negative voltage having a magnitude equal to approximately one-half of the peak voltage $V_{PEAK}$ of the AC power source 102 is coupled across the primary winding of the transformer. Accordingly, a primary voltage $V_{PRI}$ (as shown in FIG. 19) is generated across the primary winding of the transformer 754, thus causing the halogen current to flow through the secondary winding and the halogen lamp 708. The control circuit 1060 increases the duty cycle $DC_{HAL}$ of the gate voltage $V_{GT1}$, $V_{GT2}$ provided to the FETs Q1070, Q1072 as target halogen lighting intensity $L_{HAL}$ of the halogen lamp 708 increases, and decreases the duty cycle $DC_{HAL}$ as target halogen lighting intensity $L_{HAL}$ decreases.

Figure 20:
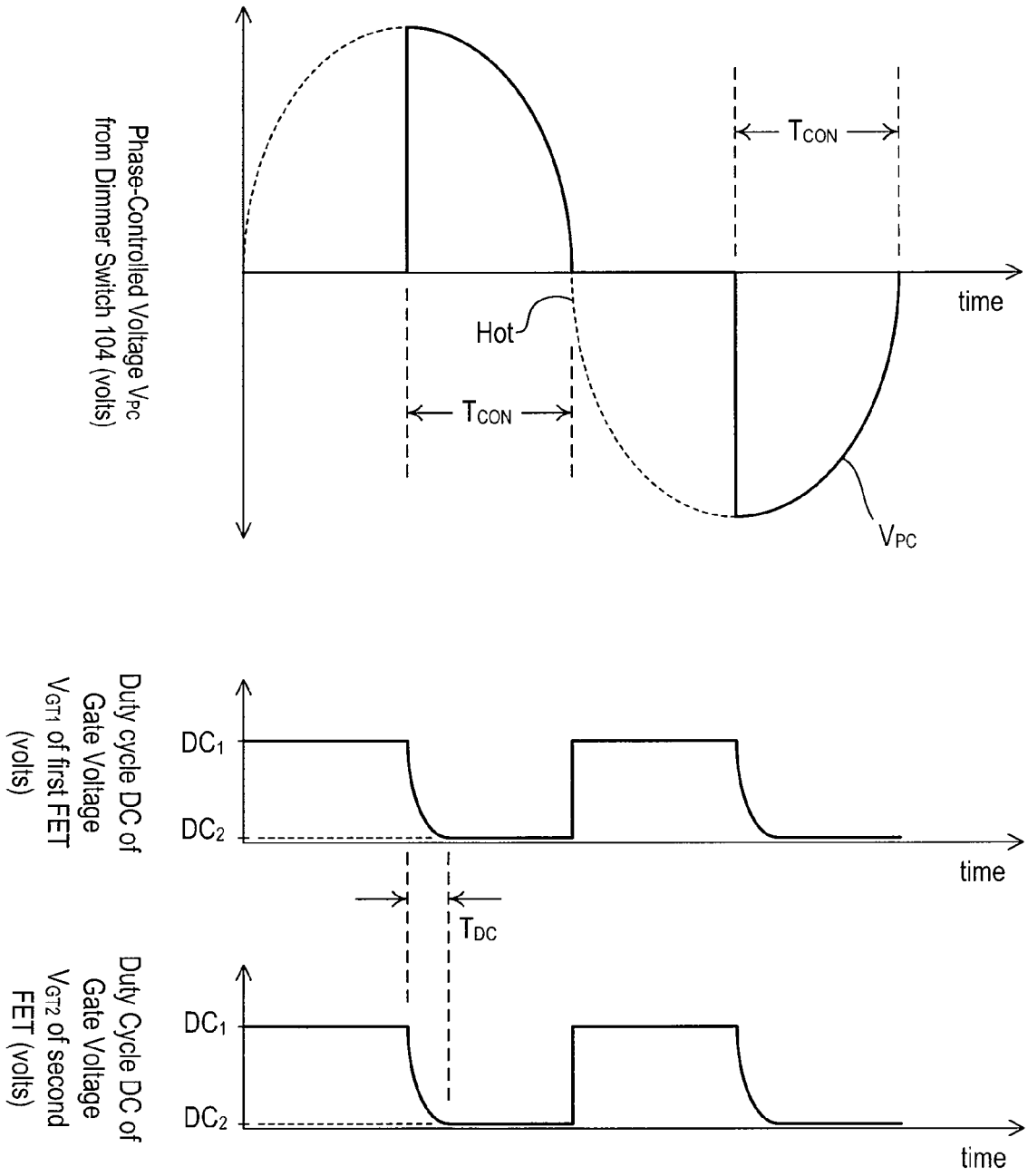

The control circuit 1060 controls the duty cycle $DC_{HAL}$ of the gate voltage $V_{GT1}$, $V_{GT2}$ provided to the FETs Q1070, Q1072 during each half-cycle in order to ensure that the halogen lamp 708 is operable to conduct the appropriate currents that the connected dimmer switch 104 needs to conduct. FIG. 20 is a simplified diagram of an example of the duty cycles DC of the gate voltage $V_{GT1}$, $V_{GT2}$ provided to the FETs Q1070, Q1072 during two half-cycles. When the bidirectional semiconductor switch 105B is non-conductive (at the beginning of each half-cycle), the control circuit 1060 drives the FETs Q1070, Q1072, such that the low-efficiency light source circuit 750 is operable to conduct the charging current of the power supply 105D of the dimmer switch 104. Specifically, the control circuit 1060 controls the duty cycle of the FETs Q1070, Q1072 to a first duty cycle $DC_1$ (e.g., approximately 45-50%), such that the low-efficiency light source circuit 750 is able to conduct the charging current when the bidirectional semiconductor switch 105B is non-conductive as shown in FIG. 20. Since the phase-controlled voltage $V_{PC}$ across the hybrid light source 1000 (and thus across the halogen lamp 708) is approximately zero volts when the bidirectional semiconductor switch 105B is non-conductive and the power supply 105D is conducting the charging current, the halogen lamp 708 will not dissipate much power at this time.

After the bidirectional semiconductor switch 105B of dimmer switch 104 is rendered conductive each half-cycle, the control circuit 1060 is operable to drive the FETs Q1070, Q1072, such that the low-efficiency light source circuit 750 provides a path for enough current to flow from the AC power source 102 through the hybrid light source 1000 to ensure that the magnitude of the current through the bidirectional semiconductor switch exceeds the rated holding current of the bidirectional semiconductor switch (i.e., when the bidirectional semiconductor switch is a thyristor). Specifically, the control circuit 1060 controls the duty cycle of the FETs Q1070, Q1072 to a second duty cycle $DC_2$ (e.g., a minimum duty cycle of approximately 7-8%, which is close to the duty cycle of 0%) as shown in FIG. 20. Because the second duty cycle $DC_2$ is small, the halogen lamp 708 does not consume a great amount of power after the bidirectional semiconductor switch 105B is rendered conductive. However, the resulting current conducted through the primary winding of the transformer 754 of the low-efficiency light source circuit 750 and through the bidirectional semiconductor switch 105B is great enough to exceed the rated holding current of the bidirectional semiconductor switch to keep the bidirectional semiconductor switch latched.

In addition, the control circuit 1060 drives the FETs Q1070, Q1072, such that when the bidirectional semiconductor switch 105B of dimmer switch 104 is rendered conductive each half-cycle, the low-efficiency light source circuit 750 is operable to provide a path for enough current to flow from the AC power source 102 through the hybrid light source 1000 to ensure that the magnitude of the current through the bidirectional semiconductor switch exceeds the rated latching current of the bidirectional semiconductor switch. Specifically, control circuit 1060 controls the duty cycle $DC_{HAL}$ from the first duty cycle $DC_1$ to the second duty cycle $DC_2$ over a period of time $T_{DC}$ (e.g., approximately 2 msec) after the bidirectional semiconductor switch 105B of dimmer switch 104 is rendered conductive as shown in FIG. 20. This gradual rate of change of the duty cycle $DC_{HAL}$ (rather than a step change in the duty cycle) prevents the current through the bidirectional semiconductor switch 105B from ringing (i.e., oscillating). For example, the RFI filter 930A could cause the current through the bidirectional semiconductor switch 105B to ring (such that the current through the bidirectional semiconductor switch falls below the rated latching current before the bidirectional semiconductor switch latches) in response to a step change in the duty cycle $DC_{HAL}$. The gradual rate of change of the duty cycle $DC_{HAL}$ prevents ringing and enables the low-efficiency light source circuit 750 to conduct current through the bidirectional semiconductor switch 105B, such that the rated latching current and the rated holding current of the bidirectional semiconductor switch 105B are exceeded after the bidirectional semiconductor switch is rendered conductive.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dimmable hybrid light source adapted to receive a phase-controlled voltage, the hybrid light source comprising:

a discrete-spectrum light source circuit comprising a discrete-spectrum lamp;

a continuous-spectrum light source circuit comprising a continuous-spectrum lamp operable to conduct a continuous-spectrum lamp current;

a zero-crossing detect circuit for detecting when the magnitude of the phase-controlled voltage becomes greater than a predetermined zero-crossing threshold voltage each half-cycle of the phase-controlled voltage; and a control circuit coupled to both the discrete-spectrum light source circuit and the continuous-spectrum light source circuit for individually controlling the amount of power delivered to each of the discrete-spectrum lamp and the continuous-spectrum lamp in response to the zero-crossing detect circuit, such that a total light output of the hybrid light source ranges from a minimum total intensity to a maximum total intensity, the control circuit operable to control the discrete-spectrum lamp when the total light intensity is below a transition intensity, such that the percentage of the total light intensity produced by the continuous-spectrum lamp is greater than the percentage of the total light intensity produced by the discrete-spectrum lamp when the total light intensity is below the transition intensity;

wherein the control circuit controls the amount of power delivered to the continuous-spectrum lamp to be greater than or equal to a minimum power level after the magnitude of the phase-controlled voltage becomes greater than the predetermined zero-crossing threshold voltage each half-cycle of the phase-controlled voltage when the total light intensity is above the transition intensity.

2. The hybrid light source of claim 1, wherein the continuous-spectrum light source circuit comprises at least one semiconductor switch coupled so as to control the flow of the continuous-spectrum lamp current through the continuous-spectrum lamp.

3. The hybrid light source of claim 2, wherein the control circuit controls the continuous-spectrum light source circuit to drive the semiconductor switch to be conductive and non-conductive with a duty cycle, the control circuit adjusting the duty cycle of the continuous-spectrum light source circuit to a minimum duty cycle such that the continuous-spectrum lamp conducts the continuous-spectrum lamp current after the magnitude of the phase-controlled voltage becomes greater than the predetermined zero-crossing threshold voltage each half-cycle of the phase-controlled voltage.

4. The hybrid light source of claim 3, wherein the control circuit adjusts the duty cycle of the continuous-spectrum light source circuit to a second duty cycle greater than the minimum duty cycle such that the continuous-spectrum lamp conducts the continuous-spectrum lamp current before the magnitude of the phase-controlled voltage becomes greater than the predetermined zero-crossing threshold voltage each half-cycle of the phase-controlled voltage.

5. The hybrid light source of claim 4, wherein the control circuit adjusts the duty cycle of the continuous-spectrum light source circuit to from the second duty cycle to the minimum duty cycle across a period of time when the zero-crossing detect circuit detects that the magnitude of the phase-controlled voltage has become greater than the predetermined zero-crossing threshold voltage.

6. The hybrid light source of claim 3, wherein the continuous-spectrum lamp comprises a low-voltage halogen lamp and the continuous-spectrum light source drive circuit comprises a low-voltage halogen drive circuit and a low-voltage transformer.

7. The hybrid light source of claim 2, further comprising:

two input terminals adapted to receive the phase-controlled voltage;

a voltage doubler circuit coupled between the input terminals and generating a bus voltage at an output, the discrete-spectrum light source circuit coupled to the output of the voltage doubler circuit for receiving the bus voltage.

8. The hybrid light source of claim 7, wherein the discrete-spectrum lamp comprises a fluorescent lamp and the discrete-spectrum light source drive circuit comprises a ballast circuit for driving the fluorescent lamp, the ballast circuit comprising an inverter circuit for converting the bus voltage to a high-frequency AC voltage, and a resonant tank circuit for coupling the high-frequency AC voltage to the fluorescent lamp, the control circuit coupled to the inverter circuit for controlling the magnitude of a lamp current conducted through the fluorescent lamp.

9. The hybrid light source of claim 7, further comprising:

a rectifier circuit coupled between the input terminals and generating a rectified voltage at an output, the series combination of the semiconductor switch and the continuous-spectrum lamp of the continuous-spectrum light source circuit coupled across the output of the rectifier circuit for receiving the second rectified voltage.

10. The hybrid light source of claim 1, wherein the continuous-spectrum light source circuit comprises a semiconductor switch coupled in series electrical connection with the continuous-spectrum lamp for controlling the amount of power delivered to the continuous-spectrum lamp.

11. The hybrid light source of claim 10, further comprising:

two input terminals adapted to receive the phase-controlled voltage;

a first rectifier circuit coupled between the input terminals and generating a first rectified voltage at an output, the discrete-spectrum light source circuit coupled to the output of the first rectifier circuit for receiving the first rectified voltage.

12. The hybrid light source of claim 11, wherein the ballast circuit comprises a bus capacitor coupled across the output of the first rectifier circuit for producing a bus voltage, an inverter circuit for converting the bus voltage to a high-frequency AC voltage, and a resonant tank circuit for coupling the high-frequency AC voltage to the fluorescent lamp, the control circuit coupled to the inverter circuit for controlling the magnitude of a lamp current conducted through the fluorescent lamp.

13. The hybrid light source of claim 11, wherein the series combination of the semiconductor switch and the continuous-spectrum lamp of the continuous-spectrum light source circuit is coupled across the output of the first rectifier circuit for receiving the first rectified voltage.

14. The hybrid light source of claim 11, further comprising:

a second rectifier circuit coupled between the input terminals and generating a second rectified voltage at an output, the series combination of the semiconductor switch and the continuous-spectrum lamp of the continuous-spectrum light source circuit coupled across the output of the second rectifier circuit for receiving the second rectified voltage.

15. The hybrid light source of claim 10, wherein the control circuit is operable to control the semiconductor switch of the continuous-spectrum light source circuit to pulse-width modulate the voltage provided across the continuous-spectrum lamp to control the amount of power delivered to the continuous-spectrum lamp when the magnitude of the phase-controlled voltage is above the predetermined zero-crossing threshold voltage.

16. The hybrid light source of claim 1, wherein the continuous-spectrum lamp comprises a halogen lamp and the continuous-spectrum light source drive circuit comprises a halogen drive circuit.

17. The hybrid light source of claim 1, wherein the zero-crossing threshold voltage of the zero-crossing detect circuit has a first magnitude when the phase-controlled voltage is less than the zero-crossing threshold voltage, and a second magnitude when the phase-controlled voltage is greater than the zero-crossing threshold voltage, the first magnitude greater than the second magnitude.

18. The hybrid light source of claim 1, wherein the control circuit turns off the discrete-spectrum lamp when the total light intensity is below the transition intensity, such that the continuous-spectrum lamp produces all of the total light intensity of the hybrid light source when the total light intensity is below the transition intensity.

19. A dimmable hybrid light source adapted to receive a phase-controlled voltage, the hybrid light source comprising:

a discrete-spectrum light source circuit comprising a discrete-spectrum lamp;

a continuous-spectrum light source circuit comprising a continuous-spectrum lamp operable to conduct a continuous-spectrum lamp current;

a zero-crossing detect circuit for detecting when the magnitude of the phase-controlled voltage is approximately zero volts; and a control circuit coupled to both the discrete-spectrum light source circuit and the continuous-spectrum light source circuit for individually controlling the amount of power delivered to each of the discrete-spectrum lamp and the continuous-spectrum lamp in response to the zero-crossing detect circuit;

wherein the control circuit controls the continuous-spectrum light source circuit such that the continuous-spectrum lamp is operable to conduct the continuous-spectrum lamp current when the phase-controlled voltage across the hybrid light source is approximately zero volts.

20. The hybrid light source of claim 19, wherein the continuous-spectrum light source circuit comprises at least one semiconductor switch coupled so as to control the flow of the continuous-spectrum lamp current through the continuous-spectrum lamp.

21. The hybrid light source of claim 20, further comprising:

two input terminals adapted to receive the phase-controlled voltage;

a voltage doubler circuit coupled between the input terminals and generating a bus voltage at an output, the discrete-spectrum light source circuit coupled to the output of the voltage doubler circuit for receiving the bus voltage.

22. The hybrid light source of claim 21, wherein the discrete-spectrum lamp comprises a fluorescent lamp and the discrete-spectrum light source drive circuit comprises a ballast circuit for driving the fluorescent lamp, the ballast circuit comprising an inverter circuit for converting the bus voltage to a high-frequency AC voltage, and a resonant tank circuit for coupling the high-frequency AC voltage to the fluorescent lamp, the control circuit coupled to the inverter circuit for controlling the magnitude of a lamp current conducted through the fluorescent lamp.

23. The hybrid light source of claim 21, further comprising:

a rectifier circuit coupled between the input terminals and generating a rectified voltage at an output, the series combination of the semiconductor switch and the continuous-spectrum lamp of the continuous-spectrum light source circuit coupled across the output of the rectifier circuit for receiving the second rectified voltage.

24. The hybrid light source of claim 20, wherein the control circuit controls the continuous-spectrum light source circuit to drive the semiconductor switch to be conductive and non-conductive with a duty cycle, the control circuit adjusting the duty cycle of the continuous-spectrum light source circuit to a maximum duty cycle such that the continuous-spectrum lamp conducts the continuous-spectrum lamp current when the magnitude of the phase-controlled voltage across the hybrid light source is approximately zero volts.

25. The hybrid light source of claim 24, wherein the continuous-spectrum lamp comprises a low-voltage halogen lamp and the continuous-spectrum light source drive circuit comprises a low-voltage halogen drive circuit and a low-voltage transformer.

26. The hybrid light source of claim 19, wherein the continuous-spectrum light source circuit comprises a semiconductor switch coupled in series electrical connection with the continuous-spectrum lamp for controlling the amount of power delivered to the continuous-spectrum lamp.

27. The hybrid light source of claim 26, further comprising:

two input terminals adapted to receive the phase-controlled voltage;

a first rectifier circuit coupled between the input terminals and generating a first rectified voltage at an output, the discrete-spectrum light source circuit coupled to the output of the first rectifier circuit for receiving the first rectified voltage.

28. The hybrid light source of claim 27, wherein the discrete-spectrum lamp comprises a fluorescent lamp and the discrete-spectrum light source drive circuit comprises a ballast circuit for driving the fluorescent lamp, the ballast circuit comprising a bus capacitor coupled across the output of the first rectifier circuit for producing a bus voltage, and an inverter circuit for converting the bus voltage to a high-frequency AC voltage, and a resonant tank circuit for coupling the high-frequency AC voltage to the fluorescent lamp, the control circuit coupled to the inverter circuit for controlling the magnitude of a lamp current conducted through the fluorescent lamp.

29. The hybrid light source of claim 27, wherein the series combination of the semiconductor switch and the continuous-spectrum lamp of the continuous-spectrum light source circuit is coupled across the output of the first rectifier circuit for receiving the first rectified voltage.

30. The hybrid light source of claim 27, further comprising:

a second rectifier circuit coupled between the input terminals and generating a second rectified voltage at an output, the series combination of the semiconductor switch and the continuous-spectrum lamp of the continuous-spectrum light source circuit coupled across the output of the second rectifier circuit for receiving the second rectified voltage.

31. The hybrid light source of claim 19, wherein the continuous-spectrum lamp comprises a halogen lamp and the continuous-spectrum light source drive circuit comprises a halogen drive circuit.

32. The hybrid light source of claim 19, wherein the zero-crossing threshold voltage of the zero-crossing detect circuit has a first magnitude when the phase-controlled voltage is less than the zero-crossing threshold voltage, and a second magnitude when the phase-controlled voltage is greater than the zero-crossing threshold voltage, the first magnitude greater than the second magnitude.

* * * * *